US006528243B2

(12) United States Patent
Koide et al.

(10) Patent No.: US 6,528,243 B2
(45) Date of Patent: Mar. 4, 2003

(54) SILVER HALIDE COLOR PHOTOGRAPHIC LIGHT-SENSITIVE MATERIAL

(75) Inventors: Tomoyuki Koide, Minami-ashigara (JP); Toshio Kawagishi, Minami-ashigara (JP)

(73) Assignee: Fuji Photo Film Co., Ltd., Minami-ashigara (JP)

( * ) Notice: Subject to any disclaimer, the term of this patent is extended or adjusted under 35 U.S.C. 154(b) by 0 days.

(21) Appl. No.: 09/983,805

(22) Filed: Oct. 25, 2001

(65) Prior Publication Data

US 2002/0102504 A1 Aug. 1, 2002

(30) Foreign Application Priority Data

Oct. 27, 2000 (JP) ..... 2000-329527

(51) Int. Cl.[7] ..... G03C 1/08; G03C 7/26; G03C 7/32

(52) U.S. Cl. ..... 430/543; 430/567; 430/550; 430/600; 430/601; 430/603; 430/351; 430/206; 430/376; 430/471

(58) Field of Search ..... 430/567, 550, 430/543, 600, 601, 603, 351, 206, 376, 471

(56) References Cited

U.S. PATENT DOCUMENTS 4,426,441 A * 1/1984 Adin et al. ..... 430/351
5,250,403 A 10/1993 Antoniades et al.
5,561,033 A * 10/1996 Kashi et al. ..... 430/567
6,114,105 A * 9/2000 Brust et al. ..... 430/567

FOREIGN PATENT DOCUMENTS

| | | |
|---|---|---|
| JP | 62-78555 | 4/1987 |
| JP | 62-79447 | 4/1987 |
| JP | 2-48101 | 10/1990 |

* cited by examiner

*Primary Examiner*—Geraldine Letscher
(74) *Attorney, Agent, or Firm*—Birch, Stewart, Kolasch & Birch, LLP

(57) ABSTRACT

A silver halide color photographic light-sensitive material has a support provided thereon a photographic constitutional layer including at least one photographic light-sensitive layer that contains a light-sensitive silver halide, an organosilver salt having a nitrogen-containing heterocycle, a compound capable of forming a dye by coupling reaction with an oxidized developing agent, and a binder, wherein the light-sensitive layer contains:

(A) as the silver halide, a silver halide emulsion composed of tabular silver halide grains having a main face made up of a (111) plane, an average diameter of an equivalent circle of at least 0.70 $\mu$m, and an average thickness of less than 0.20 $\mu$m; and (B) as the organosilver salt, a compound in which a hydrogen on a 5- or 6-membered nitrogen-containing heterocycle having at least one —NH— group is replaced with Ag.

14 Claims, No Drawings

SILVER HALIDE COLOR PHOTOGRAPHIC LIGHT-SENSITIVE MATERIAL

FIELD OF THE INVENTION

The present invention relates to a novel silver halide color photographic light-sensitive material, which is utilized to record an image.

BACKGROUND OF THE INVENTION

Photographic light-sensitive materials utilizing a silver halide have been increasingly developed in recent years, bringing about the present situation in which a high-quality color image is readily available. For example, in a system generally called color photography, a color negative film is utilized to take a photograph, and image information that is recorded on the color negative film after processing, is optically printed on a color photographic printing paper, to obtain a color print. This process has been highly developed in recent years, driving the spread of color laboratories, which are large-scaled central bases producing a large number of color prints with high efficiency, and so-called minilabs, which are small-sized and simple printer processors set up in shops; and it becomes possible to allow anyone to enjoy color photography conveniently.

The principle of color photography, which is currently spreading, is based on color reproduction according to a subtractive color process. In usual color negative, light-sensitive layers, utilizing silver halide emulsions, which are light-sensitive elements provided with light sensitivity in blue, green, and red regions, are provided on a transparent support, and so-called color couplers that respectively form a yellow, a magenta, and a cyan dye, which has a complementary hue in each light-sensitive layers, are contained in these light-sensitive layers in combination, respectively.

The color negative film, exposed image-wise by photographing, is processed in a color-developing solution containing an aromatic primary amine developing agent. At this time, the sensitized silver halide grain is developed, i.e. reduced, by the developing agent, and each dye is formed by a coupling reaction between an oxidized product of the developing agent, which is formed concurrently with the foregoing reduction, and the above-mentioned respective color coupler. Metal silver (developed silver) produced by the development, and unreacted silver halide, are removed through bleaching and fixing processes respectively, to obtain a dye image.

A color photographic printing paper, which is a color light-sensitive material, obtained by applying, on a reflective support, light-sensitive layers having a combination of a light-sensitive wavelength regions and hues to be produced in each layer similar to that of the color negative film, is optically exposed through the processed color negative film. Then, the resultant paper is subjected to the color-developing, bleaching, and fixing processes similar to the case of the negative film, to obtain a color print composed of a dye image, with which the original scene is reproduced.

These systems are widespread at present, but there is an increasingly strong need to improve the simplicity of these systems. First, for processing baths used for carrying out the aforementioned color-developing, bleaching, and fixing processes, the compositions and temperatures of these baths must be exactly controlled, requiring special knowledge and skilled operation. Second, these processing solutions contain substances, such as a color-developing agent and a bleaching agent of an iron chelating compound, whose discharge must be regulated from the environmental viewpoint. Therefore special equipment is often required for the installation of processing instruments. Third, it takes time for these development processings, though the processing time required for these processings is reduced by recent development in the technologies concerned. It can be said that the level of time reduction is still insufficient to satisfy the present need for reproducing a recorded image rapidly.

In view of these standpoints, many proposals concerning improved techniques have been offered. A variety of techniques utilizing heat development have been proposed with the intention of, particularly, simplifying and accelerating a development processing.

There are descriptions concerning heat-developable light-sensitive materials and processes used for these materials in, for example, "Shasin Kogaku no Kiso", Higinen Shashinhen, (published by Corona-sha, 1982), pp. 242 to 255.

Many methods have been proposed concerning methods to obtain a color image by heat development. For example, methods of forming a color image by a binding reaction of an oxidized product of a developing agent and a coupler are proposed in U.S. Pat. No. 3,531,286, U.S. Pat. No. 3,761,270, and U.S. Pat. No. 4,021,240; Belgian Patent No. 802519, Research Disclosure (hereinafter abbreviated to as RD), September (1975), pp.31–32, and the like.

However, in these methods, a relatively long time is generally required for processing, and the resulted image is highly foggy and has low image density, which are still insufficient.

As a system that does not require a processing solution containing a color-developing agent, a PICTROGRAPHY (trade name) system, and a PICTROSTAT (trade name) system, are provided by Fuji Photo Film Co., Ltd. In this system, a small amount of water is supplied to a light-sensitive material containing a base precursor, and the light-sensitive material is superimposed to an image-receiving material, followed by heating, to cause a development reaction. This system is environmentally advantageous in the point that the aforementioned processing bath (solution) is not used. However, this system is used for the purpose of fixing the formed dye to a dye-fixing layer, and appreciating it as a dye image.

All of the aforementioned systems are used for the purpose of appreciation use, and the development of a system that can be used for a recording material for photographing is desired.

Because it is demanded that silver halide light-sensitive materials for photographing have high sensitivity, it is essential to increase the sensitivity of a silver halide grain, and a tabular grain is therefore used by preference.

Various silver halide grains preferably used in heat development systems, in which processing is carried out at a high temperature, have been proposed. For example, JP-B-2-48101 ("JP-B" means examined Japanese patent publication) discloses a technique for improving the thermal-developing progress characteristics, by using a tabular silver halide having a grain diameter five times the grain thickness or more, in a thermal-developing light-sensitive material.

Also, JP-A-62-78555 ("JP-A" means unexamined published Japanese patent application) discloses a technique for improving the long-term storage stability of a thermal-developing light-sensitive material, by allowing the light-sensitive material to contain a tabular light-sensitive silver halide grain, in which the content of silver iodide is 4 to 40 mol %, and the ratio of the grain diameter to the grain thickness is 5 or more, in an amount of 0.05 to 1 mol, per mol of an organosilver salt.

Moreover, JP-A-62-79447 discloses a technique for improving the sensitivity and the maximum density in processing, by allowing a light-sensitive material to contain a tabular light-sensitive silver halide grain in which the ratio of the grain diameter to the grain thickness is 5 or more, and a light-sensitive silver halide grain in which the content of a silver iodide is 4 to 40 mol % and the average grain diameter is 0.4 μm or less.

An attempt has been made to make a structure of a light-sensitive material for photographing that can be processed simply and rapidly, by applying each of these emulsions utilizing tabular grains to the aforementioned thermal-developing system. However, it was found that the use of the tabular grain brings about insufficient sensitivity and maximum density, creating a hindrance to practical use.

A technique regarding tabular silver halide grains having a thin grain thickness and an average diameter of a circle whose area is equivalent to a projected area of an individual grain (hereinafter which is also referred to simply as an average diameter of an equivalent circle) of less than 0.7 μm (these grains are hereinafter referred to as "ultra-thin tabular grains"), is disclosed, for example, in U.S. Pat. No. 5,250,403. According to the specification of this U.S. Patent, although these silver halide grains exhibit such advantages as effective utilization of silver and an improved relationship between sensitivity and granularity, the maximum density contrarily drops if the average diameter of an equivalent circle becomes 0.7 μm or greater, despite a rise in sensitivity.

SUMMARY OF THE INVENTION

The present invention is a silver halide color photographic light-sensitive material that comprises a support provided thereon a photographic constitutional layer including at least one photographic light-sensitive layer that comprises a light-sensitive silver halide, an organosilver salt having a nitrogen-containing heterocycle, a compound capable of forming a dye by a coupling reaction with an oxidized product of a developing agent, and a binder, wherein the photographic light-sensitive layer contains:

(A) as the light-sensitive silver halide, a silver halide emulsion composed of tabular silver halide grains having a main face made up of a (111) plane, an average diameter of a circle whose area is equivalent to a projected area of an individual grain of at least 0.70 μm, and an average thickness of less than 0.20 μm; and (B) as the organosilver salt, a compound in which a hydrogen on a 5- or 6-membered nitrogen-containing heterocycle having at least one —NH— group is replaced with Ag.

Other and further features and advantages of the invention will appear more fully from the following description.

DETAILED DESCRIPTION OF THE INVENTION

According to the present invention, there are provided the following means:

(1) A silver halide color photographic light-sensitive material, comprising a support provided thereon a photographic constitutional layer including at least one photographic light-sensitive layer that comprises a light-sensitive silver halide, an organosilver salt having a nitrogen-containing heterocycle, a compound capable of forming a dye by a coupling reaction with an oxidized product of a developing agent (this compound is hereinafter referred to simply as a coupler), and a binder, wherein the photographic light-sensitive layer contains:

(A) as the light-sensitive silver halide, a silver halide emulsion composed of tabular silver halide grains having a main face made up of a (111) plane, an average diameter of a circle whose area is equivalent to a projected area of an individual grain of at least 0.70 μm, and an average thickness of less than 0.20 μm; and (B) as the organosilver salt, a compound in which a hydrogen on a 5- or 6-membered nitrogen-containing heterocycle having at least one —NH— group is replaced with Ag.

(2) A silver halide color photographic light-sensitive material according to the above item (1), wherein the organosilver salt having a nitrogen-containing heterocycle is a silver salt of a benzotriazole compound having at a 5-position thereof an alkyl group having 1 to 12 carbon atoms.

(3) A silver halide color photographic light-sensitive material according to any one of the above items (1) to (2), wherein the tabular silver halide grains contained in the silver halide emulsion contain a bromide in an amount exceeding 70 mole % and an iodide in an amount from 0.30 to 10 mole % to the silver.

(4) A silver halide color photographic light-sensitive material according to any one of the above items (1) to (3), wherein the silver halide emulsion is being chemically sensitized by a tellurium sensitizer.

(5) A silver halide color photographic light-sensitive material according to any one of the above items (1) to (4), wherein the light-sensitive material contains a developing agent.

(6) A silver halide color photographic light-sensitive material according to any one of the above items (1) to (5), wherein the light-sensitive material is heat-developable at 75° C. or above.

The present invention is explained in detail below.

The organosilver salt having a nitrogen-containing heterocycle to be used in the silver halide color light-sensitive material of the present invention is a compound in which a hydrogen on a 5- or 6-membered nitrogen-containing heterocycle having at least one —NH— group is replaced with Ag. The nitrogen-containing heterocycle having at least one —NH— group may further be condensed with a benzene ring or a 5- to 7-membered aromatic heterocycle. Examples of the nitrogen-containing heterocyclic compound for the formation of such a silver salt include pyrazole, imidazole, 1,2,3-trizaole, 1,2,4-trizaole, tetrazole, succinimide, phthalimide, glutarimide, 1,3-oxazolidine-2,4-dione, and hydantoin, as well as a condensed heterocycle which is formed by the condensation with a benzene ring or a 5- to 7-membered aromatic heterocycle to any one of the rings listed above.

If the nitrogen-containing heterocyclic compound for the formation of the silver salt is a compound that can be substituted, the nitrogen-containing heterocyclic compound may have a substituent. Preferred examples of the substituent include a halogen atom, an alkyl group (including a cycloalkyl group and a bridged cyclic alkyl group (e.g., a bicycloalkyl or the like)), an alkenyl group (including a cycloalkenyl group and a bridged cyclic alkenyl group (e.g., a bicycloalkenyl or the like)), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclic thio group, a sulfamoyl group, a sulfo group, an alkyl- or arylsulfinyl group, an alkyl- or arylsulfonyl group, an acyl group, an aryloxycarbonyl group, an alkoxycarbonyl group, a carbamoyl group, an aryl- or heterocyclic azo group, an imido group, a phosphino group, a phosphinyl group, a phosphinyloxy group, a phosphinylamino group, an a silyl group.

More specific examples of the substituent include the followings: A halogen atom (e.g., chlorine, bromine, and iodine atom); an alkyl group {a straight-chain, branched, or cyclic alkyl group which may be substituted or unsubstituted, including an alkyl group (preferably a substituted or unsubstituted alkyl group having 1 to 30 carbon atoms, for example, methyl, ethyl, n-propyl, isopropyl, t-butyl, n-octyl, eicosyl, 2-chloroethyl, 2-cyanoethyl, and 2-ethylhexy), a cycloalkyl group (preferably a substituted or unsubstituted cycloalkyl group having 3 to 30 carbon atoms, for example, cyclohexyl, cyclopentyl, and 4-n-dodecylcyclohexyl), a bicycloalkyl group (preferably a substituted or unsubstituted bicycloalkyl group having 5 to 30 carbon atoms, that is, a monovalent group formed by eliminating one hydrogen atom from an bicycloalkane having 5 to 30 carbon atoms. Examples thereof include bicyclo[1,2,2]heptane-2-yl, bicyclo[2,2,2]octane-3-yl), and a structure having more rings such as a tricyclo-structure. The alkyl groups constituting the following substituents (e.g., the alkyl group of an alkylthio group) represent the alkyl groups based on the above-described concept.}; an alkenyl group {a straight-chain, branched, or cyclic alkenyl group which may be substituted or unsubstituted. Examples of the alkenyl group include an alkenyl group (preferably a substituted or unsubstituted alkenyl group having 2 to 30 carbon atoms, for example, vinyl, ally, prenyl, geranyl, and oleyl), a cycloalkenyl group (preferably a substituted or unsubstituted cycloalkenyl group having 3 to 30 carbon atoms, that is, a monovalent group formed by eliminating one hydrogen atom from an cycloalkene having 3 to 30 carbon atoms, for example, 2-cyclopentene-1-yl and 2-cyclohexene-1-yl), a bicycloalkenyl group (a substituted or unsubstituted bicycloalkenyl group, preferably a substituted or unsubstituted bicycloalkyl group having 5 to 30 carbon atoms, that is, a monovalent group formed by eliminating one hydrogen atom from an bicycloalkene having one double bond, for example, bicyclo[2,2,1]hepto-2-en-1-yl, bicyclo[2,2,2]octo-2-en-4-yl, and the like)}; an alkynyl group (preferably a substituted or unsubstituted alkynyl group having 2 to 30 carbon atoms, for example, ethynyl, propargyl, and trimethylsilylethynyl); an aryl group (preferably a substituted or unsubstituted aryl group having 6 to 30 carbon atoms, for example, phenyl, p-tolyl, naphthyl, m-chlorophenyl, and o-hexadecanoylaminophenyl); a heterocyclic group (preferably a monovalent group formed by eliminating a hydrogen atom from a 5- or 6-membered, substituted or unsubstituted, aromatic or nonaromatic heterocyclic compound, more preferably a 5- or 6-membered, aromatic heterocycric group having 3 to 30 carbon atoms, for example, 2-furyl, 2-thienyl, 2-pyrimidinyl, and 2-benzothiazolyl); a cyano group; a hydroxyl group; a nitro group; a carboxyl group; an alkoxy group (preferably a substituted or unsubstituted alkoxy group having 1 to 30 carbon atoms, for example, methoxy, ethoxy, isopropoxy, t-butoxy, n-octyloxy, and 2-methoxyethoxy); an aryloxy group (preferably a substituted or unsubstituted aryloxy group having 6 to 30 carbon atoms, for example, phenoxy, 2-methylphenoxy, 4-t-butylphenoxy, 3-nitrophenoxy, and 2-tetradecanoylaminophenoxy); a silyloxy group (preferably a silyloxy group having 3 to 20 carbon atoms, for example, trimethylsilyloxy an t-butyldimethylsilyloxy); a heterocyclic oxy group (preferably a substituted or unsubstituted heterocyclic oxy group having 2 to 30 carbon atoms, for example, 1-phenyltetrazole-5-oxy and 2-tetrahydropyranyloxy); an acyloxy group (preferably a formyloxy group, a substituted or unsubstituted alkylcarbonyloxy group having 2 to 30 carbon atoms, and a substituted or unsubstituted arylcarbonyloxy group having 6 to 30 carbon atoms, for example, formyloxy, acetyloxy, pivaloyloxy, stearoyloxy, benzoyloxy, and p-methoxyphenylcarbonyloxy); a carbamoyloxy group (preferably a substituted or unsubstituted carbamoyloxy group having 1 to 30 carbon atoms, for example, N,N-dimethylcarbamoyloxy, N,N-diethylcarbamoyloxy, morpholinocarbonyloxy, N,N-di-n-octylaminocarbonyloxy, and N-n-octylcarbamoyloxy); an alkoxycarbonyloxy group (preferably a substituted or unsubstituted alkoxycarbonyloxy group having 2 to 30 carbon atoms, for example, methoxycarbonyloxy, ethoxycarbonyloxy, t-butoxycarbonyloxy, and n-octyloxycarbonyloxy); an aryloxycarbonyloxy group (preferably a substituted or unsubstituted aryloxycarbonyloxy group having 7 to 30 carbon atoms, for example, phenoxycarbonyloxy, p-methoxyphenoxycarbonyloxy, and p-n-hexadecyloxyphenoxycarbonyloxy); an amino group (preferably an amino group, a substituted or unsubstituted alkylamino group having 1 to 30 carbon atoms, and a substituted or unsubstituted anilino group having 6 to 30 carbon atoms, for example, amino, methylamino, dimethylamino, anilino, N-methylanilino, and diphenylamino); an acylamino group (including a diacylamino group, preferably a formylamino group, a substituted or unsubstituted alkylcarbonylamino group having 1 to 30 carbon atoms, and a substituted or unsubstituted arylcarbonylamino group having 6 to 30 carbon atoms, for example, formylamino, acetylamino, pivaloylamino, lauroylamino, benzoylamino, and 3,4,5-tri-n-octyloxyphenylcarbonylamino); an aminocarbonylamino group (preferably a substituted or unsubstituted aminocarbonylamino group having 1 to 30 carbon atoms, for example, carbamoylamino, N,N-dimethylaminocarbonylamino, N,N-diethylaminocarbonylamino, and morpholinocarbonylamino); an alkoxycarbonylamino group (preferably a substituted or unsubstituted alkoxycarbonylamino group having 2 to 30 carbon atoms, for example, methoxycarbonylamino, ethoxycarbonylamino, t-butoxycarbonylamino, n-octadecyloxycarbonylamino, and N-methyl-methoxycarbonylamino); an aryloxycarbonylamino group (preferably a substituted or unsubstituted aryloxycarbonylamino group having 7 to 30 carbon atoms, for example, phenoxycarbonylamino, p-chlorophenoxycarbonylamino, and m-n-octyloxyphenoxycarbonylamino); a sulfamoylamino group (preferably a substituted or unsubstituted sulfamoylamino group having 0 to 30 carbon atoms, for example, sulfamoylamino, N,N-dimethylaminosulfonylamino, and N-n-octylaminosulfonylamino); an alkyl- or arylsulfonylamino group (preferably a substituted or unsubstituted alkylsulfonylamino group having 1 to 30 carbon atoms and a substituted or unsubstituted arylsulfonylamino group having 6 to 30 carbon atoms, for example, methylsulfonylamino, butylsulfonylamino, phenylsulfonylamino, 2,3,5-trichlorophenylsulfonylamino, and p-methylphenylsulfonylamino); a mercapto group; an alkylthio group (preferably a substituted or unsubstituted alkylthio group having 1 to 30 carbon atoms, for example, methylthio, ethylthio, and n-hexadecylthio); an arylthio group (preferably a substituted or unsubstituted arylthio group having 6 to 30 carbon atoms, for example, phenylthio, p-chlorophenylthio, and m-methoxyphenylthio); a heterocyclic thio group (preferably a substituted or unsubstituted heterocyclic thio group having 2 to 30 carbon atoms, for example, 1-methyltetrazole-5-yl-thio, 2-benzothiazolylthio, and I-phenyltetrazole-5-yl-thio); a sulfamoyl group (preferably a substituted or unsubstituted sulfamoyl group having 0 to 30 carbon atoms, for example, N-ethylsulfamoyl, N-(3-dodecyloxypropyl)sulfamoyl, N,N-dimethylsulfamonyl, N-acetylsulfamoyl, N-benzoylsulfamonyl, and N-(N'-phenylcarbamoyl) sulfamoyl; a sulfo group; an alkyl- or arylsulfinyl group (preferably a substituted or unsubstituted alkylsulfinyl group having 1 to 30 carbon atoms and a substituted or unsubstituted arylsulfinyl group having 6 to 30 carbon atoms, for example, methylsulfinyl, ethylsulfinyl, phenylsulfinyl, and p-methylphenylsulfinyl); an alkyl- or arylsulfonyl group (preferably a substituted or unsubstituted alkylsulfonyl group having 1 to 30 carbon atoms and a substituted or unsubstituted arylsulfonyl group having 6 to 30 carbon atoms, for example, methylsulfonyl, ethylsulfonyl, phenylsulfonyl, and p-methylphenylsulfonyl); an acyl group (preferably a formyl group, a substituted or unsubstituted alkylcarbonyl group having 2 to 30 carbon atoms, and a substituted or unsubstituted arylcarbonyl group having 7 to 30 carbon atoms, for example, acetyl, pivaloyl, 2-chloroacetyl, stearoyl, benzoyl, and p-n-octyloxyphenylcarbonyl); an aryloxycarbonyl group (preferably a substituted or unsubstituted aryloxycarbonyl group having 7 to 30 carbon atoms, for example, phenoxycarbonyl, o-chlorophenoxycarbonyl, m-nitrophenoxycarbonyl, and p-t-butylphenoxycarbonyl); an alkoxycarbonyl group (preferably a substituted or unsubstituted alkoxycarbonyl group having 2 to 30 carbon atoms, for example, methoxycarbonyl, ethoxycarbonyl, t-butoxycarbonyl, and n-octadecyloxycarbonyl); a carbamoyl group (preferably a substituted or unsubstituted carbamoyl group having 1 to 30 carbon atoms, for example, carbamoyl, N-methylcarbamoyl, N,N-dimethylcarbamoyl, N,N-di-n-octylcarbamoyl, and N-(methylsulfonyl) carbamoyl); an arylazo or heterocyclic azo group (preferably a substituted or unsubstituted arylazo group having 6 to 30 carbon atoms and a substituted or unsubstituted heterocyclic azo group having 3 to 30 carbon atoms, for example, phenylazo, p-chlorophenylazo, and 5-ethylthio-1,3,4-thiadiazole-2-yl-azo); an imido group (preferably N-succinimido and N-phthalimido); a phosphino group (preferably a substituted of unsubstituted phosphino group having 2 to 30 carbon atoms, for example, dimethylphosphino, diphenylphosphino, and methylphenoxyphosphino); a phosphinyl group (preferably a substituted or unsubstituted phosphinyl group having 2 to 30 carbon atoms, for example, phosphinyl, dioctyloxyphosphinyl, and diethoxyphosphinyl); a phosphinyloxy group (preferably a substituted or unsubstituted phosphinyloxy group having 2 to 30 carbon atoms, for example, diphenoxyphosphinyloxy and dioctyloxyphosphinyloxy); a phosphinylamino group (preferably a substituted or unsubstituted phosphinylamino group having 2 to 30 carbon atoms, for example, dimethoxyphosphinylamino and dimethylaminophosphinylamino); and a silyl group (preferably a substituted or unsubstituted silyl group having 3 to 30 carbon atoms, for example, trimethylsilyl, t-butyldimethylsilyl, and phenyldimethylsilyl).

Among the above substituents that the nitrogen-containing heterocyclic compound may have, a substituent having a hydrogen atom may be further substituted by any one of the substituents listed above by eliminating the behydrogen atom. Examples of such a substituent include an alkylcarbonylaminosulfonyl group, an arylcarbonylaminosulfonyl group, an alkylsulfonylaminocarbonyl group, an arylsulfonylaminocarbonyl group, and the like. Specific 9n examples thereof include methylsulfonylaminocarbonyl, p-methylphenylsulfonylaminocarbonyl, acetylaminosulfonyl, benzoylaminosulfonyl, and the like.

Among the above substituents that the nitrogen-containing heterocyclic compound may have, preferable are a halogen atom, an alkyl group, an aryl group, a heterocyclic group, a cyano group, a hydroxyl group, a nitro group, an alkoxy group, an amino group, an acylamino group, an alkyl- or arylsulfonylamino group, an alkylthio group, an arylthio group, an acyl group, an alkoxycarbonyl group, and a carbamoyl group. In the case in which the substituent that may be borne by the nitrogen-containing heterocyclic compound is an alkyl group, an aryl group, a heterocyclic group, an alkoxy group, an amino group, an acylamino group, an alkyl- or arylsulfonylamino group, an alkylthio group, an arylthio group, an acyl group, an aryloxycarbonyl group, or a carbamoyl group, the sum of the carbon atoms of the substituent is preferably in the range of 1 to 20, and more preferably in the range of 1 to 12.

In the organosilver salt having a nitrogen-containing heterocycle to be used in the present invention, the compositional proportion between the heterocycle moiety and the silver ion is not limited to 1:1. The organosilver salt may be a mixed complex containing an organic or inorganic ligand that may be anionic, cationic, or neutral. For example, the organosilver salt may be a salt containing, besides one mole of a silver ion and one mole of a heterocyclic anion, a heterocycle that can be coordinated to the silver ion. Alternatively, the organosilver salt may be a silver salt containing one mole of a silver ion and a total of one mole of two or more kinds of heterocyclic anions.

Among the silver salts of a nitrogen-containing heterocycle to be used in the present invention, a silver salt of a benzotriazole compound represented by the following formula (1) is particularly preferable. Formula (1)

Formula (1)

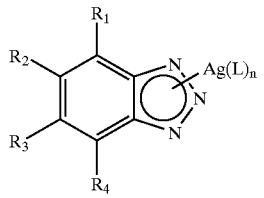

In the formula, $R_1$, $R_2$, $R_3$ and $R_4$ each represent a hydrogen atom or a substituent; L represents a ligand that can coordinate to silver; and n represent 0 or an integer of 1 to 3. In the case where $R_1$ to $R_4$ each represent a substituent, preferred examples of the substituent include a halogen atom, an alkyl group, an aryl group, a heterocyclic group, a cyano group, a hydroxyl group, a nitro group, an alkoxy group, an amino group, an acylamino group, an alkyl- or arylsulfonylamino group, an alkylthio group, an arylthio group, an acyl group, an alkoxycarbonyl group, and a carbamoyl group. The preferred number of carbon atoms and specific examples of these groups are the same as those described previously in the explanation of the substituent that may be borne by the nitrogen-containing heterocyclic compound. In the case where $R_1$ to $R_4$ each are an alkyl group, an aryl group, a heterocyclic group, an alkoxy group, an amino group, an acylamino group, an alkyl- or arylsulfonylamino group, an alkylthio group, an arylthio group, an acyl group, an alkoxycarbonyl group, or a carbamoyl group, the number of total carbon atoms of the substituent is preferably in the range of 1 to 20, and more preferably in the range of 1 to 12.

Among the silver salts of a benzotriazole compound represented by formula (1), preferable is a silver salt in which n is 0 and the compositional proportion between the benzotriazole moiety and the silver ion is approximately 1:1.

As to the benzotriazole moiety of the silver salt of a benzotriazole compound represented by formula (1), preferable is the case where $R_1$ and $R_4$ are each a hydrogen atom, and $R_2$ and/or $R_3$ each represent a hydrogen atom, a halogen atom, an alkyl group, an aryl group, a heterocyclic group, an alkoxy group, an amino group, an acylamino group, an alkyl- or arylsulfonylamino group, an alkylthio group, an arylthio group, an acyl group, an alkoxycarbonyl group, a cyano group, a nitro group, or a carbamoyl group; more preferable is the case where $R_1$ and $R_4$ each are a hydrogen atom, and $R_2$ or $R_3$ is a hydrogen atom, a halogen atom, an alkyl group, an acylamino group, or a nitro group; and most preferable is the case where $R_1$ and $R_4$ each are a hydrogen atom, and $R_2$ or $R_3$ is an alkyl group. The number of carbon atoms of this alkyl group is preferably 1 to 12.

Specific examples of the heterocyclic compound for use in the silver salt of a nitrogen-containing heterocycle that can be used in the present invention are given below. The table shows typical examples of the nitrogen-containing heterocyclic compounds which, by the elimination of a proton from —NH—, provide an anionic form capable of forming a salt with a silver ion such that the compositional proportion between the heterocyclic moiety and the silver ion is 1:1 in the salt. However, it should be understood that the present invention is not restricted by these examples.

| Compound number | Heterocyclic compound |
|---|---|
| HAG-1 | 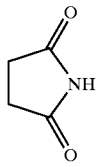 |
| HAG-2 | 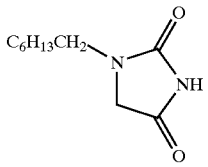 |

-continued

| Compound number | Heterocyclic compound |
|---|---|
| HAG-3 | 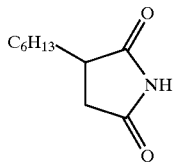 |
| HAG-4 | 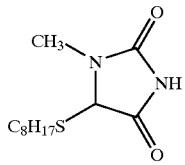 |
| HAG-5 | 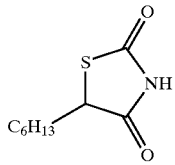 |
| HAG-6 | 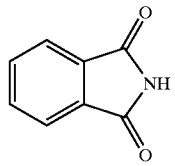 |
| HAG-7 | 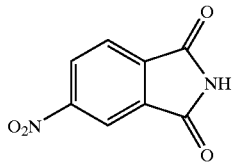 |
| HAG-8 | 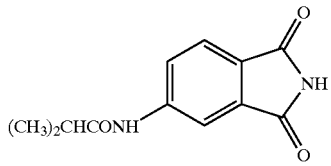 |
| HAG-9 | 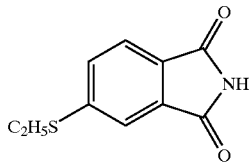 |
| HAG-10 | 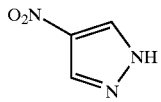 |
| HAG-11 | 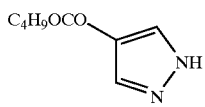 |

-continued
| Compound number | Heterocyclic compound |
|---|---|
| HAG-12 | 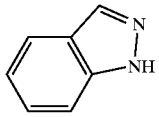 |
| HAG-13 | 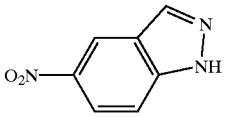 |
| HAG-14 | 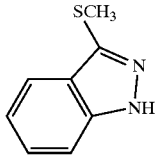 |
| HAG-15 | 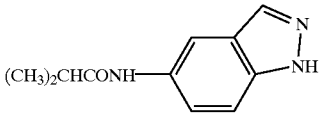 |
| HAG-16 | 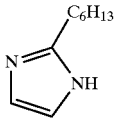 |
| HAG-17 | 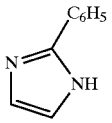 |
| HAG-18 | 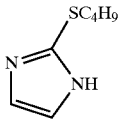 |
| HAG-19 | 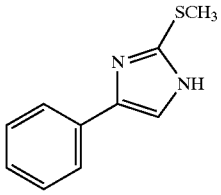 |
| HAG-20 | 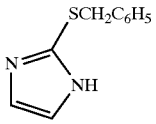 |
| HAG-21 | 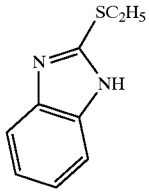 |
-continued
| Compound number | Heterocyclic compound |
|---|---|
| HAG-22 | 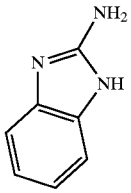 |
| HAG-23 | 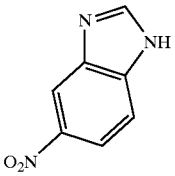 |
| HAG-24 | 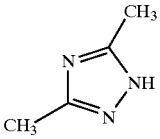 |
| HAG-25 | 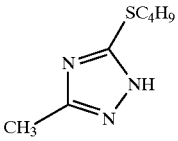 |
| HAG-26 | 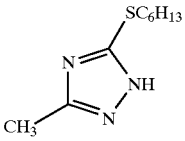 |
| HAG-27 | 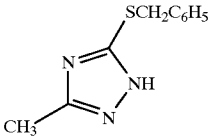 |
| HAG-28 | 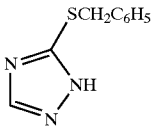 |
| HAG-29 | 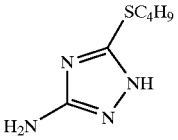 |
| HAG-30 | 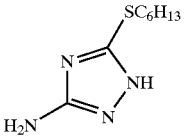 |

-continued
| Compound number | Heterocyclic compound |
|---|---|
| HAG-31 | 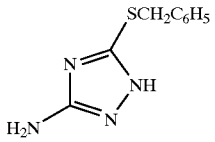 |
| HAG-32 | 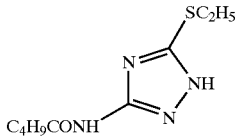 |
| HAG-33 | 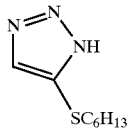 |
| HAG-34 | 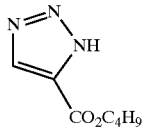 |
| HAG-35 | 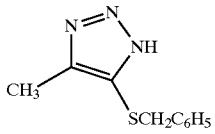 |
| HAG-36 | 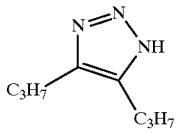 |
| HAG-37 | 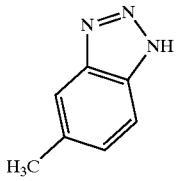 |
| HAG-38 | 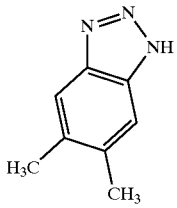 |
| HAG-39 | 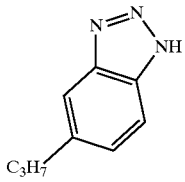 |
-continued
| Compound number | Heterocyclic compound |
|---|---|
| HAG-40 | 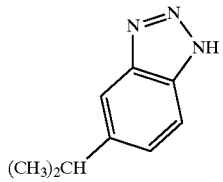 |
| HAG-41 | 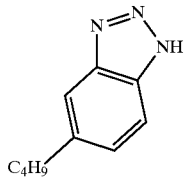 |
| HAG-42 | 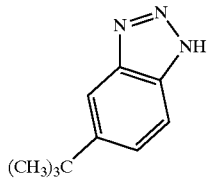 |
| HAG-43 | 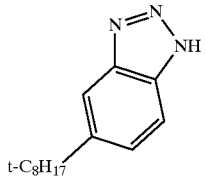 |
| HAG-44 | 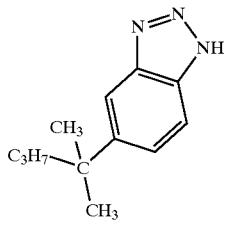 |
| HAG-45 | 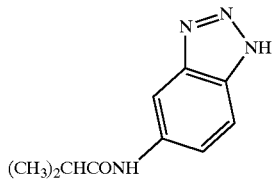 |
| HAG-46 | 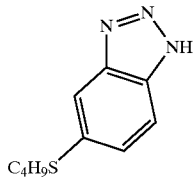 |

-continued
| Compound number | Heterocyclic compound |
|---|---|
| HAG-47 | 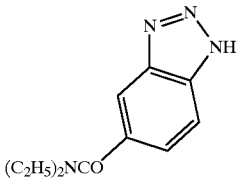 |
| HAG-48 | 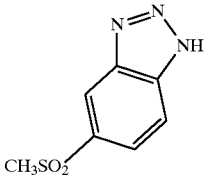 |
| HAG-49 | 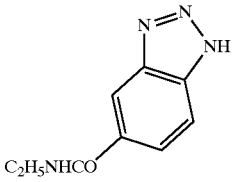 |
| HAG-50 | 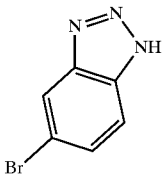 |
| HAG-51 | 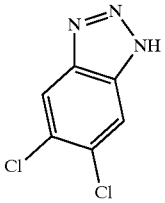 |
| HAG-52 | 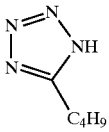 |
| HAG-53 | 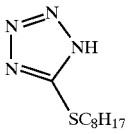 |
| HAG-54 | 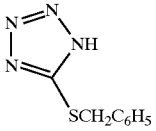 |
-continued
| Compound number | Heterocyclic compound |
|---|---|
| HAG-55 | 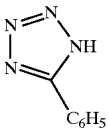 |
| HAG-56 | 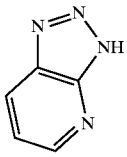 |
| HAG-57 | 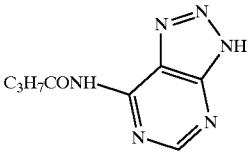 |
| HAG-58 | 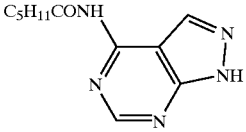 |
| HAG-59 | 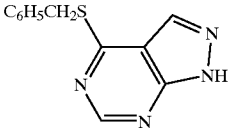 |
| HAG-60 | 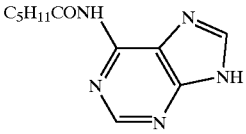 |
| HAG-61 | 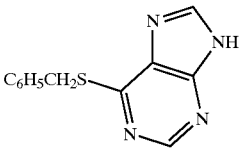 |
| HAG-62 | 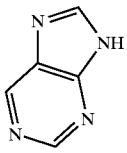 |
| HAG-63 | 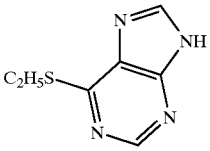 |

-continued

| Compound number | Heterocyclic compound |
|---|---|
| HAG-64 | 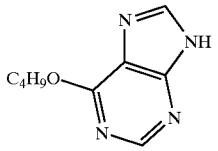 |
| HAG-65 | 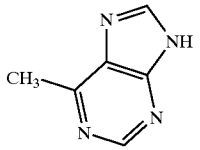 |
| HAG-66 | 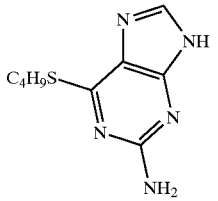 |
| HAG-67 | 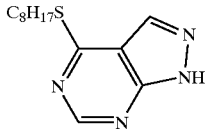 |
| HAG-68 | 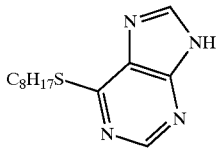 |
| HAG-69 | 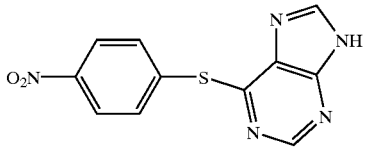 |
| HAG-70 | 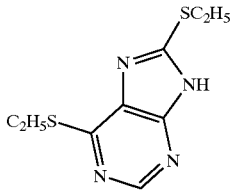 |
| HAG-71 | 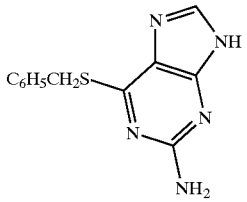 |

-continued

| Compound number | Heterocyclic compound |
|---|---|
| HAG-72 | 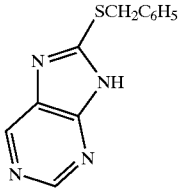 |

Examples of the tellurium sensitizer that can be used in the present invention may include known tellurium sensitizers described in U.S. Pat. No. 1,623,499, U.S. Pat. No. 3,320,069 and U.S. Pat. No. 3,772,031, U.K. Patents No. 235,211, U.S. Pat. No. 1,121,496, U.S. Pat. No. 1,295,462 and U.S. Pat. No. 1,396,696, Canadian Patent No. 800,958, JP-A-8-95184, Journal of Chemical Society Chemical Communication 635 (1980), ibid. 1102 (1979), ibid. 645 (1979), Journal of chemical Society Perkin Transaction 1, 2191 (1980), edited by S. Patai, "The chemistry of Organic Selenium and Tellurium compounds", Vol. 1 (1986), ibid. Vol. 2 (1987). Among these tellurium sensitizers, compounds represented by the following formula (I), (II) or (III) are preferable.

formula (I)

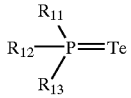

In the formula (I), $R_{11}$, $R_{12}$ and $R_{13}$ each represent an aliphatic group, an aromatic group, a heterocyclic group, $OR_{14}$, $NR_{15}(R_{16})$, $SR_{17}$, $OSiR_{18}(R_{19})(R_{20})$, X, or a hydrogen atom; $R_{14}$ and $R_{17}$ each represent an aliphatic group, an aromatic group, a heterocyclic group, a hydrogen atom, or a cation; $R_{15}$ and $R_{16}$ each represent an aliphatic group, an aromatic group, a heterocyclic group, or a hydrogen atom; $R_{18}$, $R_{19}$ and $R_{20}$ each represent an aliphatic group, and X represents a halogen atom.

In the formula (I), the aliphatic groups represented by $R_{11}$, $R_{12}$, $R_{13}$, $R_{14}$, $R_{15}$, $R_{16}$, $R_{17}$, $R_{18}$, $R_{19}$ and $R_{20}$ are preferably those having 1 to 30 carbon atoms, and particularly preferably straight-chain, branched or cyclic alkyl, alkenyl, alkynyl or aralkyl groups having 1 to 20 carbon atoms can be mentioned. Examples of the alkyl group, alkenyl group, alkynyl group and aralkyl group include methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentinyl, benzyl and phenethyl. The aromatic groups represented by $R_{11}$, $R_{12}$, $R_{13}$, $R_{14}$, $R_{15}$, $R_{16}$ and $R_{17}$ in the formula (I) are preferably those having 6 to 30 carbon atoms, and particularly preferably monocyclic or condensed-ring aryl groups having 6 to 20 carbon atoms, for example, phenyl and naphthyl, can be mentioned. The heterocyclic groups represented by $R_{11}$, $R_{12}$, $R_{13}$, $R_{14}$, $R_{15}$, $R_{16}$ and $R_{17}$ in the formula (I) are three- to ten-membered saturated or unsaturated heterocyclic groups containing at least one of a nitrogen atom, oxygen atom and sulfur atom. These groups may be respectively monocyclic, or may form a condensed ring in combination with another aromatic ring or heterocycle. Preferable examples of the heterocyclic group include five- or six-membered aromatic heterocycles, for example, pyridyl, furyl, thienyl, thiazolyl, imidazolyl, and benzimidazolyl. In the formula (I), the cation represented by $R_{14}$ and $R_{17}$ represents an alkali metal or ammonium. In the formula (I), the halogen atom represented by X represents, for example, a fluorine atom, a chlorine atom, a bromine atom or an iodine atom. Also, these aliphatic group, aromatic group and heterocyclic group may be substituted. As examples of the substituent, the followings can be mentioned. Typical examples of the substituent include an alkyl group, aralkyl group, alkenyl group, alkynyl group, aryl group, alkoxy group, aryloxy group, amino group, acylamino group, ureido group, urethane group, sulfonylamino group, sulfamoyl group, carbamoyl group, sulfonyl group, sulfinyl group, alkyloxycarbonyl group, aryloxycarbonyl group, acyl group, acyloxy group, phosphoric acid amido group, diacylamino group, imido group, alkylthio group, arylthio group, halogen atom, cyano group, sulfo group, carboxy group, hydroxy group, phosphono group, nitro group and heterocyclic group. These groups may be further substituted. When two or more substituents are present, they may be the same or different. $R_{11}$, $R_{12}$ and $R_{13}$ may bond with each other to form a ring together with a phosphorus atom, and $R_{15}$ and $R_{16}$ may bond with each other to form a nitrogen-containing heterocycle. In the formula (I), $R_{11}$, $R_{12}$ and $R_{13}$ each preferably represent an aliphatic group or an aromatic group, and more preferably an alkyl group or an aromatic group.

formula (II)

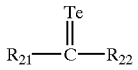

In the formula (II), $R_{21}$ represents an aliphatic group, an aromatic group, a heterocyclic group, or —$NR_{23}(R_{24})$; $R_{22}$ represents —$NR_{25}(R_{26})$, —N $(R_{27})N(R_{28})R_{29}$ or —$OR_{30}$; $R_{23}$, $R_{24}$, $R_{25}$, $R_{26}$, $R_{27}$, $R_{28}$, $R_{29}$ and $R_{30}$ each represent a hydrogen atom, an aliphatic group, an aromatic group, a heterocyclic group or an acyl group. Herein, each combination of $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ may bond together to form a ring. Next, the formula (II) will be explained in detail. In the formula (II), the aliphatic group, aromatic group, and heterocyclic group represented by $R_{21}$, $R_{22}$, $R_{23}$, $R_{24}$, $R_{25}$, $R_{26}$, $R_{27}$, $R_{28}$, $R_{29}$ and $R_{30}$ have the same meanings as defined in the formula (I). The acyl groups represented by $R_{23}$, $R_{24}$, $R_{25}$, $R_{26}$, $R_{27}$, $R_{28}$, $R_{29}$ and $R_{30}$ in the formula (II) are preferably those having 1 to 30 carbon atoms, and particularly preferably straight-chain or branched acyl groups having 1 to 20 carbon atoms. Examples of these acyl groups include acetyl, benzoyl, formyl, pivaloyl and decanoyl. Herein, when each of $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ bond together to form a ring, an alkylene group, arylene group, aralkylene group or alkenylene group can be mentioned as examples of these R's. Also, the aforementioned aliphatic group, aromatic group, and heterocyclic group may be substituted with the substituent given in the formula (I). In the formula (II), preferably, $R_{21}$ represents an aliphatic group, an aromatic group or —$NR_{23}(R_{24})$, and $R_{22}$ represents —$NR_{25}(R_{26})$, in which $R_{23}$, $R_{24}$, $R_{25}$ and $R_{26}$ each preferalby represent an aliphatic group or an aromatic group. In the formula (II), more preferably, $R_{21}$ represents an aromatic group or —$NR_{23}(R_{24})$, and $R_{22}$ represents —$NR_{25}(R_{26})$ in which $R_{23}$, $R_{24}$, $R_{25}$, and $R_{26}$ each preferably represent an alkyl group or an aromatic group. Herein, it is also more preferable that $R_{21}$ and $R_{25}$, and $R_{23}$ and $R_{25}$ each form a ring through an alkylene group, arylene group, aralkylene group or alkenylene group.

formula (III)

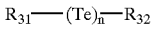

In the formula (III), $R_{31}$ and $R_{32}$ may be the same or different, and each represent an aliphatic group, an aromatic group, a heterocyclic group, or —(C=Y')—$R_{33}$; $R_{33}$ represents a hydrogen atom, an aliphatic group, an aromatic group, a heterocyclic group, $NR_{34}(R_{35})$, $OR_{36}$, or $SR_{37}$; Y' represents an oxygen atom, a sulfur atom, or $NR_{38}$; $R_{34}$, $R_{35}$, $R_{36}$, $R_{37}$ and $R_{38}$ each represent a hydrogen atom, an aliphatic group, an aromatic group, or a heterocyclic group; and n represents 1 or 2. Next, the details of the formula (III) will be explained. In the formula (III), the aliphatic group, aromatic group, and heterocyclic group represented by $R_{31}$, $R_{32}$, $R_{33}$, $R_{34}$, $R_{35}$, $R_{36}$, $R_{37}$ and $R_{38}$ have the same meanings to the respective groups as defined in the formula (I). Also, the aliphatic group, aromatic group, and heterocyclic group represented by $R_{31}$, $R_{32}$, $R_{33}$f $R_{34}$, $R_{35}$, $R_{36}$, $R_{37}$ and $R_{38}$ may be substituted with the substituent given in the formula (I). Herein, each of $R_{31}$ and $R_{32}$, and $R_{34}$ and $R_{35}$ may bond with each other to form a ring. In the formula (III), preferably, $R_{31}$ and $R_{32}$ each represent a heterocyclic group or —(C=Y')—$R_{33}$; $R_{33}$ represents $NR_{34}(R_{35})$ or $OR_{36}$; Y' represents an oxygen atom; and $R_{34}$, $R_{35}$ and $R_{36}$ each represent an aliphatic group, an aromatic group or a heterocyclic group. In the formula (III), more preferably, $R_{31}$ and $R_{32}$ each represent —(C=Y')—$R_{33}$; $R_{33}$ represents $NR_{34}(R_{35})$; Y' represents an oxygen atom; and $R_{34}$ and $R_{35}$ each represent an aliphatic group, an aromatic group or a heterocyclic group.

Specific examples of the tellurium sensitizers represented by the formula (I), (II) or (III) may include compounds described in the sections of (Chemical formula 22) to (Chemical formula 36) of JP-A-8-95184. The descriptions of these compounds are incorporated in this specification by reference.

The amount to be used of the tellurium sensitizer that can be used in the present invention is generally $10^{-8}$ to $10^{-2}$ mol, and preferably about $10^{-7}$ to $5\times10^{-3}$ mol, per mol of silver halide, though it varies depending upon the type of the silver halide grain to be used, the conditions of chemical ripening, and the like.

Although no particular limitation is imposed on the condition of chemical sensitization in the present invention, the pH is generally 5 to 8, the pAg is generally 6 to 11, and preferably 7 to 10, and the temperature is generally 40 to 95° C., and preferably 45 to 85° C.

In the present invention, it is preferable to use a noble metal sensitizer, such as gold, platinum, palladium, or iridium, in combination with the tellurium sensitizer. It is particularly preferable to use a gold sensitizer. Specific examples of the gold sensitizer include chloroauric acid, potassium chloroaurate, potassium auric thiocyanate, gold sulfide, gold selenide, and the like. The gold sensitizer may be used in an amount of about $10^{-7}$ to $10^{-2}$ mol, per mol of silver halide.

In the present invention, further, a sulfur sensitizer may be used in combination. Specific examples of the sulfur sensitizer include known unstable sulfur compounds, such as thiosulfates (e.g., hypo), thioureas (e.g., diphenylthiourea, triethylurea and allylthiourea) and rhodanines. The sulfur sensitizer may be used in an amount of about $10^{-7}$ to $10^{-2}$ mol, per mol of silver halide.

In the present invention, to constitute a light-sensitive material for use in recording an original scene and reproducing the original scene as a color image, the color reproduction according to the subtractive color process may be used basically. Specifically, at least three types of light-sensitive layers, each having light sensitivities in blue, green and red regions respectively, are provided, and each light-sensitive layer is made to contain a color coupler capable of forming a dye of yellow, magenta or cyan, which is oh relations of a complementary color with the light-sensitive wavelength region of the light-sensitive layer, whereby the color information of the original scene can be recorded. A color photographic printing paper having the same relationship between the light-sensitive wavelength and the developed color hue to that of the light-sensitive material, is exposed through the dye image obtained in this manner, whereby the original scene can be reproduced. Also, the information of a dye image obtained by taking a photograph of an original scene is read out by a scanner or the like, and based on this information, an image for appreciation can be reproduced.

The light-sensitive material of the present invention may be provided with light-sensitive layers having light-sensitivity to three or more types of wavelength regions.

Also, it is possible to make the relationship between light-sensitive wavelength region and developed color hue become other than the above complementary color relationship. In this case, original color information can be reproduced by performing image processing, such as hue conversion, after the image information is read out as mentioned above.

In the present invention, it is preferable to contain at least two types of silver halide emulsions that have light-sensitivities in the same wavelength region but that are different from each other in the average projected area of grains. In the present invention, the meaning of the sentence "have light-sensitivity in the same wavelength region" indicates that the silver halide emulsions have light-sensitivity at the substantially same wavelength region. Therefore, even silver halide emulsions differing slightly in the distribution of spectral sensitivity are deemed to be silver halide emulsions having light-sensitivity in the same wavelength region, as long as the primary light-sensitive regions are overlapped each other.

In the above case, it is preferable to employ the silver halide emulsions so that the difference in the average projected area of grains between the emulsions become at least 1.25 times. The difference is more preferably 1.4 times or more, and most preferably 1.6 times or more. When three or more types of silver halide emulsion are used, it is preferable that the above relation is established between an emulsion having the smallest average projected area of grains and an emulsion having the largest average projected area of grains.

In the present invention, in order to contain a plurality of silver halide emulsions respectively having light-sensitivity in the same wavelength region but differing in the average projected area of grains, either each of the emulsions may be coated to form a separate light-sensitive layer, respectively, or the aforementioned plurality of emulsions may be mixed and contained in one light-sensitive layer.

When these emulsions are respectively contained in separate layers, it is preferable to dispose an emulsion having a large average projected area of grains on a upper layer (the position close to the direction of incidence of light).

When these emulsions are contained in separate light-sensitive layers respectively, a coupler having the same hue of the resultant dye is preferably used as a color coupler to be used in combination. However, couplers that develop different color hues may be mixed to thereby make the developed color hues differ in every light-sensitive layer, or a coupler differing in the absorption profile of a developed color hue may be used in each light-sensitive layer.

In the present invention, in applying these emulsions having light-sensitivity in the same wavelength region, it is preferable to have the constitution that the ratio of the number of silver halide grains of an emulsion per unit area of a light-sensitive material is set at a value larger than the ratio of the value calculated by dividing the coated amount of silver of the emulsion, by the three-second (3/2) power of the average grain-projected area of the silver halide grains contained in the emulsion, in the case that a silver halide emulsion larger in the average projected area of grains is used. With such a constitution, an image having good granulation can be obtained, even in such a development condition as heating to a high temperature. Also, high development characteristics and wide exposure latitude can be satisfied at the same time.

In conventional color negative films used for photographing, in order to attain the intended granularity, not only the improvement of the silver halide emulsion but also a technique, for example, using the so-called DIR coupler, which releases a development-inhibiting compound upon a coupling reaction with an oxidized product of a developing agent, is incorporated. In the light-sensitive material of the present invention, excellent granularity can be obtained even if a DIR coupler is not used. Further, if a DIR compound is used in combination, the granularity can be improved even better.

The silver halide emulsion for use in the present invention will be hereinafter explained.

The tabular grain (in some cases also referred to as "tabular-like grain") in the present invention means a silver halide grain having two parallel main faces facing to each other.

The tabular grain for use in the present invention has one twin plane, or two or more parallel twin planes. When ions disposed at all lattice points are in the reflected image relations on the both sides of a (111) plane, the twin plane means the (111) plane.

The tabular grain has a triangular or hexagonal shape, or circular shape in which each corner of triangle or hexagon is made round off, as viewed the grain from above, and the tabular grain has external surfaces parallel to each other.

In the silver halide emulsion for use in the present invention, the tabular grain occupies preferably 50 to 100%, more preferably 80 to 100%, and particularly preferably 90 to 100%, of the total projected area of all grains.

If the percentage of the projected area occupied by the tabular grains is too small, it may become impossible to make use of the whole merit of the tabular grain (sensitivity/granularity ratio, and improvement in sharpness), and it is therefore undesirable in some cases.

The average grain thickness of the tabular grain for use in the present invention is preferably 0.01 to 0.20 $\mu$m, more preferably 0.01 to 0.17 $\mu$m, and particularly preferably 0.01 to 0.14 $\mu$m.

The average grain thickness is an arithmetic average of grain thicknesses of all tabular grains in the emulsion.

When the average grain thickness is too small, the pressure resistance is impaired, which is undesirable. When the average grain thickness exceeds 0.20 $\mu$m, it is hard to obtain the effect of the present invention, which is undesirable.

The average diameter of a circle whose area is equivalent to a projected area of an individual grain (the average equivalent-circle diameter) of the tabular grain for use in the present invention is preferably 0.7 to 5 $\mu$m, more preferably 1 to 4.5 $\mu$m, and particularly preferably 1 to 4 $\mu$m.

The average equivalent-circle-diameter means an arithmetic average of equivalent-circle diameters of all tabular grains in the emulsion.

If the average equivalent-circle diameter is less than 0.7 μm, it is hard to obtain the effect of the present invention, which is undesirable. If the average equivalent-circle diameter is too large, the pressure resistance is impaired, which is undesirable.

The ratio of the equivalent-circle diameter to the thickness of the silver halide grain is referred to as an aspect ratio. Namely, the aspect ratio is a value obtained by dividing the diameter of a circle whose area is equivalent to the projected area of an individual silver halide grain by the thickness of the grain.

As one example of a method of measuring the aspect ratio, there is a method in which transmission electron microphotograph of each grain is taken using a replica method, to find the diameter of a circle having the equivalent area to the projected area of an individual grain (equivalent-circle diameter) and the thickness of the individual grain.

In this case, the thickness is calculated from the length of the shadow of the replica.

In the silver halide emulsion for use in the present invention, the average aspect ratio of all tabular grains is preferably 3.5 to 100, more preferably 12 to 80, and particularly preferably 15 to 50.

The average aspect ratio is an arithmetic average of the aspect ratios of all tabular grains in the emulsion.

When the average aspect ratio is too small, it is hard to obtain the effect of the present invention, which is undesirable, whereas when the average aspect ratio is too large, the pressure resistance is impaired, which is undesirable.

As a method of forming the tabular grain that has a thin grain thickness and a high aspect ratio, for use in the present invention, various methods may be used. For example, a grain formation method described in U.S. Pat. No. 5,250,403 may be used.

In the silver halide emulsion for use in the present invention, hexagonal tabular grain, in which the ratio of the length of a side having a maximum length to the length of a side having a minimum length is 2 to 1, occupy preferably 100 to 50%, more preferably 100 to 70%, and particularly preferably 100 to 90%, of the projected area of all grains in the emulsion. The mingling of tabular grains having a shape other than the above hexagonal shape is undesirable in light of the uniformity among grains.

The silver halide emulsion for use in the present invention preferably has monodispersibility.

The coefficient of variation in the circle-requivalent diameter of the projected area of all silver halide grains for use in the present invention, is preferably 30 to 3%, more preferably 25 to 3%, and particularly preferably 20 to 3%. If the coefficient of variation is too large, it is undesirable in light of the uniformity among grains.

The coefficient of variation of the circle-equivalent diameter is a value obtained by dividing the standard deviation of the circle-equivalent diameter of an individual silver halide grain by the average circle-equivalent diameter.

As the composition of the tabular grain for use in the present invention, silver bromide, silver chlorobromide, silver iodobromide, silver chloroiodobromide, or the like may be used, and it is preferable to use silver bromide, silver iodobromide or silver chloroiodobromide. Further, a content of a bromide is preferably exceeding 70 mole %, more preferably 80 to 98 mole %, to the silver.

In the case where the tabular grain has phases containing an iodide or a chloride, these phases may be distributed uniformly, or localized in the grain.

Other silver slats, for example, silver rhodanate, silver sulfide, silver selenide, silver carbonate, silver phosphate, and an organic acid silver salt may be contained as separate grains or a part of silver halide grain.

The range of the silver iodide content of the tabular grain for use in the present invention is preferably 0.1 to 20 mol %, more preferably 0.2 to 15 mol %, and particularly preferably 0.3 to 10 mol %.

When the silver iodide content is too small, it is hard to obtain effects, such as an enhancement in dye adsorption and a rise in intrinsic sensitivity, which is undesirable. When the content is too large, development rate is usually delayed and this is therefore undesirable.

The coefficient of variation in the distribution of the content of silver iodide among grains in the emulsion grain for use in the present invention, is preferably 30 to 3%, more preferably 25 to 3%, and particularly preferably 20 to 3%. If the coefficient of variation is too large, it is undesirable in light of uniformity among grains.

The silver iodide content in each emulsion grain may be measured, by analyzing the composition of an individual grain by using an X-ray microanalyzer.

The coefficient of variation in the distribution of the silver iodide content is a value obtained by dividing the scatter (standard deviation) of the silver iodide content of each grain by the average silver iodide content.

The tabular grain for use in the present invention may have a dislocation line.

The dislocation line means a linear lattice defect present at the boundary between a slipped region and a non-slipped region on a slip plane of a crystal.

There are following literatures concerning the dislocation line of a silver halide crystal: 1) C. R. Berry, J. Appl. Phys., 27, 636 (1956), 2) C. R. Berry, D. C. Skilman, J. Appl. Phys., 35, 2165 (1964), 3) J. F. Hamilton, Phot. Sci. Eng., 11, 57 (1967), 4) T. Shiozawa, J. Soc. Phot. Sci. Jap., 34, 16 (1971), 5) T. Shiozawa, J. Soc. Phot. Sci. Jap., 35, 213 (1972), and the like. The dislocation line may be analyzed by an X-ray diffractometry or by direct observation method using a low-temperature transmission-type electron microscope.

When the dislocation line is directly observed using a transmission-type electron microscope, a silver halide grain is taken out from a silver halide emulsion while taking care so as not to apply pressure enough to occur the dislocation line in the grain, the grain is placed on a mesh for observation under the electron microscope, and the observation is carried out in a transmission method while the sample is kept in a cooled condition so as to prevent damages (e.g., print-out) due to electron rays.

In this case, the use of a high-voltage type electron microscope (200 kV or more for a thickness of 0.25 μm) allows clearer observation, because transmission of the electron rays become difficult as the thickness of the grain increases.

There is a description concerning a technique for introducing dislocation lines into a silver halide grain under control in JP-A-63-220238.

It is shown that tabular grains into which a dislocation line is introduced, are superior to tabular grains having no dislocation line, in photographic characteristics such as sensitivity and reciprocity law.

In the case of tabular grains, the positions and the number of dislocation lines of each grain, as viewed from a direction perpendicular to the principal face, can !be found from the photograph of the grain that is taken using an electron microscope as mentioned above.

If the tabular grains for use in the present invention has a dislocation line, the position of the dislocation line is optional, and the position may be selected from among such positional situations that, for example, it is limited to the apex portion or fringe portion of the grain, it is introduced into over the entire principal face, and the like. However, it is particularly preferable that the position of the dislocation line is limited to the fringe portion.

The "fringe portion" referred to in the present invention indicates the outer periphery of the tabular grain. Specifically, the fringe portion is a portion, placed outside of a spot where the silver iodide content exceeds or drops below the average silver iodide content of the whole grain for the first time when viewed from the peripheral side of the grain, in the distribution of silver iodide ranging from the periphery side to the center of the grain.

When the tabular grain for use in the present invention has a dislocation line, the density of the dislocation line is optional, and the density of the dislocation line can be selected according to the situation, for example, so as to be 10 lines or more, 30 lines or more, 50 lines or more, per grain.

The silver halide emulsion for use in the present invention and another photographic emulsion, which is able to be used in combination therewith, will be hereinafter explained.

Specifically, any of silver halide emulsions can be used that are prepared by methods described, for example, in U.S. Pat. No. 4,500,626, column 50; U.S. Pat. No. 4,628,021, Research Disclosure (hereinafter abbreviated to as RD) No. 17,029 (1978), RD No. 17,643 (December 1978), pages 22 to 23; RD No. 18,716 (November 1979), page 648; RD No. 307,105 (November 1989), pages 863 to 865; JP-A-62-253159, JP-A-64-13546, JP-A-2-236546, and JP-A-3-110555; by P. Glafkides, in Chemie et Phisique Photographique, Paul Montel (1967); by G. F. Duffin, in Photographic Emulsion Chemistry, Focal Press, 1966; and by V. L. Zelikman et al., in Making and Coating Photographic Emulsion, Focal Press, 1964.

In the process for preparing the light-sensitive silver halide emulsion for use in the present invention, so-called desalting, for removing excess salts, is preferably carried out. As a means for attaining it, the noodle water-washing method, which is carried out with the gelatin gelled, can be used, and also the sedimentation method, in which inorganic salts comprising polyvalent anions (e.g. sodium sulfate), an anionic surfactant, an anionic polymer (e.g. polystyrene-sulfonic acid sodium salt), or a gelatin derivative (e.g. an aliphatic-acylated gelatin, an aromatic-acylated gelatin, and an aromatic-carbamoylated gelatin) is employed, can be used, with the sedimentation method preferred.

The light-sensitive silver halide emulsion that can be used in the present invention may contain a heavy metal, such as iridium, rhodium, platinum, cadmium, zinc, thallium, lead, iron, and osmium, to achieve various purposes. These compounds may be used either singly or in combinations of two or more. The amount to be added varies depending on the purpose of the application; but the amount is generally on the order of $10^{-9}$ to $10^{-3}$ mol, per mol of the silver halide. When they are incorporated, they may be incorporated uniformly in the grains, or they may be localized in the grains or on the surface of the grains. Specifically, the emulsions described, for example, in JP-A-2-236542, JP-A-1-116637, and JP-A-5-181246 are preferably used. In the step for forming grains of the light-sensitive silver halide emulsion for use in the present invention, as a silver halide solvent, for example, a rhodanate, ammonia, a tetrasubstituted thioether compound, an organic thioether derivative described in JP-B-47-11386, or a sulfur-containing compound described in JP-A-53-144,319 can be used.

As other conditions employed to prepare the emulsion in the present invention, the description, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964, can be referred to. That is, any of the acid process, the neutral process, and the ammonia process can be used; and to react a soluble silver salt with a soluble halogen salt, any of the single-jet method, the double-jet method, and a combination thereof can be used. To obtain monodispersed emulsion, the double-jet method is preferably used.

A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used.

Further, to quicken the growth of the grains, the concentrations, the amounts, and the addition speeds of the silver salt and the halide to be added may be increased (e.g. JP-A-55-142329, JP-A-55-158124, and U.S. Pat. No. 3,650,757).

As the method of stirring the reaction liquid, any of known stirring methods may be used. The temperature and the pH of the reaction liquid during the formation of the silver halide grains may be set arbitrarily to meet the purpose. Preferably the pH range is 2.2 to 7.0, and more preferably 2.5 to 6.0.

The light-sensitive silver halide emulsion is generally a chemically-sensitized silver halide emulsion. To chemically sensitize the light-sensitive silver halide emulsion, in addition to the above tellurium sensitization, known sensitization methods for silver halide emulsions in ordinary light-sensitive materials, for example, a chalcogen sensitization method, such as a sulfur sensitization method, and a selenium sensitization method; a noble metal sensitization method, wherein a noble metal, such as gold, platinum, or palladium, is used; and a reduction sensitization method, can be used alone or in combination (e.g. JP-A-3-110555 and JP-A-5-241267). These chemical sensitizations can be carried out in the presence of a nitrogen-containing heterocyclic compound (JP-A-62-253159). Further, the below-mentioned antifoggant can be added after the completion of the chemical sensitization. Specifically, methods described in JP-A-5-45833 and JP-A-62-40446 can be used.

At the time of the chemical sensitization, the pH is preferably 5.3 to 10.5, and more preferably 5.5 to 8.5, and the pAg is preferably 6.0 to 10.5, and more preferably 6.8 to 9.0.

The coating amount of the light-sensitive silver halide that can be used in the present invention is preferably in the range of 1 $mg/m^2$ to 10 $g/m^2$ in terms of silver, and more preferably in the range of 100 $mg/m^2$ to 8 $g/m^2$.

When the light-sensitive silver halide for use in the present invention is made to have color sensitivities of green sensitivity, red sensitivity, and the like, the light-sensitive silver halide emulsion is spectrally sensitized with methine dyes or the like. If required, the blue-sensitive emulsion may be spectrally sensitized in the blue region.

Dyes that can be used include cyanine dyes, merocyanine dyes, composite cyanin dyes, composite merocyanine dyes, halopolar cyanine dyes, hemicyanine dyes, styryl dyes, and hemioxonol dyes.

Specifically, sensitizing dyes described, for example, in U.S. Pat. No. 4 617 257, JP-A-59-180550, JP-A-64-13546, JP-A-5-45828, and JP-A-5-45834 can be mentioned.

These sensitizing dyes can be used singly or in combination thereof, and a combination of these sensitizing dyes is often used, particularly for the purpose of adjusting the wavelength of the spectral sensitivity, and for the purpose of supersensitization.

Together with the sensitizing dye, a dye having no spectral sensitizing action itself, or a compound that does not substantially absorb visible light and that exhibits supersensitization, may be included in the emulsion (e.g. those described, for example, in U.S. Pat. No. 3,615,641 and JP-A-63-23145).

The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. No. 4,183,756 and U.S. Pat. No. 4,225,666. Further, these sensitizing dyes and supersensitizers may be added in the form of a solution of an organic solvent, such as methanol, or in the form of a dispersion of gelatin or the like, or in the form of a solution of a surface-active agent. Generally the amount of the sensitizing dye to be added is of the order of $10^{-8}$ to $10^{-2}$ mol per mol of the silver halide.

These additives that can be used in the above process, and known additives for photography that can be used in the present invention, are described in the above mentioned RD No. 17643; RD No. 18716; and RD No. 307105, whose particular parts are given below in a table.

| Kind of Additive | RD 17643 | RD 18716 | RD 307105 |
|---|---|---|---|
| 1 Chemical sensitizers | p.23 | p.648 (right column) | p.866 |
| 2 Sensitivity-enhancing agents | | p.648 (right column) | |
| 3 Spectral sensitizers and Supersensitizers | pp.23–24 | pp.648 (right column)-649 (right column) | pp.866–868 |
| 4 Brightening agents | p.24 | pp.648 (right column) | p.868 |
| 5. Antifogging agents and Stabilizers | pp.24–25 | p.649 (right column) | pp.868–870 |
| 6 Light absorbers, Filter dyes, and UV absorbers | pp.25–26 | pp.649 (right column)-650 (left column) | p.873 |
| 7 Dye-image stabilizers | p.25 | p.650 (left column) | p.872 |
| 8 Hardeners | p.26 | p.651 (left column) | pp.874–875 |
| 9 Binders | p.26 | p.651 (left column) | pp.873–874 |
| 10 Plasticizers and Lubricants | p.27 | p.650 (right column) | p.876 |
| 11 Coating aids and surfactants | pp.26–27 | p.650 (right column) | pp.875–876 |
| 12 Antistatic agents | p.27 | p.650 (right column) | pp.876–877 |
| 13 Matting agents | | | pp.878–879 |

The organosilver salt of a nitrogen-containing heterocycle to be used in the present invention can be used in combination with a light-sensitive silver halide such that the amount of the silver salt of a heterocycle is generally 0.01 to 10 moles, preferably 0.01 to 1 mole, per mole of the light-sensitive silver halide. The total coating amount of the light-sensitive silver halide and the organosilver salt is generally 0.05 to 10 g/m$^2$, preferably 0.1 to 4 g/m$^2$, in terms of silver.

The organosilver salt of a nitrogen-containing heterocycle to be used in the present invention is used preferably with another organosilver salt. The amount of the another organosilver salt to be used in combination is preferably in the range of 20 to 80 mole % based on the organosilver salt of a nitrogen-containing heterocycle to be used in the present invention. Examples of the another organosilver salt to be used together include the silver acetylide described in U.S. Pat. No. 4,775,613. In addition, a silver mercaptide composed of a mercapto compound (e.g., a mercaptotetrazole, a mercaptotriazole, or the like) and silver is useful.

As the binder of the constitutional layer of the light-sensitive material, a hydrophilic binder is preferably used. Examples thereof include those described in the above-mentioned Research Disclosures and JP-A-64-13546, pages (71) to (75). Specifically, a transparent or semitransparent hydrophilic binder is preferable, and examples include natural compounds, such as proteins including gelatin, gelatin derivatives, and the like, or polysaccharides including cellulose derivatives, starches, gum-arabic, dextrans, pullulan, and the like; and synthetic polymer compounds such as polyvinyl alcohols, polyvinyl pyrrolidones, and acrylamide polymers. Further, highly water-absorptive polymers described, for example, in U.S. Pat. No. 4,960,681 and JP-A-62-245260; that is, homopolymers of a vinyl monomer having —COOM or —$SO_3$M (M represents a hydrogen atom or an alkali metal), or copolymers of the vinyl monomers, or this vinyl monomer(s) with another vinyl monomer (e.g., those comprising sodium methacrylate or ammonium methacrylate, including Sumika Gel L-5H, trade name, manufactured by Sumitomo Chemical Co., Ltd.) can also be used. Two or more of these binders can be combined and used. Particularly, combinations of gelatin with the above binders are preferable. As the gelatin, lime-processed gelatin, acid-processed gelatin, or so-called de-ashed gelatin, wherein the contents of calcium, etc., are reduced, can be selected in accordance with various purposes, and combinations of these gelatins are also preferably used.

In the present invention, the coating amount of the binder is preferably 1 g or more but 20 g or less, and particularly preferably 2 g or more but 10 g or less, per m$^2$.

In the case where development is carried out only by heating, in the present invention, it is preferable to provide an organosilver salt-containing layer.

Any polymer may be used as a binder in the organosilver salt-containing layer for use in the present invention. Preferred binders are transparent or semitransparent and generally colorless. Examples include natural polymer synthetic resins, polymers, copolymers and other media forming films: for example, a gelatin, gum arabic, poly(vinyl alcohol), hydroxyethyl cellulose, cellulose acetate, cellulose acetate butylate, poly(vinylpyrrolidone), casein, starch, polyacrylic acid, poly(methylmethacrylic acid), polyvinyl chloride, polymethacrylic acid, styrene/maleic acid anhydride copolymer, styrene/acrylonitrile copolymer, styrene/butadiene copolymer, poly(vinylacetal)s (e.g., poly (vinylformal) and poly(vinylbutyral)), polyesters, polyurethanes, phenoxy resin, polyvinylidene chloride, polyepoxides, polycarbonates, poly(vinyl acetate), cellulose esters and polyamides. The binder may be formed by coating water, an organic solvent or an emulsion.

In the present invention, when the organosilver salt-containing layer is formed by coating using a coating solution, in which 30 wt % or more of a solvent is water, and by drying the coating solution, the organosilver salt-containing layer is improved in a case where, further, the binder in the organosilver salt-containing layer is soluble or dispersible in a water-type solvent (water solvent) and is composed of a latex of a polymer having, particularly, an equilibrium moisture content of 2 wt % or less at 25° C. and 60% RH. A most preferred type of binder is one prepared so that the ionic conductivity becomes 2.5 mS/cm or less. Examples of such a preparation method include a method of purifying a polymer using a separative functional film after the polymer is synthesized.

The aforementioned water-type solvent, in which a polymer is soluble or dispersible, is water or those obtained by mixing 70 wt % or less of a water-miscible organic solvent with water. Examples of the water-miscible organic solvent may include alcohol-type solvents such as methyl alcohol, ethyl alcohol, and propyl alcohol; cellosolve-type solvents such as methyl cellosolve, ethyl cellosolve, and butyl cellosolve; ethyl acetate, and dimethylformamide.

Herein, in the case of types in which the polymer is not dissolved thermodynamically but is present in the so-called dispersion state, the term "water-type solvent" is also used.

Also, the "equilibrium moisture content at 25° C. and 60% RH" can be given as follows using a mass W1 of a polymer in a humidity-controlled equilibrium condition under atmosphere of 25° C. and 60% RH, and a mass W0 of the polymer in absolute dry condition at 25° C.

$$\text{Equilibrium moisture content at 25° C. and 60\% RH}=\{(W1-W0)/W\}\times 100(\text{wt \%})$$

As to the definition and measuring method of the moisture content, for example, reference can be made to "Kobunshi Kogaku Koza 14, Kobunshi-Zairyo Shiken-ho (Polymer Engineering Lecture 14, Polymer material Test Method)" (edited by Kobunshi-Gakkai (Polymer Society), Chizin Shokan).

The equilibrium moisture content at 25° C. and 60% RH of the binder polymer for use in the present invention is preferably 2 wt % or less, and it is more preferably 0.01 wt % or more and 1.5 wt % or less, and still more preferably 0.02 wt % or more and 1 wt % or less.

In the present invention, polymers dispersible in the water-type solvent are particularly preferable. Examples of the dispersion state include latexes in which fine particles of a water-insoluble hydrophobic polymer is dispersed, and those in which a polymer molecule is dispersed in a molecular state or with forming a micelle, and all of these states are preferable. The average particle diameter of the dispersed particles is preferably in a range from about 1 to 50,000 nm and more preferably about 5 to 1,000 nm. No particular limitation is imposed on the distribution of particle diameter of the dispersed particle, and those having a wide distribution of particle diameter and a monodispersion type distribution of particle diameter may be used.

In the present invention, as preferable types of polymer dispersible in the water-type solvent, hydrophobic polymers such as an acrylic resin, polyester resin, rubber type resin (e.g., an SBR resin), polyurethane resin, vinyl chloride resin, vinyl acetate resin, vinylidene chloride resin, and polyolefin resin, can be preferably used. These polymers may be straight-chain, branched or cross-linked polymers, the so-called homopolymers obtained by polymerizing a single monomer, or copolymers obtained by polymerizing two or more types of monomer. In the case of copolymers, these copolymers may be either random copolymers or block copolymers. The molecular weight of each of these copolymers is generally 5,000 to 1,000,000, and preferably 10,000 to 200,000 in terms of number average molecular weight. Polymers having excessively small molecular weight impart insufficient dynamic strength to an emulsion layer and polymers having excessively large molecular weight bring about poor filming ability, and therefore both cases are undesirable.

As specific examples of the preferable polymer latex, the following compounds may be given. In the description hereinbelow, each latex is represented by raw material monomers, the numeral values in the parenthesis show a wt %, and the molecular weight is a number average molecular weight.

P-1: Latex of -MMA(70)-EA(27)-MAA(3)-(molecular weight: 37,000)

P-2: Latex of -MMA(70)-2EHA(20)-St(5)-AA(5)-(molecular weight: 40,000)

P-3: Latex of -St(50)-Bu(47)-MAA(3)-(molecular weight: 45,000)

P-4: Latex of -St(68)-Bu(29)-AA(3)-(molecular weight: 60,000)

P-5: Latex of -St(70)-Bu(27)-IA(3)-(molecular weight: 120,000)

P-6: Latex of -St(75)-Bu(24)-AA(1)-(molecular weight: 108,000)

P-7: Latex of -St(60)-Bu(35)-DVB(3)-MAA(2)-(molecular weight: 150,000)

P-8: Latex of -St(70)-Bu(25)-DVB(2)-AA(3)-(molecular weight: 280,000)

P-9: Latex of -VC(50)-MMA(20)-EA(20)-AN(5)-AA(5)-(molecular weight: 80,000)

P-10: Latex of -VDC(85)-MMA(5)-EA(5)-MAA(5)-(molecular weight: 67,000)

P-11: Latex of -Et(90)-MAA(10)-(molecular weight: 12,000)

P-12: Latex of -St(70)-2EHA(27)-AA(3) (molecular weight: 130,000)

P-13: Latex of -MMA(63)-EA(35)-AA(2) (molecular weight: 33,000)

The abbreviations in the above structures represent the following monomers. MMA: methyl methacrylate, EA: ethyl acrylate, MAA: methacrylic acid, 2EHA: 2-ethyl hexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

These polymer latexes described above are commercially available, and polymers described below may be utilized. Examples of the acrylic resin include Cevian A-4635, -46583 and -4601 (trade names, manufactured by Daicel Chemical Industries), Nipol Lx811, 814, 821, 820 and 857 (trade names, manufactured by Nippon Zeon Co., Ltd.), and the like. Examples of the polyester resin include FINETEX ES650, 611, 675 and 850 (trade names, manufactured by Dainippon Ink and Chemicals, Incorporated), WD-size and WMS (trade names, manufactured by Eastman Chemical Ltd.), and the like. Examples of the polyurethane resin include HYDRAN AP10, 20, 30 and 40 (trade names, manufactured by Dainippon Ink and Chemicals, Incorporated), and the like. Examples of the rubber type resin include LACSTAR 7310K, 3307B, 4700H and 7132C (trade names, manufactured by Dainippon Ink and Chemicals, Incorporated), and Nipol Lx416, 410, 438C and 2507 (trade names, manufactured by Nippon Zeon Co., Ltd.), and the like. Examples of the vinyl chloride resin include G351 and G576 (trade names, manufactured by Nippon Zeon Co., Ltd.), and the like. Examples of vinylidene chloride resin include L502 and L513 (trade names, manufactured by Asahi Chemical Industry Co., Ltd.), and the like. Examples of the olefin resin include Chemipearl S120 and SA100 (trade names, manufactured by Mitsui Chemicals Inc.).

These polymer latexes may be used either singly or by blending two or more, according to the need.

As the polymer latex that can be used in the present invention, particularly, latexes of styrene/butadiene copolymers are preferred. The ratio by mass of a monomer unit of styrene to a monomer unit of butadiene in the styrene/butadiene copolymer is preferably 40:60 to 95:5. The proportion of a monomer unit of styrene and a monomer unit of butadiene in the copolymer is preferably 60 to 99 wt %. A preferable range of the molecular weight of the styrene/butadiene copolymer is the same as above.

As examples of the latex of styrene/butadiene copolymer, which is preferably used in the present invention, the aforementioned P-3 to P-8 and commercially available products (trade names) LACSTAR-3307B and 7132C, Nipol Lx416, and the like can be given.

A hydrophilic polymer such as a gelatin, polyvinyl alcohol, methyl cellulose, hydroxypropyl cellulose, carboxymethyl cellulose, or the like may be added, if necessary, to the organosilver salt-containing layer in the light-sensitive material of the present invention. The amount of these hydrophilic polymers to be added is preferably 30 wt % or less, and more preferably 20 wt % or less, based on the total binder in the organosilver salt-containing layer.

In the present invention, the organosilver salt-containing layer (namely, an image-forming layer) is preferably those formed using a polymer latex. As to the amount of the binder in the organosilver salt-containing layer, the ratio by mass of the total binder/the organosilver salt is in a range of preferably 1/10 to 10/1, and more preferably 1/5 to 4/1.

In the present invention, a thermal solvent can be incorporated. The "thermal solvent" is an organic material, which is a solid at ambient temperature, but exhibits a mixed melting point together with another component at or below a thermal processing temperature to be employed, and liquefies at the time of heat development, so as to accelerate the heat development or the thermal transfer of a dye. Useful as the thermal solvent are a compound capable of becoming a solvent for the developing agent, a compound having a high dielectric constant and known to accelerate the physical development of a silver salt, a compound compatible with a binder and capable of swelling the binder, and the like.

Examples of the thermal solvent that can be used in the present invention include the compounds described, for example, in U.S. Pat. Nos. 3,347,675, 3,667,959, 3,438,776, and 3,666,477, Research Disclosure No. 17,643, JP-A-51-19525, JP-A-53-24829, JP-A-53-60223, JP-A-58-118640, JP-A-58-198038, JP-A-59-229556, JP-A-59-68730, JP-A-59-84236, JP-A-60-191251, JP-A-60-232547, JP-A-60-14241, JP-A-61-52643, JP-A-62-78554, JP-A-62-42153, JP-A-62-44737, JP-A-63-53548, JP-A-63-161446, JP-A-1-224751, JP-A-2-863, JP-A-2-120739, and JP-A-2-123354. More specifically, preferred examples of the thermal solvent that can be used in the present invention include urea derivatives (e.g., urea, dimethylurea, and phenylurea), amide derivatives (e.g., acetamide, stearylamide, p-toluamide, and p-propanoyloxyethoxybenzamide), sulfonamide derivatives (e.g., p-toluenesulfonamide), and polyhydric alcohols (e.g., 1,6-hexanediol, pentaerythritol, D-sorbitol, and polyethylene glycol).

The coupler which may be used in the present invention may be a four-equivalent coupler or a two-equivalent coupler. Also, a nondiffusing group of the coupler may be in a form of a polymer chain. Specific examples of the coupler are described in detail by T. H. James "The Theory of the Photographic Process", The fourth edition, pp.291–334, and pp.354–361, and in JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, JP-A-8-110608, JP-A-8-146552, JP-A-8-146578, and the like.

Also, couplers as mentioned below are preferably used.

Yellow coupler: couplers represented by the formula (I) or (II) in EP 502,424A, couplers represented by the formula (1) or (2) in EP 513,496A, couplers represented by the formula (I) in claim 1 of JP-A-5-307248, couplers represented by the formula D in column 1, line 45 to line 55 of U.S. Pat. No. 5,066,576, couplers represented by the formula D in Paragraph 0008 of JP-A-4-274425, couplers described on page 40, in claim 1 of EP 498,381A1, couplers represented by the formula (Y) on page 4 in EP 447,969A1, and couplers represented by any one of the formulae (I) to (IV) in Column 7, line 36 to line 58 of U.S. Pat. No. 4,476,219.

Magenta coupler: couplers described in JP-A-3-39737, JP-A-6-43611, JP-A-5-204106 and JP-A-4-3626.

Cyan coupler: couplers described in JP-A-4-204843, JP-A-4-43345 and JP-A-5-211989.

Polymer coupler: couplers described in JP-A-2-44345.

As couplers whose color-formed dye has suitable diffusibility, those described in U.S. Pat. No. 4,366,237, GB 2,125,570, EP 96,570 and DE 3,234,533 are preferable.

The light-sensitive material of the present invention may contain functional couplers as mentioned below. Examples of the couplers for correcting unnecessary absorption of a color-formed dye include yellow-colored cyan couplers described in EP 456,257A1, yellow-colored magenta couplers described in the same EP publication, magenta-colored cyan couplers described in U.S. Pat. No. 4,833,069, and colorless masking couplers (particularly, exemplified compounds on Pages 36–45) represented by (2) in U.S. Pat. No. 4,837,136 and the formula (A) in claim 1 of WO92/11575.

In the present invention, a coupler or other compounds, which release a photographically useful compound by a reaction with an oxidized product of a developing agent, are preferably used.

As a compound (including a coupler) that reacts with an oxidized product of a developing agent to release a photographically useful compound residue, the following compounds may be mentioned. Developing-inhibitor-releasing compound: compounds represented by any one of the formulae (I) to (IV) described in EP 378,236A1, page 11; compounds represented by the formula (I) described in EP 436,938A2, page 7; compounds represented by the formula (1) described in JP-A-5-307248; compounds represented by any one of the formulae (I), (II) and (III) described in EP 440,195A2, pages 5 and 6; compounds represented by the formula (I) in claim 1 of JP-A-6-59411; and Ligand-releasing compounds represented by LIG-X described in claim 1 of U.S. Pat. No. 4,555,478.

The light-sensitive material of the present invention preferably incorporates a color-developing agent whose oxidized product produced by silver development can conduct coupling with the aforementioned coupler to produce a dye.

In this case, a combination of a p-phenylenediamines-series developing agent with a phenol or with an active methylene coupler, as described in U.S. Pat. No. 3,531,256, or a combination of a p-aminophenol-series developing agent with an active methylene coupler, as described in U.S. Pat. No. 3,761,20 may be used.

A combination of a four-equivalent coupler and a sulfonamidophenol, as described in U.S. Pat. No. 4,021,240, JP-A-60-128438, and the like, is preferable, because a light-sensitive material incorporating this. combination exhibits excellent raw stock (unused stock) storability.

When a color-developing agent is built-in a light-sensitive material, a precursor of the color-developing agent may be used. Examples of the precursor may include indoaniline-series compounds described in U.S. Pat. No. 3,342 597; Schiff base-type compounds described in U.S. Pat. No. 3,342,599, and Research Disclosures No. 14,850 and No. 15,159; aldol compounds described in Research Disclosure No. 13,924; metal salt complexes described in U.S. Pat. No. 3,719,492; and urethane-series compounds described in JP-A-53-135628.

In the present invention, the.amount of the coupler to be used is preferably 1/1,000 to 1 mol, and more preferably 1/500 to 1/3 mol, per one mol of silver halide.

A combination of a coupler with a sulfonamidophenol-series developing agent described in JP-A-9-15806 and EP 0930528A1, or with a hydrazine-series developing agent described in JP-A-8-286340 and JP-A-8-234388 is also preferable for use in the light-sensitive material of the present invention.

In the present invention, a compound represented by the following formula IV, V, VI or VII is preferably used as a developing agent. Among the compounds, particularly the compound represented by the following formula IV or VI is preferably used.

These developing agents will be hereinafter explained in detail.

formula IV

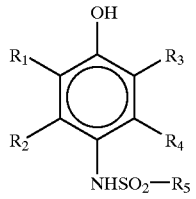

formula V

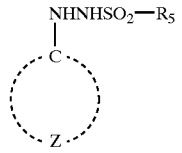

formula VI

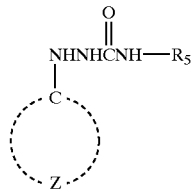

formula VII

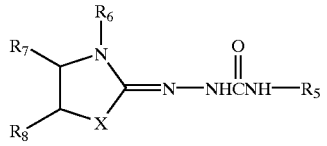

The compound represented by formula IV is a compound collectively called sulfonamidophenol, and the compound is a known compound in the field of art concerned. When the compound is used in the present invention, those in which at least one of the substituents $R_1$ to $R_5$ has a ballasting group having 8 or more carbon atoms, are preferable.

In the formula, $R_1$, $R_2$, $R_3$, and $R_4$ each represent a hydrogen atom, a halogen atom (e.g., a chloro group and bromo group), an alkyl group (e.g., a methyl group, ethyl group, isopropyl group, n-butyl group, and t-butyl group), an aryl group (e.g., a phenyl group, tolyl group, and xylyl group), an alkylcarbonamido group (e.g., an acetylamino group, propionylamino group and butyroylamino group), an arylcarbonamido group (e.g., a benzoylamino group), an alkylsulfonamido group (e.g., a methanesulfonylamino group and ethanesulfonylamino group), an arylsulfonamido group (e.g., a benzenesulfonylamino group and toluenesulfonylamino group), an alkoxy group (e.g., a methoxy group, ethoxy group and butoxy group), an aryloxy group (e.g., a phenoxy group), an alkylthio group (e.g., a methylthio group, ethylthio group and butylthio group), an arylthio group (e.g., a phenylthio group and tolylthio group), an alkylcarbamoyl group (e.g., a methylcarbamoyl group, dimethylcarbamoyl group, ethylcarbamoyl group, diethylcarbamoyl group, dibutylcarbamoyl group, piperidylcarbamoyl group and morpholylcarbamoyl group), an arylcarbamoyl group (e.g., a phenylcarbamoyl group, methylphenylcarbamoyl group, ethylphenylcarbamoyl group and benzylphenylcarbamoyl group), a carbamoyl group, an alkylsulfamoyl group (e.g., a methylsulfamoyl group, dimethylsulfamoyl group, ethylsulfamoyl group, diethylsulfamoyl group, dibutylsulfamoyl group, piperidylsulfamoyl group and morpholylsulfamoyl group), an arylsulfamoyl group (e.g., a phenylsulfamoyl group, methylphenylsulfamoyl group, ethylphenylsulfamoyl group and benzylphenylsulfamoyl group), a sulfamoyl group, a cyano group, an alkylsulfonyl group (e.g., methanesulfonyl group and ethanesulfonyl group), an arylsulfonyl group (e.g., a phenylsulfonyl group, 4-chlorophenylsulfonyl group and p-toluenesulfonyl group), an alkoxycarbonyl group (e.g., a methoxycarbonyl group, ethoxycarbonyl group and butoxycarbonyl group), an aryloxycarbonyl group (e.g., a phenoxycarbonyl group), an alkylcarbonyl group (e.g., an acetyl group, propionyl group and butyroyl group), an arylcarbonyl group (e.g., a benzoyl group and alkylbenzoyl group), or an acyloxy group (e.g., an acetyloxy group, propionyloxy group and butyroyloxy group). Among $R_1$, $R_2$, $R_3$, and $R_4$, $R_2$ and $R_4$ each are preferably a hydrogen atom. The sum of Hammett's constants $\sigma_p$ of $R_1$, $R_2$, $R_3$, and $R_4$ is preferably 0 or more. $R_5$ represents an alkyl group (e.g., a methyl group, ethyl group, butyl group, octyl group, lauryl group, cetyl group and stearyl group), an aryl group (e.g., a phenyl group, tolyl group, xylyl group, 4-methoxyphenyl group, dodecylphenyl group, chlorophenyl group, trichlorophenyl group, nitrochlorophenyl group, triisopropylphenyl group, 4-dodecyloxyphenyl group and 3,5-di-(methoxycarbonyl) group), or a heterocyclic group (e.g., pyridyl group).

The compound represented by the formula V is a compound which is collectively called sulfonylhydrazine. These compounds are known compounds in the field of art concerned. When the compound is used in the present invention, those in which $R_5$ or a substituent on the ring has a ballasting group having 8 or more carbon atomsi*are preferable.

In the above formulas, Z represents a group of atoms forming, together with the C, an aromatic ring. The aromatic ring formed by Z together with the C should be sufficiently electron-attractive, to impart silver developing activity to the compound. For this reason, a nitrogen-containing aromatic ring, or an aromatic ring obtained by, for example, introducing an electron-attractive group into a benzene ring, is preferably used. As such an aromatic ring, a pyridine ring, pyrazine ring, pyrimidine ring, quinoline ring, quinoxaline ring, and the like, is preferable. In the case of a benzene ring, examples of its substituent(s) include an alkylsulfonyl group (e.g., a methanesulfonyl group and ethanesulforyl group), a halogen atom (e.g., a chloro group and bromo group), an alkylcarbamoyl group (e.g., a methylcarbamoyl group, dimethylcarbamoyl group, ethylcarbamoyl group, diethylcarbamoyl group, dibutylcarbamoyl group, piperidinecarbamoyl group and morpholinocarbamoyl group), an arylcarbamoyl group (e.g., a phenylcarbamoyl group, methylphenylcarbamoyl group, ethylphenylcarbamoyl group and benzylphenylcarbamoyl group), a carbamoyl group, an alkylsulfamoyl group (e.g., a methylsulfamoyl group, dimethylsulfamoyl group, ethylsulfamoyl group, diethylsulfamoyl group, dibutylsulfamoyl group, piperidylsulfamoyl group and morpholilsulfamoyl group), an arylsulfamoyl group (e.g., a phenylsulfamoyl group, methylphenylsulfamoyl group, ethylphenylsulfamoyl group and benzylphenylsulfamoyl group), a sulfamoyl group, a cyano group, an alkylsulfonyl group (e.g., a methanesulfonyl group and ethanesulfonyl group), an arylsulfonyl group (e.g., a phenylsulfonyl group, 4-chlorophenylsulfonyl group and p-toluenesulfonyl group), an alkoxycarbonyl group (e.g., a methoxycarbonyl group, ethoxycarbonyl group and butoxycarbonyl group), an aryloxycarbonyl group (e.g., a phenoxycarbonyl group), an alkylcarbonyl group (e.g., an acetyl group, propionyl group and butyroyl group), or an arylcarbonyl group (e.g., a benzoyl group and alkylbenzoyl group). The sum of Hammett's constants a values of the above substituents is preferably 1 or more.

The compound represented by the above formula VI is a compound collectively called a carbamoylhydrazine, and the compound represented by formula VII is a compound collectively called a carbamoylhydrazone. The both are known compounds in the field of art concerned. When these compounds are used in the present invention, those in which at least one of the substituents $R_5$, $R_6$, $R_7$, and $R_8$ has a ballasting group having 8 or more carbon atoms, are preferable.

In the above formula, $R_6$ represents an alkyl group (e.g., a methyl group and ethyl group). X represents an oxygen atom, a sulfur atom, a selenium atom, or an alkyl- or aryl-substituted tertiary nitrogen atom, and X is preferably an alkyl-substituted tertiary nitrogen atom. $R_7$ and $R_8$ each represent a hydrogen atom or a substituent (as examples of this substituent, those mentioned as examples of the substituent for the benzene ring of the aforementioned Z may be given). $R_7$ and $R_8$ may bond with each other to form a double bond or a ring.

Among the compounds represented by any one of the formulae IV, V, VI, and VII, the compounds represented by the formula IV or VI are particularly preferable in light of raw stock storability, in the present invention.

In the above, each group of $R_1$, $R_2$, $R_3$, $R_4$, $R_5$, $R_6$, $R_7$, and $R_8$ includes those having a possible substituent, and as examples of the substituent, those exemplified as the substituent for the benzene ring of the aforementioned Z may be mentioned.

Specific examples of the compounds represented by any one of the formulae IV, V, VI, and VII are shown below, but the compound for use in the present invention is not limited by these examples.

D-1

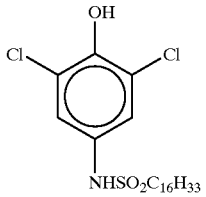

-continued

D-2

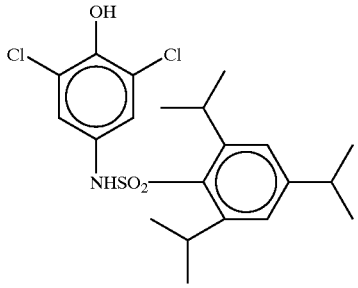

D-3

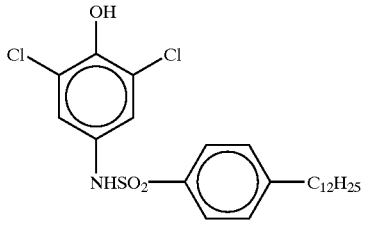

D-4

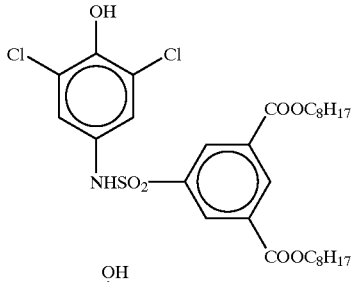

D-5

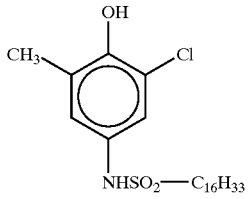

D-6

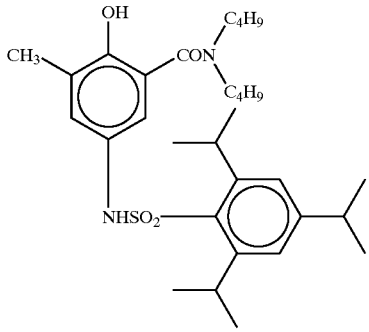

D-7

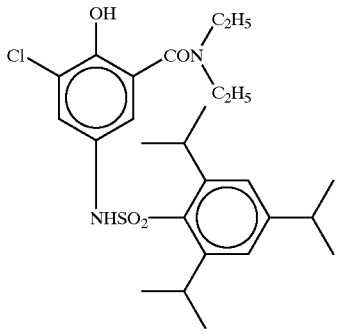

-continued
D-8
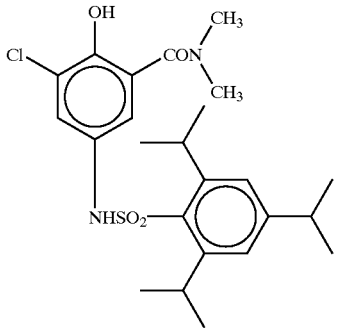
D-9
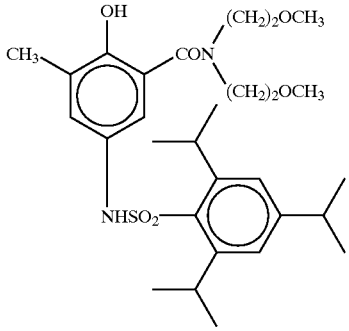
D-10
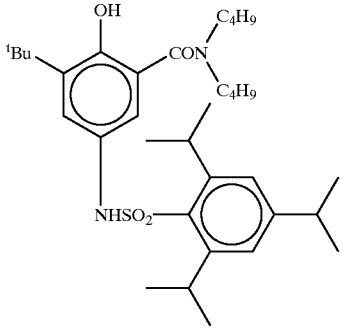
D-11
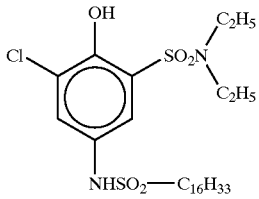
D-12
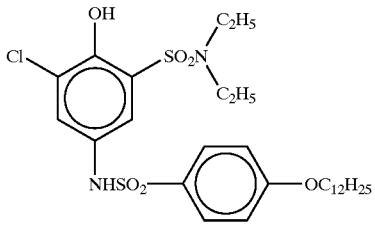
-continued
D-13
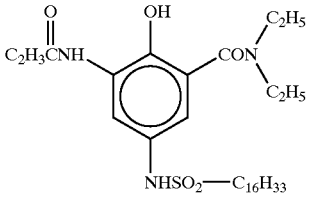
D-14
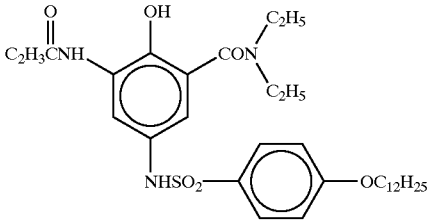
D-15
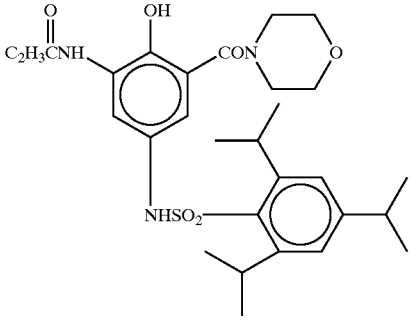
D-16
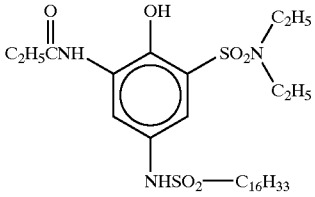
D-17
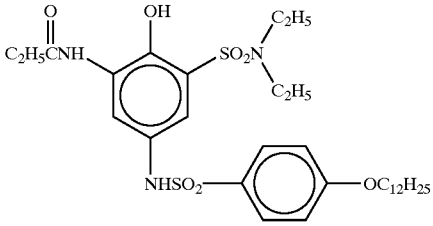
D-18
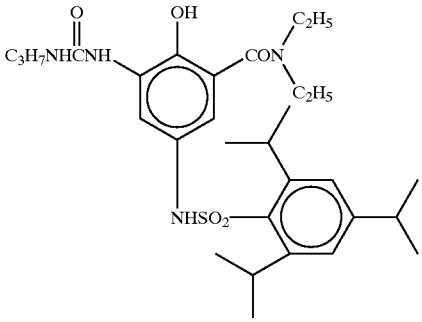

-continued
D-19
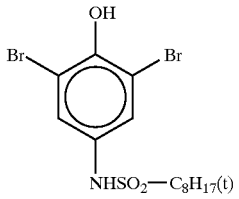
D-20
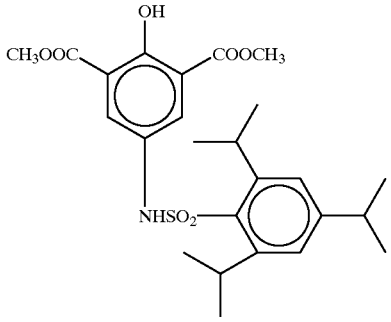
D-21
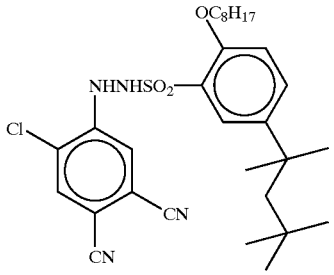
D-22
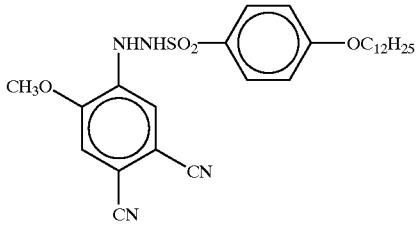
D-23
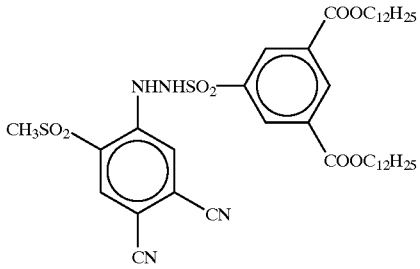
D-24
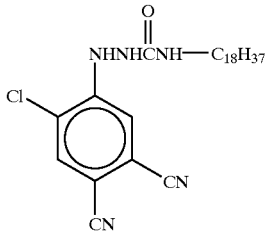
-continued
D-25
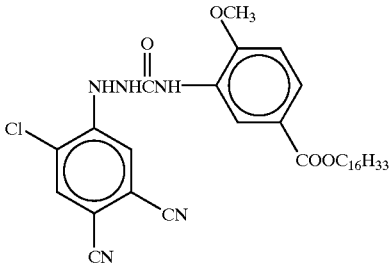
D-26
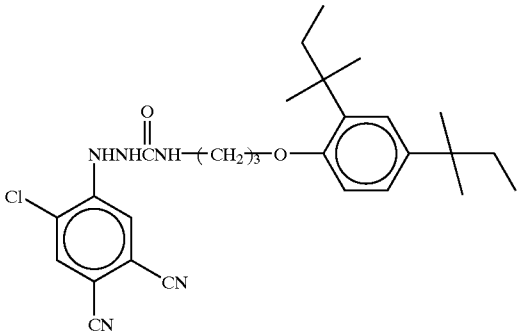
D-27
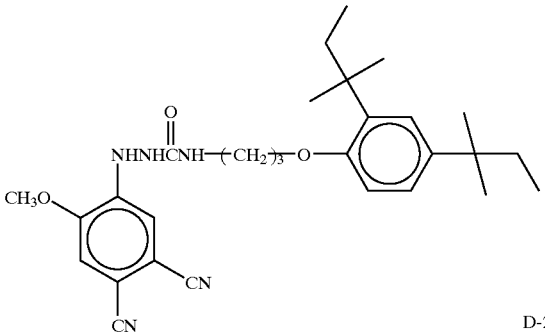
D-28
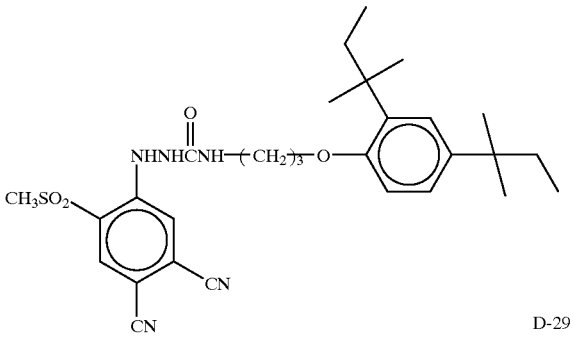
D-29
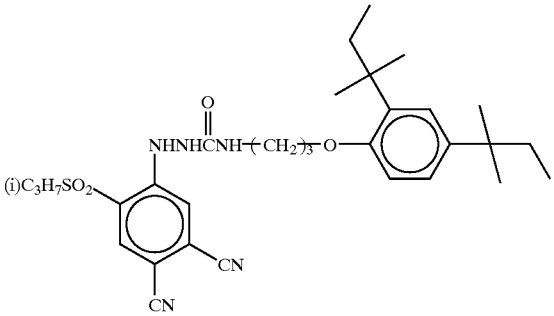

-continued
D-30
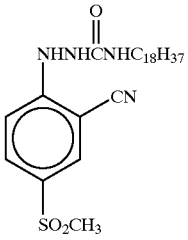
D-31
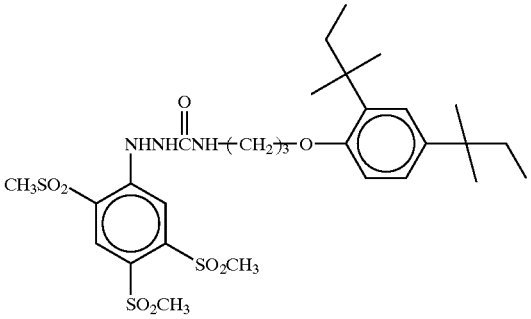
D-32
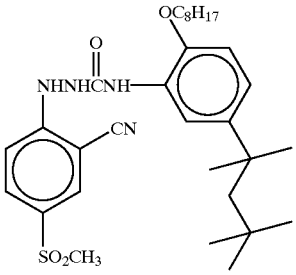
D-33
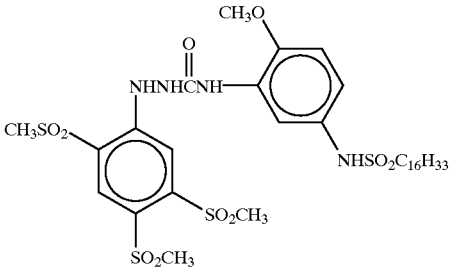
D-34
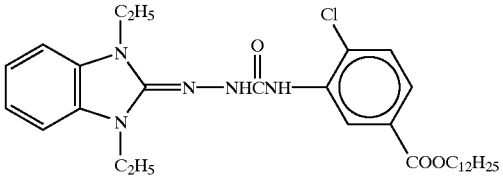
D-35
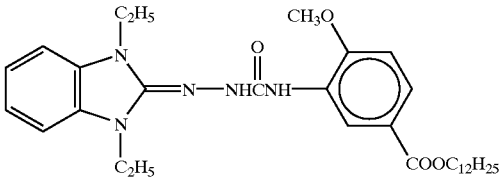
-continued
D-36
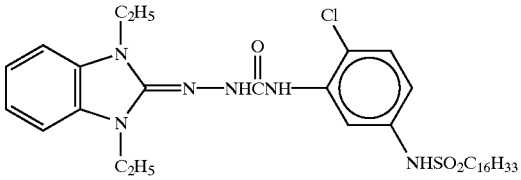
D-37
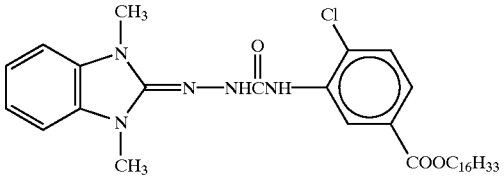
D-38
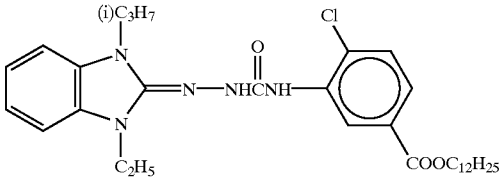
D-39
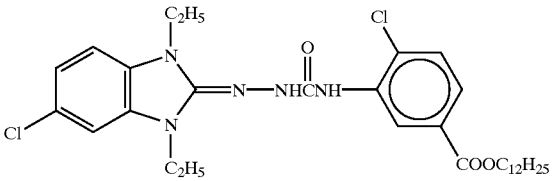
D-40
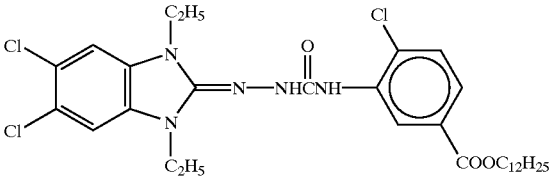
D-41
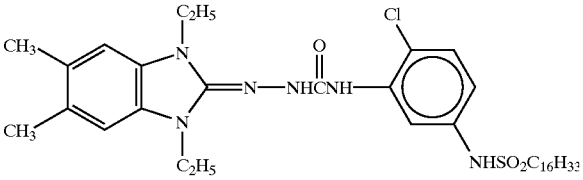
D-42
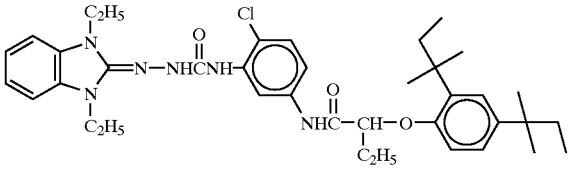

-continued

D-43

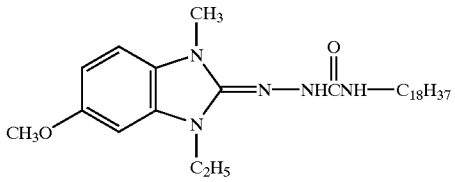

D-44

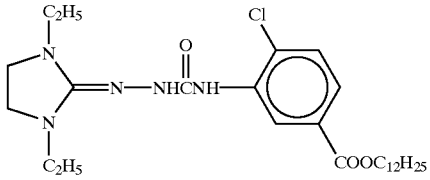

D-45

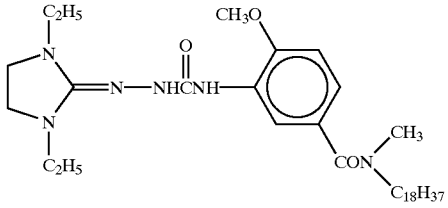

D-46

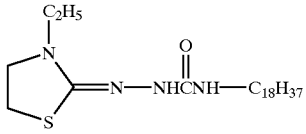

D-47

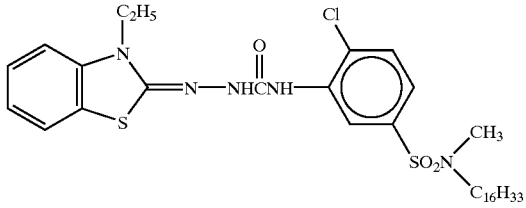

D-48

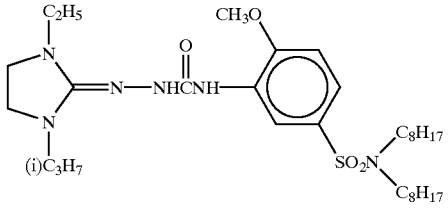

The above compounds can be generally synthesized according to known methods.

When a non-diffusion developing agent is used, an electron-transport agent and/or an electron-transport agent precursor can be used additionally, if necessary, in order to accelerate the electron transport between the non-diffusion developing agent and the developable silver halide. Particularly preferably, those described, for example, in the above-mentioned U.S. Pat. No. 5,139,919, EP-A-418 743 are used. Further, a method wherein it is introduced in a layer stably as described in JP-A-2-230143 and JP-A-2-235044 is preferably used.

The electron-transport agent or its precursor can be chosen from among the above developing agents or their precursors. The electron-transport agent and its precursor are desirably greater in its movability than the non-diffusion developing agent (electron provider). Particularly useful electron-transfer agents include 1-phenyl-3-pyrazolidones or aminophenols.

Also, an electron provider-precursor as described in JP-A-3-160,443 is preferably used.

Moreover, various reducing agents may be used, for various purposes, such as prevention of color mixing and improvement in color reproduction, in an intermediate layer and protective layer. Specifically, reducing agents described in European Patent Applications Laid-open No. 524,649 and No. 357,040, JP-A-4-249,245, JP-A-2-46,450 and JP-A-63-186,240 are preferably used. Also, development-inhabitor-releasing reducing agent compounds as described in JP-B-3-63,733, JP-A-1-150,135, JP-A-2-46,450, JP-A-2-64,634, JP-A-3-43,735, and European Patent Application Laid-open No. 451,833 can be used.

A developing agent precursor, which itself has no reducibility but exhibits reducibility by the action of heat or a nucleophilic reagent during the process of development, may also be used.

In addition, the light-sensitive material may include a reducing agent as mentioned below.

Examples of the reducing agent that can be used in the present invention include reducing agents and reducing agent precursors described, for example, in U.S. Pat. No. 4,500,626, columns 49 to 50, U.S. Pat. No. 4,839,272, U.S. Pat. No. 4,330,617, U.S. Pat. No. 4,590,152, U.S. Pat. No. 5,017,454, U.S. Pat. No. 5,139,919, JP-A-60-140335, pages (17) to (18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044, JP-A-62-131253, JP-A-62-131256, JP-A-64-13546, pages (40) to (57), JP-A-1-120553, and European Patent No. 220 746 A2, pages 78 to 96.

Combinations of various reducing agents as disclosed in U.S. Pat. No. 3,039,869 can also be used.

The developing agent or reducing agent may be incorporated (built-in) in a processing sheet explained later, and it can be incorporated in the light-sensitive material.

The total amount of the developing agent and reducing agent to be added is generally 0.01 to 20 mol, and particularly preferably 0.01 to 10 mol, per mol of silver, in the present invention.

In the present invention, as a coupler, a four-equivalent coupler and a two-equivalent coupler may be selected to use properly, depending upon the type of developing agent. First, a four-equivalent coupler is preferably used for the developing agent represented by the above formula IV, while a two-equivalent coupler can also be used. Because the developing agent represented by formula V has the coupling site that is substituted with a sulfonyl group, and the sulfonyl group is capable of being split-off as a sulfinic acid upon coupling, a split-off group (releasing group) on the coupler side must split-off as a cation. Therefore, this type of developing agent reacts with a four-equivalent coupler, which can release a proton as a split-off group upon coupling, but does not react with a two-equivalent coupler, whose split-off group is an anion. On the contrary, a two-equivalent coupler is used for the developing agent represented by the above formula VI or VII. Because the developing agents represented by formula VI or VII each have the coupling site that is substituted with a carbamoyl group, and a hydrogen atom on the nitrogen atom of the carbamoyl group is capable of being split-off as a proton upon coupling, a split-off group on the coupler side must split-off as an anion. Therefore, these types of developing agents react with a two-equivalent coupler, which can release an anion as a split-off group upon coupling, to form a dye, but they do not form a dye with a four-equivalent coupler, whose split-off group is a proton. The use of such a combination can prevent color impurity derived from the layer-to-layer transportation of an oxidized product of a developing agent. Specific examples of the coupler including both the four-equivalent couplers and the two-eqivalent couplers are described in detail, in "Theory of The Photographic Process" (4th Ed. Edited by T. H. James, Macmillan, 1977), pp.291–334, and pp.354–361, JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474, JP-A-60-66249, and the foregoing literatures and patent publications.

Hydrophobic additives, such as a coupler, a developing agent a nondiffusion reducing agent, and the like, can be introduced into a layer of the light-sensitive material, by using a known method described in U.S. Pat. No. 2,322,027, and the like. In this case, a high-boiling organic solvent, as described in U.S. Pat. No. 4,555,470, U.S. Pat. No. 4,536,466, U.S. Pat. No. 4,536,467, U.S. Pat. No. 4,587,206, U.S. Pat. No. 4,555,476 and U.S. Pat. No. 4,599,296, JP-B-3-62,256, and the like, may be used in combination with a low-boiling organic solvent having a boiling point of 50 to 160° C., according to the need. Also, these dye-providing compounds, nondiffusion reducing agents, and high-boiling organic solvents may be respectively used in combination of two or more.

The amount of the high-boiling organic solvent is generally 10 g or less, preferably 5 g or less, and more preferably 1 g to 0.1 g, per 1 g of the hydrophobic additives to be used. Also, it is proper to use the high-boiling organic solvent in an amount of generally 1 ml or less, preferably 0.5 ml or less, and particularly preferably 0.3 ml or less, per 1 g of the binder.

A dispersing method that uses a polymer as described in JP-B-51-39,853 and JP-A-51-59,943, and a method wherein the addition is made with them in the form of a fine-particle dispersion, as described in JP-A-62-30,242, and the like, may be used.

In the case of a compound, which is substantially insoluble in water, besides the above methods, a method can be used wherein the compound is dispersed and contained in the form of a fine particle in a binder.

When the hydrophobic compound is dispersed in a hydrophilic colloid, various surfactants may be used. For example, those listed, as examples of the surfactant, in JP-A-59-157,636, page (37) to page (38), and in the aforementioned Research Disclosures, may be used. Phosphate-type surfactants described in JP-A-7-56267, JP-A-7-228589, and West Germany Patent Application Laid-open No. 1,932,299A, may also be used.

In the present invention, a compound, which serves to activate developing and concurrently serves to stabilize an image, may be used in the light-sensitive material. Specific compounds, which can be preferably used, are described in U.S. Pat. No. 4,500,626, columns 51 to 52.

The light-sensitive material may be provided with various non-light-sensitive layers, such as a protective layer, an undercoat layer, an intermediate layer, a yellow filter layer, and an anti-halation layer, between the aforementioned silver halide emulsion layers, or as the uppermost layer or the lowermost layer. Also, various auxiliary layers, such as a backing layer, may be provided on the opposite side of the support. Specifically, a layer structure as described in the above patents, an undercoat layer as described in U.S. Pat. No. 5,051,335, an intermediate layer containing a solid pigment as described in JP-A-1-167,838 and JP-A-61-20,943, an intermediate layer containing a reducing agent or a DIR compound as described in JP-A-1-120,553, JP-A-5-34,884 and JP-A-2-64,634, an intermediate layer containing an electron transfer agent as described in U.S. Pat. No. 5,017,454 and U.S. Pat. No. 5,139,919 and JP-A-2-235,044, a protective layer containing a reducing agent as described in JP-A-4-249,245, or layers obtained by combining these layers may be provided.

As a dye that can be used in a yellow filter layer and an anti-halation layer, a dye that loses its color or dissolves out when developed and thus does not contribute to the density after processing is preferable.

The expression "a dye in the yellow filter layer and anti-halation layer loses its color or removed when developed" means that the amount of the dye remaining after processing becomes generally ⅓ or less, and preferably 1/10 or less, of the amount of the dye immediately before coating. The components of the dye may be dissolved out from the light-sensitive material, or transferred to a processing material when the material is processed, or may be converted to be a colorless compound by a reaction at the time of processing.

As the dye, which can be used in the light-sensitive material of the present invention, a known dye may be used. For example, a dye dissolved in an alkali of a developing solution, or a dye of a type that losts its color by reacting with a component of a developing solution, such as a sulfite ion, a developing agent, or an alkali may be used. Concretely, dyes described in European Patent Application EP 549,489A, and dyes ExF2 to -6 in JP-A-7-152129, may be mentioned. A solid-dispersed dye as described in JP-A-8-101487 may also be used. Although this dye may be used when the light-sensitive material is developed with a processing solution, this dye is particularly preferably used when the light-sensitive material is thermally developed using a processing sheet described later.

Also, the dye may be mordanted with a mordant and a binder. In this case, as the mordant and the dye, those known in the field of photography may be used. Examples of the mordant may include mordants described in U.S. Pat. No. 4,500,626, columns 58–59, JP-A-61-88256, pp.32–41, JP-A-62-244043, JP-A-62-244036, and the like.

Also, such method can be conducted where using a reducing agent and a compound that reacts with the reducing agent to release a diffusible dye, allowing a movable dye to be released by an alkali at the development, and then allowing the dye to be dissolved out in a processing solution or transferred to a processing sheet, to thereby be removed. There are specific descriptions in U.S. Pat. No. 4,559,290 and U.S. Pat. No. 4,783,369, European Patent No. 220,746A2, Published Technical Report (Kokai-Giho) No. 87-6119, and besides, in JP-A-8-101487, Paragraphs 0080-0081.

A leuco dye or the like that loses its color may also be used. Specifically, a silver halide light-sensitive material containing a leuco dye, which is color-developed in advance by using a developer of an organic acid metal salt, is disclosed in JP-A-1-150,132. Because a leuco dye and a developer complex react with an alkali agent or under heating to decolorize, a combination of such leuco dye and such developer is preferable if the light-sensitive material is thermally developed, in the present invention.

As the leuco dye, known leuco dyes may be utilized. There are descriptions concerning the leuco dyes in Moriga & Yoshida "Senryo to Yakuhin (Dyes and Chemicals)" 9, page 84 (Kaseihin Kogyo-Kyokai), "Shinban Senryo Binran (Dye Handbook new edition)" page 242 (Maruzen, 1970), R. Garner "Reports on the Progress of Appl. Chem" 56, page 199 (1971), "Senryo to Yakuhin (Dyes and Chemicals)" 19, page 230 (Kaseihin Kogyo-Kyokai, 1974), "Shikizai (Colorant)" 62, page 288 (1989), "Shenshoku Kogyo (Dye Industry)" 32, 208, and the like.

As the developer, acid clay type developers, phenolformaldehyde resins or metal salts of organic acids are preferably used. As the metal salts of organic acids, metal salts of salicylic acids, metal salts of phenol/salicylic acid/formaldehyde resins, rhodanates, and metal salts of xanthogenates, are advantageous. As the metals, zinc is particularly preferable. As oil-soluble zinc salicylates, among the aforementioned developer, those described in the specification of each of U.S. Pat. No. 3,864,146 and U.S. Pat. No. 4,046,941, and the publication of JP-B-52-1327 may be used.

It is preferable that the light-sensitive material of the present invention is hardened with a hardener.

Examples of the hardener include hardeners described in U.S. Pat. No. 4,678,739, column 41, U.S. Pat. No. 4,791,042, JP-A-59-116,655, JP-A-62-245,261, JP-A-61-18,942, JP-A-4-218,044, and the like. More specific examples of the hardener include aldehyde-series hardeners (e.g., formaldehyde), aziridine-series hardeners, epoxy-series hardeners, vinylsulfone-series hardeners (e.g., N,N'-ethylene-bis(vinylsulfonylacetamide)ethane), N-methylol-series hardeners (e.g., dimethylolurea), boric acid, metaboric acid, and polymer hardeners (e.g., compounds described in JP-A-62-234,157 and the like).

These hardeners are used in an amount of generally 0.001 to 1 g, and preferably 0.005 to 0.5 g, per 1 g of the hydrophilic binder.

In the light-sensitive material, various antifoggants or photographic stabilizers or their precursors may be used. Specific examples of these compounds include compounds described in the aforementioned Research Disclosures, U.S. Pat. No. 5,089,378, U.S. Pat. No. 4,500,627, and U.S. Pat. No. 4,614,702, JP-A-64-13,564, pp.(7) to (9), (57) to (71) and (81) to (97), U.S. Pat. No. 4,775,610, U.S. Pat. No. 4,626,500 and U.S. Pat. No. 4,983,494, JP-A-62-174,747, JP-A-62-239,148, JP-A-1-150,135, JP-A-2-110,557, JP-A-2-178,650, RD17,643 (1978) pp.(24)–(25), and the like.

These compounds are used in an amount of preferably $5\times10^{-6}$ to $1\times10^{-10}$ lmol, and more preferably $1\times10^{-5}$ to $1\times10^{-2}$ mol, per 1 mol of silver.

The present invention may be applied to a variety of color light-sensitive materials, such as color negative films for general use or movies, color reversal films for slides or televisions, color papers, color positive films, and color reversal papers. The present invention is preferable for film units with a lens as described in JP-B-2-32615 and JU-B-3-39784 (the term "JU-B" used herein means an "examined Japanese utility model publication").

Appropriate supports that may be used in the present invention are described in, for example, the aforementioned RD. No. 17643, page 28, RD. No. 18716, page 647, right column to page 648, left column, and RD. No. 307105, page 879.

The present invention is particularly preferable for light-sensitive materials for photographing. As the support for this type of light-sensitive material, those known as the supports of light-sensitive materials for photographing may be used. Typical examples of such a support include cellulose acetate films, polyethylene terephthalate films, and polyethylene naphthalate films, or their derivative films.

Besides, a magnetic recording layer may be provided on the light-sensitive material of the present invention. For example, the magnetic recording layers described in JP-A-4-124645, 5-40321, 6-35092, and 6-317875 are preferable.

The magnetic recording layer is formed by coating on a support a water-based or organic solvent-based coating solution comprising a binder and magnetic grains dispersed therein.

Examples of usable magnetic grains include ferromagnetic iron oxide such as $\gamma$-$Fe_2O_3$, Co-deposited $\gamma$-$Fe_2O_3$, Co-deposited magnetite, Co-containing magnetite, ferromagnetic chromium dioxide, ferromagnetic metals, ferromagnetic alloys, hexagonal-system Ba-ferrite, Sr-ferrite, Pb-ferrite, and Ca-ferrite. A Co-deposited ferromagnetic iron oxide such as Co-deposited $\gamma$-$Fe_2O_3$ is preferable. The grain can take any shape of a needle, a rice grain, a sphere, a cube, a plate (tabular), etc. The specific surface area in SBET is preferably 20 $m^2/g$ or greater and particularly preferably 30 $m^2/g$ or greater. The saturation magnetization ($\sigma s$) of the ferromagnetic substance is preferably in the range of $3.0\times10^4$ to $3.0\times10^5$ A/m and particularly preferably $4.0\times10^4$ to $2.5\times10^5$ A/m. The ferromagnetic grains may be surface-treated with silica and/or alumina or with an organic substance. Further, as described in JP-A-6-161032, the ferromagnetic grains may be surface-treated with a silane coupling agent or with a titanium coupling agent. Magnetic grains, which are covered with an inorganic or organic substance on the surface and are described in JP-A-4-259911 and JP-A-5-81652, can also be used in the present invention.

As the binders usable together with the magnetic grains, thermoplastic resins, thermosetting resins, radiation-curable resins, reactive resins, acid-, alkali or biodegradable polymers, naturally occurring polymers (e.g., cellulose derivatives and saccharide derivatives) and mixtures thereof, described in JP-A-4-219569, can be used. These resins generally have a Tg in the range of −40 to 300° C. and a weight average molecular weight in the range of 2,000 to 1,000,000.

Preferred examples of the binder include vinyl copolymers, cellulose derivatives, such as cellulose diacetate, cellulose triacetate, cellulose acetatepropionate, cellulose acetatebulylate, and cellulose tripropionate, acrylic resins, polyvinyl acetal resins, and gelatin. Cellulose di(tri) acetate is particularly preferable.

The binder may be hardened by use of a crosslinking agent such as an epoxy, aziridine, or isocyanate crosslinking agent. Examples of the isocyanate crosslinking agent include isocyanates, such as tolylene diisocyanate, 4,4'-diphenylmethane diisocyanate, hexamethylene diisocyanate, and xylylene diisocyanate, a reaction product of any of these isocyanates and a polyalcohol (e.g., a 3/1 molar ratio adduct of tolylene diisocyanate/trimethylol propane), and a polyisocyanate produced by a condensation reaction of these isocyanates, all of which are described, for example, in JP-A-6-59357.

The magnetic grains are dispersed in a binder preferably by means of a kneader, a pin-type mill, or an annular mill, as described in JP-A-6-35092. A combination of these dispersing means is also preferable. Dispersants described in JP-A-5-88283 and other known dispersants can be used.

The thickness of the magnetic recording layer is generally 0.1 to 10 $\mu$m, preferably 0.2 to 5 $\mu$m, and more preferably 0.3 to 3 $\mu$m.

The mass ratio of the magnetic grains to the binder is preferably 0.5:100 to 60:100, and more preferably 1:100 to 30:100.

The coating amount of the magnetic grains is generally 0.005 to 3 $g/m^2$, preferably 0.01 to 2 $g/m^2$, and more preferably 0.02 to 0.5 $g/m^2$.

The transmission yellow density of the magnetic recording layer is preferably 0.01 to 0.50, more preferably 0.03 to 0.20, and particularly preferably 0.04 to 0.15. The magnetic recording layer may be provided on the entire surface or in a stripe on the back of a photographic support by coating or printing.

Employable methods for coating the magnetic recording layer include an air doctor method, a blade method, an air knife method, squeezing, impregnation, reverse roll coating, transfer roll coating, gravure coating, kissing, casting, spraying, dipping, bar coating, and extrusion. The coating solution, which is described, for example, in JP-A-5-341436, is preferable.

The magnetic recording layer may also have functions such as the enhancement of lubricity, control of curling, prevention of electrostatic charge, prevention of adhesion, and head polishing. Alternatively, another functional layer, which performs any of these functions, can be provided. The use of an abrasive, at least one kind of grains of which is made up of non-spherical inorganic grains having a Mohs hardness of 5 or greater, is preferable. Examples of the composition of non-spherical inorganic grains preferably include oxides, such as aluminum oxide, chromium oxide, silicon dioxide, and titanium dioxide, carbides such as silicon carbide and titanium carbide, and a fine powder of diamond etc. The surface of these abrasive grains may be treated with a silane coupling agent or with a titanium coupling agent. These grains may be added to the magnetic recording layer. Alternatively, the magnetic recording layer may be overcoated with these grains (e.g., as a protective layer or as a lubricating layer). As for the binder to be used in the overcoat, the same binders as those mentioned above may be used, and the binder in the overcoat is preferably the same as that for the magnetic recording layer. The light-sensitive materials having a magnetic recording layer are described in U.S. Pat. Nos.5,336,589, 5,250,404, 5,229,259, and 5,215,874, and EP 466,130.

The light-sensitive material of the present invention is subjected to development by, after subjecting to exposure to light, putting the light-sensitive material together with a processing material that contains a base and/or a base precursor after supplying water in an amount corresponding to 1/10 to 1 times the amount of water required for maximum swelling of whole coating films constituting the light-sensitive material and processing material, followed by heating.

The present invention has been attained with the intention to attain high sensitivity and high maximum density in heat development as aforementioned, further in addition to the above, to attain excellent graininess and exposure latitude, and to reduce environmental loads caused by development using solutions. It is also possible to form an image by processing the light-sensitive material of the present invention, with a conventional development that uses a developing solution, with an activator method that employs an alkali processing solution, or with a processing solution that contains a developing agent/a base.

Heat processings of light-sensitive materials are known in the technical fields concerned, and there are descriptions concerning heat-developable light-sensitive materials and their processes in, for example, "Shashin Kogaku no Kiso (Fundamental of Photographic Engineering)" (1970, published by Corona), pp.553–555, "Eizo Joho (Picture Information)" published on April, 1978, page 40, "Nabletts Handbook of Photography and Reprography", 7th Ed. (Vna Norstrand and Reinhold Company), pp.32–33, U.S. Pat. No. 3,152,904, U.S. Pat. No. 3,301,678, U.S. Pat. No. 3,392,020 and U.S. Pat. No. 3,457,075, U.K. Patants. No. 1,131,108 and No. 1,167,777, and Journal of Research Disclosure, the June issue (1978), pp.9–15 (RD-17029).

The activator treatment indicates a treating method, in which a light-sensitive material is made to incorporate a color-developing agent, and development processing is performed using a processing solution free from any color-developing agent. The feature of the processing solution in this case is that it does not contain a color-developing agent, which is normally contained as a composition of a development-processing solution, but the processing solution may comprise other components (e.g., an alkali and an auxiliary developing agent). Examples of the activator treatment are shown in known literature such as EP No. 545, 491A1 and EP No. 565,165A1.

The method, wherein development is carried out using a processing solution containing a developing agent/a base is described in RD. No. 17643, pp.28–29, RD. No. 18716, page 651, left column to right column, and RD. No. 307105, pp.880–881.

Hereinafter, processing materials and processing methods that can be used in the case of heat-development, in the present invention, are explained in detail.

Given as examples of the base or base precursor for use in the present invention are various known compounds. Preferable examples of the base include a hydroxide, carbonate, bicarbonate, borate, phosphate, and the like of an alkali metal such as sodium, potassium, and the like; a hydroxide, carbonate, bicarbonate, borate, phosphate, carboxylate, and the like of a quaternary alkylammonium, such as tetramethylammonium and tetraethylammonium; an organic base such as amidines, cyclic amidines, guanidines, cyclic guanidines, aliphatic amines, aromatic amines, heterocyclic amines, and the like and a carbonate, bicarbonate, borate, phosphate, carboxylate, and the like of these organic bases. It is preferable to use these bases by making them contained in an amount 0.05 to 10 g/m$^2$ in a processing material, or in an amount of 1 to 100 g/l in a processing solution.

Also, as the base precursor, compounds that decompose or react under heating or in an alkaline condition to generate a base (e.g., compounds described in JP-A-62-65038 and U.S. Pat. No. 4,511,493) may be used. A combination of a basic metal compound, which is sparingly soluble in water, and a compound, which can undergo a complex-forming reaction with a metal ion constituting the sparingly-soluble metal compound (complex-forming compounds or complexing agents), as described in, for example, JP-A-62-129848, European patent publication (Laid-open) No. 210,660A2, and U.S. Pat. No. 4,740,445, is particularly preferable.

Preferable examples of the sparingly soluble metal compound are oxides of, hydroxides of and basic carbonates of zinc or aluminum, and particularly preferable examples are zinc oxide, zinc hydroxide, and basic zinc carbonate.

It is preferable to use the metal compound sparingly soluble in water by dispersing in the form of fine particles in a hydrophilic binder, and then including in the light-sensitive material, as described, for example, in JP-A-59-174830. The average particle diameter of the fine particles is generally 0.001 to 5 $\mu$m, and preferably 0.01 to 2 $\mu$m. The content in the light-sensitive material is generally 0.01 to 10 g/m$^2$, and preferably 1 to 5 g/m$^2$.

The complex-forming compound, which reacts with a metal ion of the basic metal compound that is sparingly soluble in water, is preferably contained in a processing sheet. The complex-forming compound is a known compound as a chelating agent used in analytical chemistry, and as a hard-water softener in photographic chemistry. The details of the complex-forming compound are also described in, besides the aforementioned patent specifications, A Ringbom "Saku Keisei Hanno (Complex Forming Reaction)", translated by Nobuyuki Tanaka and Haruko Sugi (Sangyo Tosho). Complex-forming compounds preferably used in the present invention are water-soluble compounds. Examples of the complex-forming compounds include aminopolycarboxylic acids (including salts thereof), such as ethylenediaminetetraacetic acid, nitrilotriacetic acid, diethylenetriaminepentaacetic acid, and the like; aminophosphonic acids (salts), such as aminotris(methylenephosphonic acid), ethylenediaminetetramethylenephosphonic acid, and the like; and pyridinecarboxylic acids (salts), such as 2-picolinic acid, pyridine-2,6-dicarboxylic acid, 5-ethyl-2-picolinic acid, and the like. Among these compounds, pyridinecarboxylic acids (salts) are particularly preferable.

In the present invention, the complex-forming compound is preferably used as a salt neutralized with a base. Particularly, salts of the complex-forming compounds with an organic base, such as guanidines, amidines, or tetraalkylammonium hydroxide, and salts of the complex-forming compounds with an alkali metal, such as sodium, potassium, or lithium, are preferable. Specific examples of the preferable complex-forming compound are described in the aforementioned JP-A-62-129848, European Patent Application Laid-open No. 210,660A2, and the like. The content of the complex-forming compound in the processing material is generally 0.01 to 10 g/m$^2$, and preferably 0.05 to 5 g/m$^2$.

A thermal solvent may be added to the light-sensitive material of the present invention, for the purpose of accelerating heat development. Examples of the thermal solvent include organic compounds having a polarity as described in U.S. Pat. No. 3,347,675 and U.S. Pat. No. 3,667,959. Given as specific examples of the thermal solvent are amide derivatives (e.g., a benzamide), urea derivatives (e.g., methylurea and ethyleneurea), sulfonamide derivatives (e.g., compounds described in JP-B-1-40974 and JP-B-4-13701), polyol compounds (e.g., sorbitols) and polyethylene glycols.

When the thermal solvent is insoluble in water, it is preferably used in the form of a solid dispersion. A layer to which the thermal solvent is added may be any of the light-sensitive layers and the non-light-sensitive layers, according to the purpose.

The amount of the thermal solvent to be added is generally 10 wt % to 500 wt %, and preferably 20 wt % to 300 wt %, based on the binder in the layer to which the thermal solvent is added.

The heating temperature in the heat development step is generally about 50° C. to 250° C., and especially 60° C. to 150° C. is useful, and 60° C. or more and 100° C. or less is particularly preferable.

The time required to thermally develop at such a temperature is preferably about 3 sec to 80 sec, more preferably 5 sec or more and within 60 sec, and particularly preferably 5 sec or more and within 30 sec.

In order to supply the base required in the heat development step, a processing material that has a processing layer containing a base or a base precursor is used. The processing material may be imparted with functions, in addition to the above; a function to shield air at the time of thermal development, a function to prevent the volatilization of materials from the light-sensitive material, a function to supply, to the light-sensitive material, materials for processing other than the base, and a function to remove materials (e.g., a YF dye and AH dye) in the light-sensitive material that become needless after the development, or useless components generated at the time of development. The support and binder of the processing material used in this case may be the same to those used in the light-sensitive material.

A mordant may be added to the processing material, with the intention to remove the aforementioned dyes, and for other purposes. As the mordant, those known in the field of photography may be used. Examples of the mordant may include mordants described in U.S. Pat. No. 4,500,626, columns 58-59, JP-A-61-88256, pp.32–41, JP-A-62-244043, JP-A-62-244036, and the like. Also, a dye-accepting polymer compound described in U.S. Pat. No. 4,463,079 may be used. Also, the aforementioned thermal solvent may be contained.

The processing layer of the processing material is made to contain a base or a base precursor. As the base, either an organic base or an inorganic base may be used, and as the base precursor, the aforementioned one may be used. The amount of the base or base precursor to be used is generally 0.1 to 20 g/m$^2$, and preferably 1 to 10 g/m$^2$.

As a heating method in the development step, there are a method wherein the photographic material is brought into contact with a heated block or plate, a method wherein the photographic material is brought in contact with a hot plate, a hot presser, a heat roller, a heat drum, a halogen lamp heater, or an infrared- or far infrared-lamp heater, and a method wherein the photographic material is made to pass through a high-temperature atmosphere.

As a method wherein the light-sensitive material and the processing material are overlapped (superimposed), in which a light-sensitive layer and a processing layer are facing each other, the methods described in JP-A-62-253,159 and JP-A-61-147,244, page (27) may be applied.

For the processing of the photographic element according to the present invention, any one of various heat development apparatuses may be used. For example, apparatuses described in JP-A-59-75,247, JP-A-59-177,547, JP-A-59-181,353, JP-A-60-18,951, JU-A-62-25,944 ("JU-A" means unexamined published Japanese utility model application), JP-A-6-130,509, JP-A-6-95,338, JP-A-6-95,267, JP-A-8-29,955, JP-A-8-29,954, and the like can be preferably used.

Also, as a commercially available apparatus, for instance, Pictrostat 100, Pictrostat 200, Pictrostat 300, Pictrostat 330 and Pictrostat 50, and Pictrography 3000, and Pictrography 2000 (all these are trade names), manufactured by Fuji Photo Film Co., Ltd. may be used.

The light-sensitive material and/or the processing sheet in the present invention may be in the form that has an electroconductive heat-generating material layer as a heating means for thermal development. As this heat-generating element, those described in JP-A-61-145,544, or the like, may be utilized.

In the present invention, although image information can be read out without removing developed silver generated by development and undeveloped silver halide, an image can be also read out after the removal of these. In the latter case, a means wherein these developed silver and undeveloped silver halide are removed concurrently with the development or after the development, may be adopted.

In order to remove developed silver in the light-sensitive material, or in order to complex or solubilize a silver halide, simultaneously with development, the processing material may contain a silver oxidizing agent or re-halogenating agent, which acts as a bleaching agent, or a silver halide solvent, which acts as a fixing agent, in advance, so that these reactions may occur at the-time of heat development.

Also, after the completion of development for image formation, a second material that contains a silver oxidizing agent, a re-halogenating agent, or a silver halide solvent may be put together with the light-sensitive material, whereby attaining the removal of developed silver or attaining the complexing or solubilization of the silver halide.

In the present invention, it is preferable to carry out these treatments to the extent that these treatments do not provide a hindrance to the reading out of image information after photographing and image-forming development in succession thereto. Because, particularly, undeveloped silver halide causes a significant haze in a gelatin film to raise the density of the background of an image, it is preferable to decrease the haze by using such a complexing agent as aforementioned, or to solubilize the silver halide so that all or part thereof is removed from the film. It is also preferable to use a tabular grain having a high aspect ratio, or a tabular grain having a high silver chloride content, for the purpose of decreasing the haze of the silver halide itself.

The silver bleaching agents usually used may be arbitrarily used as a bleaching agent that can be used in the processing material for use in the present invention. Such a bleaching agent is described in U.S. Pat. No. 1,315,464 and U.S. Pat. No. 1,946,640, and Photographic Chemistry Vol. 12, chapter 30, Foundation Press London England. These bleaching agents effectively oxidize and solubilize a photographic silver image. Examples of useful silver bleaching agent include alkali metal bichromates and alkali metal ferricyanide.

Preferable bleaching agents are those soluble in water, and examples thereof include ninhydrine, indandione, hexaketocyclohexane, 2,4-dinitrobenzoic acid, benzoquinone, benzenesulfonic acid, and 2,5-dinitrobenzoic acid. Also, examples of the bleaching agent include metal organic complexes, such as ferric salt of cyclohexyldialkylaminotetraacetic acid, ferric salt of ethylenediaminetetraacetic acid, and ferric salt of citric acid. As the fixing agent, a silver halide solvent, which can be contained in the processing material (first processing material) that develops the aforementioned light-sensitive material, may be used. For the binder, support and other additives that can be used in the second processing material, those that can be used in the first processing material may be used.

Although the coating amount of the bleaching agent must be changed according to the silver content of the light-sensitive material to be put together, the bleaching agent is generally used in an amount ranging from 0.01 mol to 10 mol per mol of coated amount of silver of the light-sensitive material in unit area. The amount of the bleaching agent is preferably 0.1 to 3 mol/mol of coated silver in the light-sensitive material, and more preferably 0.1 to 2 mol/mol of coated silver in the light-sensitive material.

As the silver halide solvent, known compounds may be used. Examples of the silver halide solvent which may be used include thiosulfates, such as sodium thiosulfate and ammonium thiosulfate, sulfites, such as sodium sulfite and sodium hydrogensulfite; thiocyanate, such as potassium thiocyanates and ammonium thiocyanate; thioether compounds such as 1,8-di-3,6-dithiaoctane, 2,2'-thiodiethanol, and 6,9-dioxa-3,12-dithiatetradecane-1,14-diol as described in JP-B-47-11386; compounds having five- or six-membered imide ring, such as uracil and hydantoin, as described in JP-A-8-179458; and compounds represented by the following formula (I) as described in JP-A-53-144319. A mesoionic thiolate compound of trimethyltriazolium thiolate as described in Analytica Chemica Acta, Vol. 248, pp.604 to 614 (1991) is also preferable. Compounds that is capable of fixing a silver halide to stabilize, as described in JP-A-8-69097, may also be used as the silver halide solvent.

$$N(R^1)(R^2)—C(=S)—X—R^3 \quad \text{Formula (1)}$$

In the formula (1), X represents a sulfur atom or an oxygen atom, $R^1$ and $R^2$, which may be the same or different, each represent an aliphatic group, an aryl group, a heterocyclic residue, or an amino group, and $R^3$ represents an aliphatic group, or an aryl group. Each of $R^1$ and $R^2$, or $R^2$ and $R^3$ may be combined with each other to form a five- or six-membered hetero ring. The aforementioned silver halide solvent may be used together.

Among the aforementioned compounds, sulfites and the compounds having a five- or six-membered imide ring, such as uracil and hydantoin, are particularly preferable. Particularly, uracil and hydantoin are preferable, in the point that a reduction in glossiness at the storage of the processing material, can be improved, if the uracil or hydantoin is added as a potassium salt thereof.

The total content of the silver halide solvents in the processing layer is generally 0.01 to 100 mmol/$m^2$, preferably 0.1 to 50 mmol/$m^2$, and more preferably 10 to 50 mmol/$m^2$. The total amount of the silver halide solvents is generally 1/20 to 20 times, preferably 1/10 to 10 times, and more preferably 1/3 to 3 times the molar amount of coated silver in the light-sensitive material. The silver halide solvent may be added to a solvent such as water, methanol, ethanol, acetone, dimethylformamide, or methylpropyl glycol, or to an alkaline or acidic aqueous solution, or may be added to the coating solution after being dispersed as a solid fine particle.

Also, the processing material may contain a physical development nuclei and a silver halide solvent, so that silver halide in the light-sensitive material is solubilized and fixed to the processing layer simultaneously with development.

The physical development nuclei reduces a soluble silver salt diffused from the light-sensitive material to convert it into physically developed silver, thereby fixing the developed silver to the processing layer. As the physical development nuclei, all compounds known as physical development nuclei can be used. Examples thereof include colloidal particles of heavy metals (such as zinc, mercury, lead, cadmium, iron, chromium, nickel, tin, cobalt, copper, and ruthenium), noble metals (such as, palladium, platinum, silver, and gold), or compounds of any of these metals with chalcogen such as sulfur, selenium or tellurium. These physical development nucleus substances may be obtained by reducing a corresponding metal ion with a reducing agent, such as ascorbic acid, sodium boron hydride, or hydroquinone, to produce a metal colloid dispersion, or by mixing a soluble sulfide, selenide, or telluride solution with a corresponding metal ion, to produce a colloid dispersion of a water-insoluble metal sulfide, metal selenide, or metal telluride. These dispersions are preferably formed in a hydrophilic binder such as a gelatin. The preparation method of colloidal silver particles are described in U.S. Pat. No. 2,688,601, and the like. The desalting method of removing excess salts, which method is known in the preparation method of silver halide emulsions, may be conducted according to need.

The physical development nuclei that have a particle diameter of 2 to 200 nm are preferably used.

These physical development nuclei are contained in an amount of generally $10^{-3}$ to 100 mg/$m^2$, and preferably $10^{-2}$ to 10 mg/$m^2$, in the processing layer.

The physical development nuclei may be prepared separately, and added to a coating solution, and it may be produced by, for example, reacting silver nitrate with sodium sulfide, or reacting gold chloride with a reducing agent, in a coating solution that contains a hydrophilic binder.

As the physical development nucleus, silver, silver sulfide, palladium sulfide, or the like, is preferably used. If physically developed silver, which is transferred to a sheet containing a complexing agent, is used as an image, palladium sulfide, silver sulfide, or the like is preferably used, in the point that the Dmin becomes under a prescribed value and Dmax becomes high.

Each of the first processing material and the second processing material may have at least one polymerizable timing layer. This polymerizable timing layer can temporarily delay a bleaching and fixing reaction until the reaction of a desired silver halide with a dye-providing compound or a developing agent, is substantially completed. The timing layer may comprise a gelatin, polyvinyl alcohol, or polyvinyl alcohol/polyvinyl acetate. This layer can be also a barrier timing layer as described in, for example, U.S. Pat. No. 4,056,394, U.S. Pat. No. 4,061,496, and U.S. Pat. No. 4,229,516.

When this timing layer is applied, it is coated in a film thickness of generally 5 to 50 $\mu$m, and preferably 10 to 30 $\mu$m.

In a method of bleaching and fixing the light-sensitive material after development by using the second processing material, in the present invention, water amounting to 0.1 to 1 time the amount required for the maximum swelling of all coating films (layers), except for the backing layers, of both the light-sensitive material and the second processing material is supplied to either of the light-sensitive material or the second processing material, and thereafter the light-sensitive material is overlapped with the second processing material such that the light-sensitive layer faces the processing layer, followed by heating at a temperature of 40° C. to 100° C. for 5 seconds to 60 seconds.

As to the amount of water, the type of water, a water supplying method, and the method for overlapping the light-sensitive material and the processing material, those described for the first processing material and usual known ones can be employed.

More specifically, a bleaching and fixing sheet as described in JP-A-59-136733, U.S. Pat. No. 4,124,398, and JP-A-55-28098 may be used.

The color photographic light-sensitive material of the present invention exhibits high sensitivity and high maximum density and is suitable to simple and rapid processing.

The silver halide color photographic light-sensitive material of the present invention exhibits a very high sensitivity and brings about such an excellent effect that a color image having a high maximum density can be formed even by simple and rapid processing. The silver halide color photographic light-sensitive material of the present invention is preferable as a recording material for photographing in particular.

The present invention is described in more detail with reference to the following examples, but the present invention is not limited thereto.

EXAMPLES

Example 1

(1) Preparation of Emulsion

Tabular silver iodobromide emulsion A (Nucleation and Grain Growth)

1200 ml of an aqueous solution containing 6.2 g of a low-molecular-weight gelatin (molecular weight: 15,000) and 6.4 g of KBr was stirred while being kept at 35° C. To this solution, 43 ml of a 0.1 M $AgNO_3$ aqueous solution and 43 ml of a 0.1 M KBr aqueous solution were simultaneously added over 5 seconds by a double jet method. After that, 38 g of gelatin (lime-treated gelatin) was added thereto, the temperature was raised to 75° C. over 35 minutes, and the resultant mixture was ripened for 15 minutes at that temperature. Then, 608 ml of a 1.9 M $AgNO_3$ aqueous solution and a 1.9 M KBr aqueous solution containing 1 mol of KI were simultaneously added over 100 minutes by accelerating the flow rate (final flow rate was 11 times the initial flow rate) while keeping pAg at 8.07.

Thereafter, the temperature of the reaction mixture was then lowered to 40° C. over 25 minutes, and an aqueous solution containing 12.7 g of sodium p-iodoacetamidobenzenesulfonate (monohydrate), serving as an iodide-ion-releasing agent, was added thereto. Then, 50 ml of a 0.8 M sodium sulfite aqueous solution was added thereto over 1 minute at a constant flow rate, thereby allowing iodide ions to generate, with controlling the pH to 9.0. Two minutes later, the temperature of the reaction mixture was raised to 55° C. over 15 minutes, then the pH was returned to 5.5. Then, sodium benzenethiosulfonate and $K_2IrCl_6$ were added as a solution in amounts of $3.8\times10^{-6}$ mol/mol silver and $1\times10^{-8}$ mol/mol silver, respectively, to the total amount of silver in the grains. After that, 100 ml of an aqueous solution containing 12 g of gelatin (lime-processed gelatin) was added thereto, and then 269 ml of a 1.9 M $AgNO_3$ aqueous solution and a 1.9 M KBr aqueous solution were added simultaneously over 30 minutes at a constant flow rate while keeping pAg at 8.59.

(Washing, Dispersing)

After that, the resultant emulsion was cooled to 35° C. and washed with water according to a usual flocculation method. Then, after the pH of the emulsion was raised, 75 g of gelatin (lime-treated gelatin) was added to disperse the emulsion. As a final product, pH was adjusted to 5.8 and pAg was adjusted to 8.8. The thus-obtained emulsion was kept in a container.

The grain shape in the emulsion was photographed by a replica method using a transmission electron microscope wherein the measurement was made for 1,000 grains.

In the grains of the resultant emulsion, tabular grains accounted for 98% (in number) or more of the total grains and the projected area of the tabular grains accounted for 99% or more of the projected area of the total grains.

In the grains of the emulsion obtained, 98% or more of the projected area of the all grains was made up of tabular grains each having an aspect ratio of 8 or more.

The percentage of the projected area of hexagonal tabular grains having a ratio between neighboring sides (i.e., the ratio of the length of the longest side to the length of the shortest side) of 1.2 to 1 was 80% or more of the projected area of all grains in the emulsion.

The average equivalent-circle diameter of all the tabular grains was 2.52 $\mu$m, the average grain thickness of all the tabular grains was 0.180 $\mu$m, and the average aspect ratio of all the tabular grains was 14.0.

The coefficient of variation in the distribution of equivalent-sphere diameters (the diameters of spheres whose volume was equivalent to a volume of an individual grain) of all the grains was 11%, the coefficient of variation in the distribution of equivalent-circle diameters of all the tabular grains was 12%, and the coefficient of variation in the distribution of the grain thicknesses of all the tabular grains was 12%.

The coefficient of variation in the distribution of silver iodide contents among grains, measured with 200 grains by the method using EPMA, as described in European Patent No. 147,868 and the like, was 11%.

In the emulsion obtained, the percentage (in number %) of the tabular grains, which had 30 or more dislocation lines per grain at substantially only in the grain fringe portion, was 80% or more of the total grains.

The intra-grain distribution of silver iodide contents was measured with 20 grains by the method using an analytical electron microscope, as described in JP-A-7-219102, at 50 nm intervals of electron beam spots. According to the results, the grain fringe region was about 0.15 μm on average, the average silver iodide content in grain central portion was 1.0 mol %, and the average silver iodide content in grain fringe portion was 5.5 mol %.

Proportions of planes in grain surface of the obtained emulsion were measured by the method described in T. Tani, J. Imaging Sci., 29, 165 (1985), and the proportion of the {100} plane to the {111} plane was found to be 4.4%. Further, the proportion of the {100} plane in the edge portion of tabular grains, measured by the method described in JP-A-8-334850, was 36%.

(2) Chemical Sensitization

With regard to the emulsion A, the following red-sensitive spectral sensitizing dyes I, II and III were added as a spectral sensitizing dye to a red-sensitive emulsion, the following green-sensitive spectral sensitizing dyes IV, V and VI were added as a spectral sensitizing dye to a green-sensitive emulsion, and the following blue-sensitive spectral sensitizing dye VII was added as a spectral sensitizing dye to a blue-sensitive emulsion, in the following condition: temperature: 56° C., pH=5.8 and pAg=8.4. Then a mixed solution of potassium thiocyanate and chloroauric acid was added, and in succession, sodium thiosulfate, and the following tellurium sensitizer and Compound I were added to carry out spectral sensitization and chemical sensitization. The chemical sensitization was brought to a termination by using a mercapto compound described below. At this time, the amount of each of the spectral sensitizing dyes and the chemical sensitizer was controlled such that the sensitivity of the emulsion subjected to 1/100 sec exposure became a maximum. The sensitivity meant here is a logarithmic value of the reciprocal of an exposure amount providing a density higher than the fogging density by +0.15 on a characteristic curve obtained by subjecting a light-sensitive material to exposure and development as described later. These emulsions were expressed with each of the characters r, g and b annexed thereto corresponding to the spectral sensitizing dye used, as shown in the table below.

Sensitizing dye for red-sensitive emulsion I

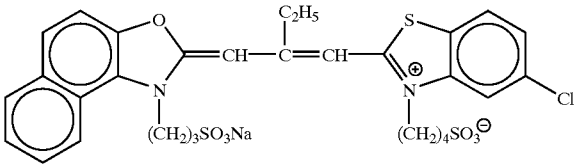

Sensitizing dye for red-sensitive emulsion II

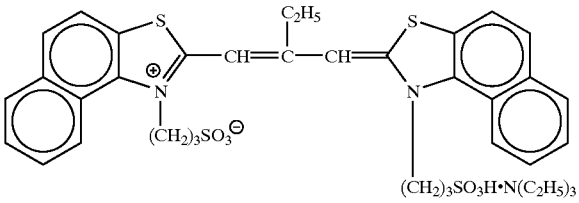

-continued

Sensitizing dye for red-sensitive emulsion III

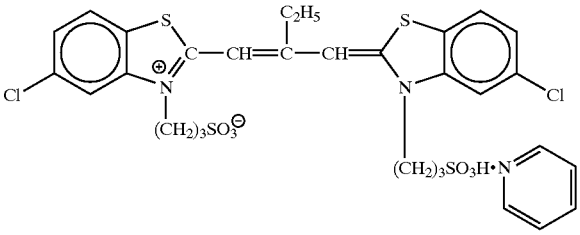

Sensitizing dyes for red-sensisitve emulsion I:II:III = 40:2:58 in a ra tio (molar ratio)

Sensitizing dye for green-sensitive emulsion IV

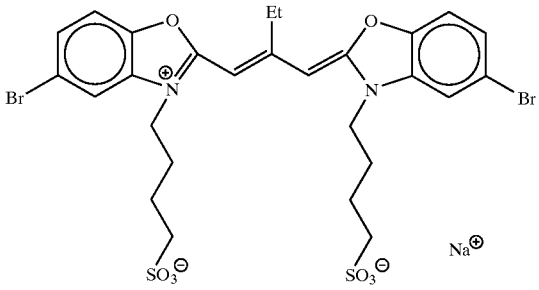

Sensitizing dye for green-sensitive emulsion V

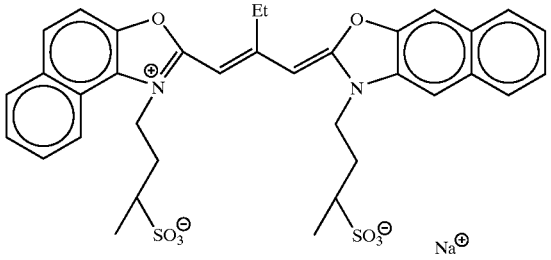

Sensitizing dye for green-sensitive emulsion VI

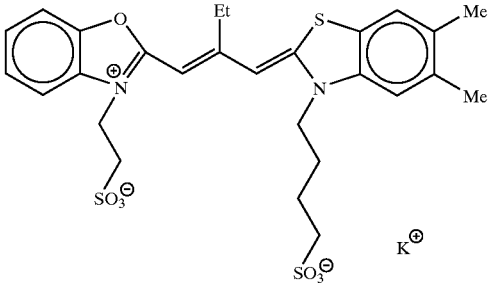

Sensitizing dyes for green-sensitive emulsion IV:V: I = 77:20:3 in a ratio (molar ratio)

Sensitizing dye for blue-sensitive emulsion VII

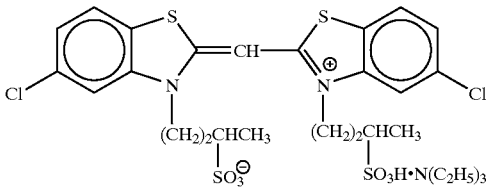

Compound I

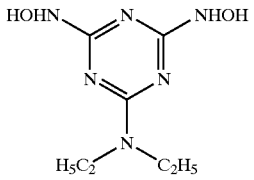

Tellurium sensitizer

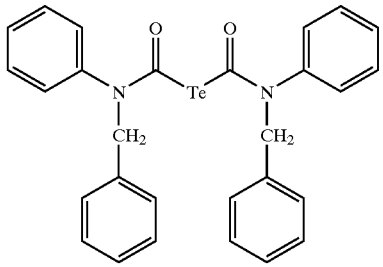

Mercapto compound

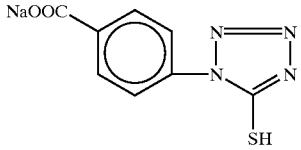

(3) Preparation of a Dispersion and a Coating Sample, and Evaluation Thereof

<Preparation Method of Zinc Hydroxide Dispersion (For 5th Layer and 12th Layer>

A zinc hydroxide dispersion to be used as a base precursor was prepared.

31 g of a powder of zinc hydroxide, whose primary particles had a particle size of 0.2 μm, 1.6 g of carboxymethyl cellulose and 0.4 g of sodium polyacrylate as dispersants, 8.5 g of lime-processed ossein gelatin, and 158.5 ml of water were mixed. The resultant mixture was dispersed for one hour by a mill using glass beads. After dispersion, the glass beads were separated by filtration, to obtain a zinc hydroxide dispersion in an amount of 188 g.

<Preparation Method of Emulsified Dispersion of Developing agent and Coupler>

(1) Emulsified Dispersion of Developing Agent and Yellow Coupler 10 g of the yellow coupler YC-1, 8.2 g of the developing agent (1), 1.6 g of the developing agent (2), 21 g of a high-boiling organic solvent (1), and 50.0 ml of ethyl acetate were dissolved at 60° C. (solution II). The solution II was mixed with 170 g of an aqueous solution (solution I) in which 12 g of a lime-processed gelatin and 1 g of the surfactant (1) were dissolved. The resultant mixture was emulsified and dispersed using a dissolver stirrer at 10,000 rpm over 20 minutes. After dispersion, distilled water was added thereto such that the total amount became 300 g, followed by mixing at 2,000 rpm for 10 minutes.

YC - (1)

Yellow coupler

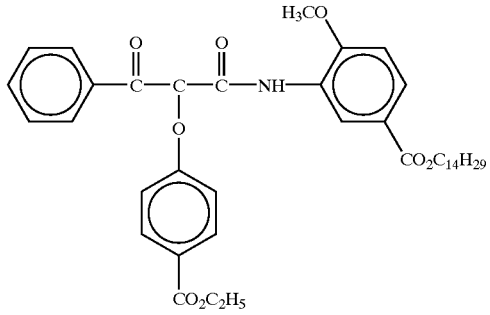

Color-developing agent - (1)

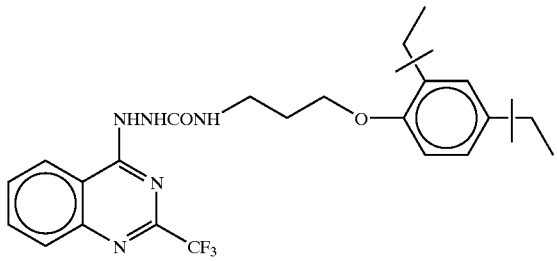

Color-developing agent - (2)

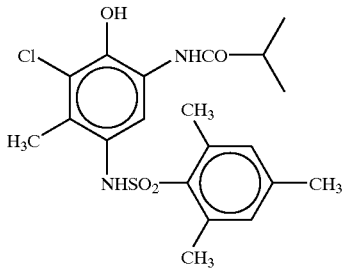

High-boiling organic solvent (1)

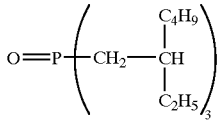

Surface-active agent (1)

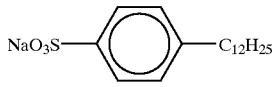

(2) Emulsified Dispersion of Developing Agent and Magenta Coupler 7.5 g of each of the magenta couplers MC-1 and MC-2, 8.2 g of the developing agent (3), 1.05 g of the developing agent (2), 11 g of a high-boiling organic solvent (1), and 24.0 ml of ethyl acetate were dissolved at 60° C. (solution II). The solution II was mixed with 170 g of an aqueous solution (solution I) in which 12 g of a lime-processed gelatin and 1 g of the surfactant (1) were dissolved. The resultant mixture was emulsified and dispersed using a dissolver stirrer at 10,000 rpm over 20 minutes. After dispersion, distilled water was added thereto such that the total amount became 300 g, followed by mixing at 2,000 rpm for 10 minutes.

MC-(1)

Magenta coupler

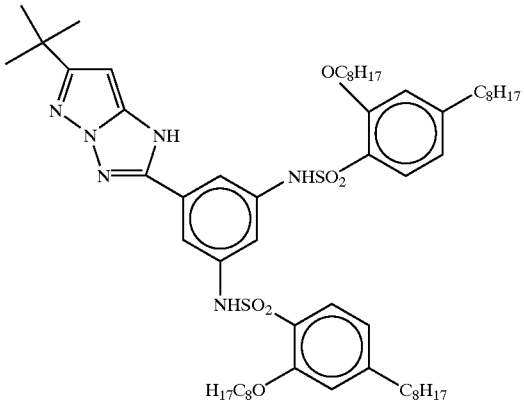

MC-(2)

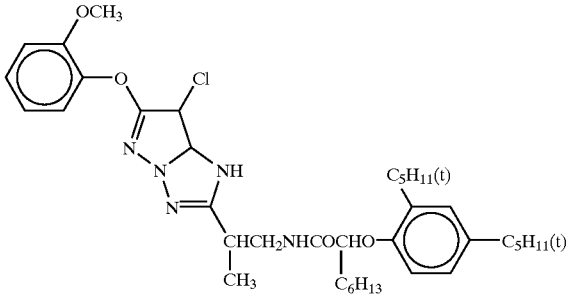

Color-developing agent (3)

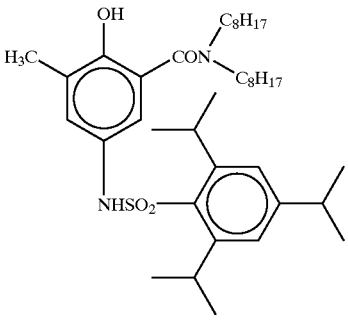

(3) Emulsified Dispersion of Developing Agent and Cyan Coupler 10.7 g of a cyan coupler CC-1, 8.2 g of the developing agent (3), 1.05 g of the developing agent (2), 11 g of a high-boiling organic solvent (1), and 24.0 ml of ethyl acetate were dissolved at 60° C. (solution II). The solution II was mixed with 170 g of an aqueous solution (solution I) in which 12 g of a lime-processed gelatin and 1 g of the surfactant (1) were dissolved. The resultant mixture was emulsified and dispersed using a dissolver stirrer at 10,000 rpm over 20 minutes. After dispersion, distilled water was added thereto such that the total amount became 300 g, followed by mixing at 2,000 rpm for 10 minutes.

CC-(1)

Cyan coupler

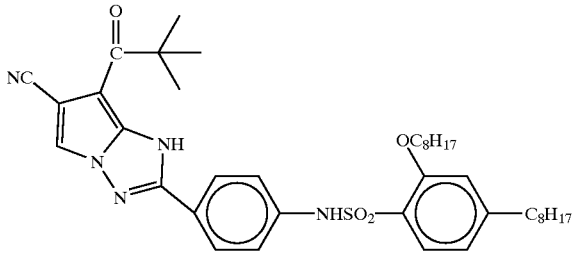

<Preparation method of Dye Dispersion for Yellow Filter Layer, Magenta Filter Layer and Antihalation Layer>

(1) Dye Dispersion for Yellow Filter Layer 14 g of YF-1 and 13 g of the high-boiling organic solvent (2) were weighed and mixed, to which was added ethyl acetate. The resultant mixture was heated to about 60° C. to dissolve the mixture, thereby forming a uniform solution. To 100 ml of the solution, were added 1.0 g of the surfactant (1), and 190 ml of a 6.6% aqueous solution of a lime-processed gelatin, which aqueous solution was heated to about 60° C. The resultant mixture was dispersed using a homogenizer for 10 minutes at 10,000 rpm.

(2) Dye Dispersion for Magenta Filter Layer 13 g of MF-1 and 13 g of the high-boiling organic solvent (2) were weighed and mixed, to which was added ethyl acetate. The resultant mixture was heated to about 60° C. to dissolve the mixture, thereby forming a uniform solution. To 100 ml of the solution, were added 1.0 g of the surfactant (1), and 190 ml of a 6.6% aqueous solution of a lime-processed gelatin, which aqueous solution was heated to about 60° C. The resultant mixture was dispersed using a homogenizer for 10 minutes at 10,000 rpm.

(3) Dye Dispersion for Antihalation Layer 20 g of CF-1 and 15 g of the high-boiling organic solvent (1) were weighed and mixed, to which was added ethyl acetate. The resultant mixture was heated to about 60° C. to dissolve the mixture, thereby forming a uniform solution. To 100 ml of the solution, were added 1.0 g of the surfactant (1), and 190 ml of a 6.6% aqueous solution of a lime-processed gelatin heated to about 60° C. The resultant mixture was dispersed using a homogenizer for 10 minutes at 10,000 rpm.

YF-1

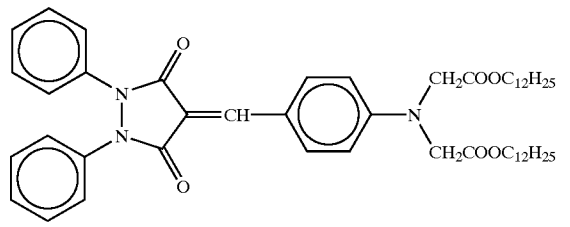

-continued

MF-1

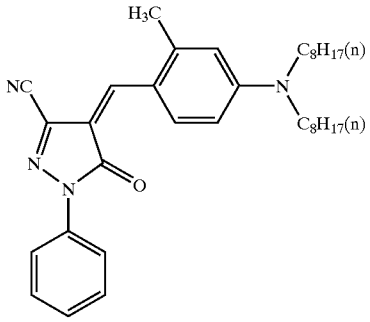

CF-1

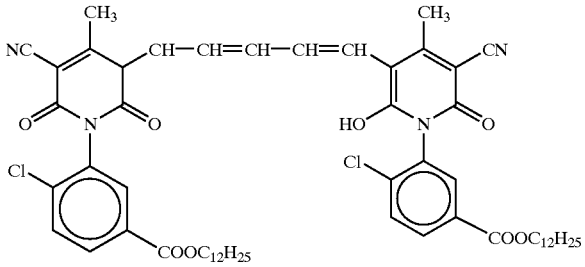

-continued

High-boiling organic solvent (2)

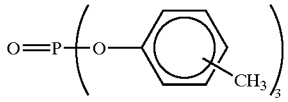

Any of these dispersions and the silver halide emulsion prepared previously were combined to form coating solutions for each layer, which were then applied to a support to constitute the structure as shown in Table 1, thereby producing a photographic light-sensitive material having a color multilayer structure of Sample 101. Emulsions E to H for color-forming layers other than the above layers are shown in Table 2. These emulsions were prepared according to the tabular grain-forming method described in the text of the present specification, with adjusting the grain size and the aspect ratio. Spectral sensitization and chemical sensitization were carried out in the same manner as in the working examples in the present specification.

The samples produced in this manner were cut out, after they were stored in the condition of a temperature of 25° C. and a relative humidity of 65% for 7 days.

TABLE 1

Light-sensitive material 101

| Layer structure | Added material | Amount to be added ($mg/m^2$) |
|---|---|---|
| Protective layer | Lime-processed gelatin | 904 |
| Thirteenth layer | Matt agent (Silica) | 38 |
| | Surfactant (5) | 30 |
| | Surfactant (3) | 25 |
| | Water-soluble polymer (1) | 20 |
| | Hardener (1) | 104 |
| Interlayer | Lime-processed gelatin | 760 |
| Twelfth layer | Surfactant (3) | 10 |
| | Zinc hydroxide | 341 |
| | Water-soluble polymer (1) | 30 |
| Yellow color-forming layer (high-sensitivity layer) | Lime-processed gelatin | 560 |
| | Emulsion Ab (Sensitizing dye was VII) | 750 (in terms of silver) |
| Eleventh layer | Antifoggant (1) | *0.40 (Emulsion Ab) |
| | Yellow coupler YC-(1) | 228 |
| | Developing agent (1) | 185 |
| | Developing agent (2) | 38 |
| | Surfactant (1) | 26 |
| | High-boiling organic solvent(1) | 156 |
| | Water-soluble polymer (1) | 15 |
| Yellow color-forming layer (low-sensitivity layer) | Lime-processed gelatin | 1725 |
| | Emulsion G (Sensitizing dye was VII) | 370 |
| Tenth layer | Emulsion H (Sensitizing dye was VII) | 230 (in terms of silver) |
| | Antifoggant (1) | 3.92 |
| | Yellow coupler YC-(1) | 357 |
| | Developing agent (1) | 290 |
| | Developing agent (2) | 59 |
| | Surfactant (1) | 42 |
| | High-boiling organic solvent(1) | 476 |
| | Water-soluble polymer (1) | 43 |
| Interlayer | Lime-processed gelatin | 1000 |
| Yellow filter | Yellow dye YF-1 | 140 |
| Ninth layer | High-boiling organic solvent (2) | 130 |
| | Surfactant (1) | 15 |
| | Water-soluble polymer (1) | 17 |

TABLE 1-continued

Light-sensitive material 101

| Layer structure | Added material | Amount to be added ($mg/m^2$) |
|---|---|---|
| Magenta color-forming layer (high-sensitivity layer) | Lime-processed gelatin | 496 |
| | Emulsion Ag (Sensitizing dyes were IV, V, VI) | 1082 (in terms of silver) |
| | Antifoggant (1) | *0.47 (Emulsion Ag) |
| Eighth layer | Magenta coupler MC-(1) | 62 |
| | Magenta coupler MC-(2) | 8 |
| | Developing agent (3) | 68 |
| | Developing agent (2) | 8.7 |
| | Surfactant (1) | 6.5 |
| | High-boiling organic solvent (1) | 78 |
| | Water-soluble polymer (1) | 28 |
| Magenta color-forming layer (medium-sensitivity layer) | Lime-processed gelatin | 551 |
| | Emulsion E (Sensitizing dyes were IV, V, VI) | 346 (in terms of silver) |
| | Antifoggant (1) | 1.54 |
| Seventh layer | Magenta coupler MC-(1) | 100 |
| | Magenta coupler MC-(2) | 15 |
| | Developing agent (3) | 109 |
| | Developing agent (2) | 14 |
| | Surfactant (1) | 33 |
| | High-boiling organic solvent (1) | 101 |
| | Water-soluble polymer (1) | 23 |
| Magenta color-forming layer (low-sensitivity layer) | Water-soluble polymer (1) | 665 |
| | Emulsion F (Sensitizing dyes were IV, V, VI) | 300 (in terms of silver) |
| | Antifoggant (1) | 1.27 |
| Sixth layer | Magenta coupler MC-(1) | 274 |
| | Magenta coupler MC-(2) | 36.5 |
| | Developing agent (3) | 300 |
| | Developing agent (2) | 38.5 |
| | Surfactant (1) | 33 |
| | High-boiling organic solvent (1) | 272 |
| | Water-soluble polymer (1) | 26 |
| Interlayer | Lime-processed gelatin | 871 |
| Magenta filter | Magenta dye MF-1 | 150 |
| Fifth layer | High-boiling organic solvent (2) | 25 |
| | Zinc hydroxide | 2030 |
| | Surfactant (1) | 115 |
| | Water-soluble polymer (1) | 44 |
| Cyan color-forming layer (high-sensitivity layer) | Lime-processed gelatin | 1000 |
| | Emulsion Ar (Sensitive dyes were I, II, III) | 1490 (in terms of Ag) |
| | Antifoggant (1) | *0.22 (Emulsion Ar) |
| Forth layer | Cyan coupler CC-1 | 189 |
| | Developing agent (3) | 145 |
| | Developing agent (2) | 18.5 |
| | Surfactant (1) | 15 |
| | High-boiling organic solvent (1) | 26 |
| | Water-soluble polymer (1) | 16 |
| Cyan color-forming layer (medium-sensitivity layer) | Lime-processed gelatin | 292 |
| | Emulsion E (Sensitive dyes were I, II, III) | 391 (in terms of Ag) |
| | Antifoggant (1) | 2.04 |
| Third layer | Cyan coupler CC-1 | 90 |
| | Developing agent (3) | 69 |
| | Developing agent (2) | 8.8 |
| | Surfactant (1) | 7 |
| | High-boiling organic solvent (1) | 104 |
| | Water-soluble polymer (1) | 18 |
| Cyan color-forming layer (low-sensitivity layer) | Lime-processed gelatin | 730 |
| | Emulsion F (Sensitive dyes were I, II, III) | 321 (in terms of Ag) |
| | Antifoggant (1) | 3.34 |
| Second layer | Cyan coupler CC-1 | 232 |
| | Developing agent (1) | 178 |
| | Developing agent (2) | 23 |
| | Surfactant (1) | 17 |
| | High-boiling organic solvent (1) | 173 |
| | Water-soluble polymer (1) | 32 |
| Interlayer | Lime-processed gelatin | 429 |
| Antihalation | Cyan dye CF-1 | 132 |
| First layer | High-boiling organic solvent (2) | 212 |
| | Surfactant (1) | 17 |
| | Water-soluble polymer (1) | 24 |

TABLE 1-continued

| Light-sensitive material 101 | | |
|---|---|---|
| Layer structure | Added material | Amount to be added ($mg/m^2$) |
| Transparent PET base (120 μm), both sides of which were each coated with a gelatin subbing | | |
| Antistatic layer | Lime-processed gelatin (M.W. 12000) | 60 |
| | Fine grains of a composite of tin oxide-antimony oxide having an average grain diameter of 0.005 μm (secondary-aggregated particles' diameter of about 0.08 μm at the specific resistance of 5 $\Omega \cdot cm^2$) | 180 |
| | Polyethylene-p-nonylphenol (polymerization degree:10) | 5 |
| Backing coat second layer | Lime-processed gelatin (M.W. 12000) | 2000 |
| | Surfactant (3) | 11 |
| | PMMA latex (diameter; 6 μm) | 9 |
| | Hardener (2) | 455 |
| Backing coat third layer | Methyl methacrylate/styrene/2-ethlhexyl acrylate/methacrylic acid copolymer | 1000 |
| | Surfactant (3) | 1.5 |
| | Surfactant (4) | 20 |
| | Surfactant (5) | 2.5 |

*The amount of antifogging agent (1) was changed proportionally to surface area of the emulsion grain.

TABLE 2

| | Average AgI content (mol %) | Average grain diameter (sphere-equivalent (μm) | Deviation coefficient of grain diameter (%) | Ratio of diameter/thickness | Ratio of silver amounts [core/intermediate/shell] (the values in parenthesis are AgI content in the corresponding portion) | Grain structure/shape |
|---|---|---|---|---|---|---|
| Emulsion E | 5.4 | 0.65 | 20 | 5.4 | 14/65/31 (0/2/13) | Triple structure tabular grains |
| Emulsion F | 3.7 | 0.49 | 15 | 3.2 | 7/32/61 (5/0/5) | Triple structure tabular grains |
| Emulsion G | 7.2 | 0.50 | 22 | 4.3 | 17/37/46 (1/7/10) | Triple structure tabular grains |
| Emulsion H | 3.7 | 0.43 | 16 | 4.6 | 5/54/41 (0/0/9) | Triple structure tabular grains |

Surface-active agent (2)

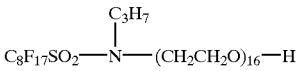

Surface-active agent (3)

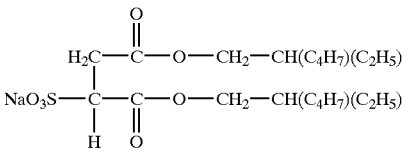

Surface-active agent (4)

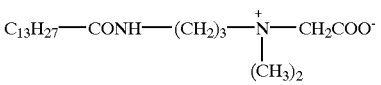

Surface-active agent (5)

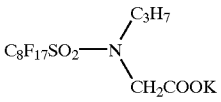

-continued

Water-soluble polymer (1)

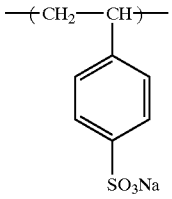

Hardener (1)

Hardener (2)

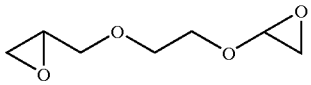

-continued

Antifoggant (1)

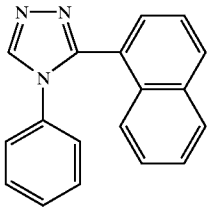

<Preparation of the Emulsion of an Organosilver Salt of a Nitrogen-containing Heterocycle (Silver HAG-37)>

28 g of gelatin and 13.2 g of the compound HAG-37 were dissolved in 300 ml of water. This solution was kept at 40° C. and stirred. To this solution was added a solution, which was prepared by dissolving 17 g of silver nitrate in 100 ml of water, over a period of 2 minutes. The pH of the resultant silver HAG-37 emulsion was adjusted, to form a precipitate, and excess salt was removed. After that, the pH was adjusted to 6.30, and 400 g of the emulsion of silver HAG-37 was obtained.

Emulsions of organosilver salts were prepared in the same manner as above, except that the compound HAG-37 was replaced with the same molar amount of the compounds, respectively, according to Table 3.

Light-sensitive material samples 102 to 110 were prepared in the same manner as in the sample 101, except that the 8th layer was incorporated with the above-prepared emulsions of organosilver salts of a nitrogen-containing heterocycle, respectively, as shown in Table 3.

TABLE 3

| Name of samples | Remarks | Emulsion of organosilver salt used in the 8th layer | Sensitivity | Maximum density |
|---|---|---|---|---|
| 101 | Comparative example | None | 100 | 1.20 |
| 102 | Present invention | HAG-37 | 120 | 1.50 |
| 103 | Present invention | HAG-41 | 110 | 2.00 |
| 104 | Present invention | HAG-1 | 125 | 1.85 |
| 105 | Present invention | HAG-6 | 130 | 1.75 |
| 106 | Present invention | HAG-27 | 145 | 1.65 |
| 107 | Present invention | HAG-31 | 185 | 1.85 |
| 108 | Present invention | HAG-45 | 165 | 1.90 |
| 109 | Present invention | HAG-60 | 155 | 1.80 |
| 110 | Present invention | HAG-65 | 145 | 1.35 |

Then, processing materials P-1 and P-2, as shown in Tables 4 and 5, were produced.

TABLE 4

Processing Material P-1

| Layer structure | Added material | Amount to be added (mg/m$^2$) |
|---|---|---|
| Fourth layer Protective layer | Lime-processed gelatin | 220 |
| | Water-soluble polymer (2) | 60 |

TABLE 4-continued

Processing Material P-1

| Layer structure | Added material | Amount to be added (mg/m$^2$) |
|---|---|---|
| | Water-soluble polymer (3) | 200 |
| | Potassium nitrate | 12 |
| | PMMA latex (diameter: 6 μm) | 10 |
| | Surfactant (3) | 7 |
| | Surfactant (4) | 7 |
| | Surfactant (5) | 10 |
| Third layer Interlayer | Lime-processed gelatin | 240 |
| | Water-soluble polymer (2) | 24 |
| | Hardener (2) | 180 |
| | Surfactant (3) | 9 |
| Second layer Base-producing layer | Lime-processed gelatin | 2400 |
| | Water-soluble polymer (3) | 360 |
| | Water-soluble polymer (4) | 700 |
| | Water-soluble polymer (5) | 1000 |
| | Guanidine picolinate | 2910 |
| | Potassium quinolinate | 225 |
| | Sodium quinolinate | 180 |
| | Surfactant (3) | 24 |
| First layer Interlayer | Lime-processed gelatin | 280 |
| | Water-soluble polymer (2) | 12 |
| Subbig layer | Surfactant (3) | 14 |
| | Hardener (2) | 185 |
| | Transparent base A (43 μm) | |

Constitution of Base A

| Name of layer | Composition | Amount to be added (mg/m$^2$) |
|---|---|---|
| Subbing layer of surface | Lime-processed gelatin | 100 |
| Polymer layer | Polyethylene terephthalate | 62500 |
| Subbing layer of back surface | Polymer (Methyl methacrylate/styrene/2-ethylhexyl acrylate/methacrylic acid copolymer) | 1000 |
| | PMMA latex | 120 |

TABLE 5

Processing Material P-2

| Layer structure | Added material | Amount to be added (mg/m$^2$) |
|---|---|---|
| Fourth layer Protective layer | Lime-processed gelatin | 220 |
| | Water-soluble polymer (2) | 60 |
| | Water-soluble polymer (3) | 200 |
| | Potassium nitrate | 12 |
| | PMMA latex (diameter:6 μm) | 10 |
| | Surfactant (3) | 7 |
| | Surfactant (4) | 7 |
| | Surfactant (5) | 10 |
| Third layer Interlayer | Lime-processed gelatin | 240 |
| | Water-soluble polymer (2) | 24 |
| | Hardener (2) | 180 |
| | Surfactant (3) | 9 |
| Second layer Fixing agent layer | Lime-processed gelatin | 2400 |
| | Silver halide solvent (1) | 5500 |
| | Water-soluble polymer (5) | 2000 |
| | Surfactant (3) | 24 |
| First layer interlayer Subbing layer | Lime-processed gelatin | 280 |
| | Water-soluble polymer (2) | 12 |
| | Surfactant (3) | 14 |
| | Hardener (2) | 185 |
| Transparent base A (43 μm) (base same as to P-1) | | |

Water-soluble polymer (2)

κ(kappa)-Carrageenan

Water-soluble Polymer (3)

Sumikagel L-5H (trade name: manufactured by Sumitomo Kagaku Co.)

Water-soluble polymer (4)

Dextran (molecular weight 70,000)

Water-soluble polymer (5)

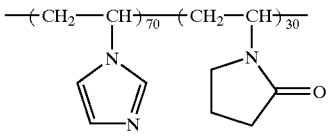

Silver halide solvent (1)

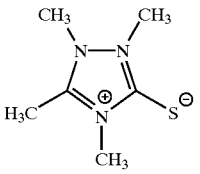

<Evaluation>

These light-sensitive materials were subjected to exposure to light at an intensity of 1,000 lux for 1/100 seconds through an optical wedge and a green filter.

15 ml/m$^2$ of 40° C. hot water was supplied to the surface of the exposed light-sensitive material. The film surfaces of each of the light-sensitive material and the processing material P-1 were overlapped on each other, and thereafter, heat developed at 83° C. for 15 seconds by using a heat drum. The amount of damping water at this time was within the range as described in the above, and it corresponded to about 30% of the sum of the saturated water swelling amount. The light-sensitive material was peeled off after it was processed, to obtain a magenta color-developed wedge form image.

Processing of a second step was carried out on this sample by using the processing material P-2. In the processing of the second step, 10 ml/m$^2$ of water was applied to the processing material P-2, then the processing material was overlapped with the light-sensitive material after the first processing, and heated at 60° C. for 30 seconds.

The transmission density of the resulted color-formed sample was measured, to obtain the so-called characteristic curve. The reciprocal of an exposure amount giving a density higher than the fogging density by 0.15, was defined as a relative sensitivity, and the sensitivity determined was expressed as a relative value by assuming the sensitivity of sample 101 to be 100. Further, maximum densities of the samples were measured.

These results are also shown in the above-described Table 3.

As can be seen from Table 3, the light-sensitive materials of the present invention each have a quite high sensitivity and can form an image having a quite high maximum density.

Example 2

Samples were prepared in the same manner as in Example 1, except that the support was changed to a support prepared by the following preparation method. These samples were subjected to the same tests as in Example 1, and the similar excellent results were obtained, whereby the effects of the present invention were confirmed.

1) Support

The support used in this example was prepared by the following method.

100 parts by weight of polyethylene-2,6-naphthalate polymer, and 2 parts by weight of Tinuvin P.326 (trade name, manufactured by Ciba-Geigy Co.) as a ultraviolet absorber, were dried and then melted at 300° C. The melted mixture was extruded from a T-die and stretched 3.3 times in a lengthwise direction at 140° C., and 3.3 times in a width direction at 130° C. The resulting product was thermally fixed at 250° C. for 6 seconds, to obtain a PEN film with a thickness of 90 μm. To this PEN film were added a blue dye, a magenta dye, and a yellow dye (I-1, I-4, I-6, I-24, I-26, I-27 and II-5 described in Kokai Giho: Kogi No. 94-6023) in appropriate amounts. Moreover, the PEN film was wound around a stainless core (spool) having a diameter of 20 cm, and thermal history was imparted thereto at 110° C. over 48 hours, to obtain a support having suppressed curl tendency.

2) Coating of an Undercoat Layer

The both surfaces of the above support were subjected to corona discharge treatment, UV discharge treatment, and glow discharge treatment. Thereafter, one surface of the support was coated with an undercoat solution having a composition of 0.1 g/m$^2$ of gelatin, 0.01 g/m$^2$ of sodium α-sulfo-di-2-ethylhexylsuccinate, 0.04 g/m$^2$ of salicylic acid, 0.2 g/m of p-chlorophenol, 0.012 g/m$^2$ of $(CH_2{=}CHSO_2CH_2CH_2NHCO)_2CH_2$, and 0.02 g/m$^2$ of polyamide/epichlorohydrin polycondensation product (the weight of each component in the undercoat layer was presented in terms per unit area) (10 ml/m$^2$, a bar coater was used). As a result, the undercoat layer was provided on the side that was heated at a higher temperature at the time of stretching. Drying was carried out at 115° C. for 6 minutes (the roller and the transportation apparatus in the drying zone all were set at 115° C.).

3) Coating of a Backing Layer

An antistatic layer, a transparent magnetic recording layer, and a slipping (sliding) layer, each having the compositions mentioned below, were coated, as a backing layer, on the other surface side of the above support opposite to the side coated with the undercoat layer.

3-1) Coating of an Antistatic Layer 0.2 g/m$^2$ of a dispersion of fine grain powder of a composite of tin oxide/antimony oxide having an average grain diameter of 0.005 μm and the specific resistance of 5 Ω·cm (secondary aggregation grain diameter of about 0.08 μm), 0.05 g/m$^2$ of gelatin, 0.02 g/m$^2$ of $(CH_2{=}CHSO_2CH_2CH_2NHCO)_2CH_2$, and 0.005 g/m$^2$ of poly(polymerization degree: 10)oxyethylene-p-nonylphenol were coated (herein the weight of each component in the antistatic layer was in terms per unit area).

3-2) Coating of a Transparent Magnetic Recording Layer

3-Poly(polymerization degree: 15)oxyethylene-propyloxytrimethoxysilan (15 weight%)-coated Co-γ-iron oxide (specific surface area, 43 m$^2$/g; major axis, 0.14 μm; minor axis, 0.03 μm; saturation magnetization, 89 emu/g, $Fe^{2+}/Fe^{3+}$=6/94; the surface was treated with 2 weight % respectively, based on iron oxide, of aluminum oxide and silicon oxide) (0.06 g/m$^2$), diacetylcellulose (dispersion of the iron oxide was carried out by an open kneader and a sand mill) (1.2 g/m$^2$), and $C_2H_5C(CH_2CONH{-}C_6H_3(CH_3)NCO)_3$ (0.3 g/m$^2$) as a hardner, were coated using acetone, methyl ethyl ketone, cyclohexanone, and dibutyl phthalate, as solvents, by means of a bar coater, to obtain a magnetic recording layer having a film thickness of 1.2 μm. The weight of each component in the magnetic recording layer was in terms per unit area. 50 mg/m$^2$ of $C_6H_{13}CH(OH)$ $C_{10}H_{20}COOC_{40}H_{81}$ as a slipping agent, aluminum oxides (0.20 μm and 1.0 μm) 50 mg/m$^2$ and 10 mg/m$^2$ respectively, as an abrasive, treated and coated with 3-poly (polymerization degree: 15)oxyethylene-propyloxytrimethoxysilan (15 weight %) and silica grains (1.0 μm) as a matt agent, were each added thereto. Drying was conducted at 115° C. for 6 min (the roller and the transportation apparatus in the drying zone all were set at 115° C.). The increment of the color density of $D_B$ of the magnetic recording layer was about 0.1 when X-light (blue filter) was used. The saturation magnetization moment of the magnetic recording layer was 4.2 emu/g, the coercive force was $7.3\times10^4$ A/m, and the squareness (ratio) was 65%.

3—3) Formation of a Sliding Layer

The sliding layer was prepared by coating each of the following components in the weight per unit area of the layer: hydroxyethyl cellulose (25 mg/m$^2$), $C_6H_{13}CH(OH)C_{10}H_{20}COOC_{40}H_{81}$ (6 mg/m$^2$), and a silicone oil BYK-310 (trade name, manufactured by BYK Chemie Japan Co., Ltd.) (1.5 mg/m$^2$). Herein, the coating solution was prepared by melting the components in xylene/propyleneglycolmonomethyl ether (1/1) at 105° C., adding the molten product to and dispersing in propyleneglycolmonomethyl ether (tenfold amount) at room temperature, and further dispersing the resultant dispersion in acetone to prepare a dispersion (average particle size: 0.01 μm). Drying was performed at 115° C. for 6 minutes (all of the rollers and conveyors in the drying zone were maintained at 115° C.). The resultant sliding layer was found to have excellent characteristics. That is, the coefficient of kinetic friction was 0.10 (stainless steel hard ball having a diameter of 5 mm; load: 100 g; speed: 6 cm/minute) and the coefficient of static friction was 0.08 (clip method). Further, the coefficient of kinetic friction between the emulsion layer surface and the sliding layer was 0.15.

Example 3

<<Preparation of an Organic Acid Silver Salt Dispersion>>

117 ml of an aqueous 1N sodium hydroxide solution was added over 55 minutes to 43.8 g of behenic acid (trade name: Edenor C22 85R) manufactured by Henkel, 730 ml of distilled water and 60 ml of tert-butanol with stirring at 79° C. These components were reacted for 240 minutes. Then, 112.5 ml of an aqueous solution containing 19.2 g of silver nitrate was added to the reaction mixture over 45 seconds. The mixture was allowed to stand for 20 minutes, and the temperature of the mixture was dropped to 30° C. After that, the solid was separated by suction filtration, and washed until the conductivity of the filtered water became 30 μS/cm. The solid obtained in this manner was not dried, but was handled as a wet cake. 7.4 g of polyvinyl alcohol (trade name: PVA205) and water were added to the wet cake, which was equivalent to 100 g of the dry solid, to make the total amount 385 g, and then the mixture was pre-dispersed using a homomixer.

Then, the pre-dispersed raw liquid was treated three times in a dispersing machine (trade name: Microfluidizer M-110S-EH, manufactured by Microfulindex International Corporation, using a G10Z interaction chamber) by adjusting the pressure to 1,750 kg/cm$^2$, to obtain a silver behenate dispersion B. Grains of silver behenate contained in the thus-obtained silver behenate dispersion were needle-shape grains having an average breadth (minor axis) of 0.04 μm, an average length (major axis) of 0.8 μm, and a coefficient of variation of 30%. The size of the grain was measured using Master Sizer X (trade name) manufactured by Malvern Instruments Ltd. In a cooling operation, a corrugated tube type heat exchanger was attached to each of the front and back sides of the interaction chamber, and the temperature of the cooling medium was controlled, to thereby set the temperature of the dispersing system to a desired temperature.

<<Preparation of a 25 wt % Dispersion of a Reducing Agent>>

With respect to each of the Compounds I-1 and D-119, a slurry was prepared respectively by adding 176 g of water to 80 g of the compounds I-1 or D-119 and 64 g of an aqueous 20% solution of modified Poval MP203 (trade name) manufactured by Kuraray Co., Ltd., and mixing them sufficiently. 800 g of zirconia beads having an average diameter of 0.5 mm was prepared and placed in a vessel together with the slurry, and the slurry was dispersed by using a dispersing machine (a ¼G sand grinder mill, manufactured by Imex Co., Ltd.) for 5 hours, to obtain a reducing agent dispersion. Particles of the reducing agent contained in the resulted reducing agent dispersion had an average particle diameter of 0.72 μm.

<<Preparation of a 20 wt % Dispersion of a Mercapto Compound))

224 g of water was added to 64 g of 3-mercapto-4-phenyl-5-heptyl-1,2,4-triazole and 32 g of an aqueous 20% solution of modified Poval MP203 (trade name) manufactured by Kuraray Co., Ltd., and these components were sufficiently mixed to form a slurry. 800 g of zirconia beads having an average diameter of 0.5 mm was prepared and placed in a vessel together with the slurry, and the slurry was dispersed by using a dispersing machine (a ¼G sand grinder mill, manufactured by Imex Co., Ltd.) for 10 hours, to obtain a mercapto compound dispersion. Particles of the mercapto compound contained in the mercapto compound dispersion obtained in this manner had an average particle diameter of 0.67 μm.

<<Preparation of a 30 wt % Dispersion of an Organic Polyhalogen Compound>>

224 g of water was added to 116 q of an organic polyhalogen compound P-2 and 48 g of an aqueous 20 wt % solution of modified Poval MP203 (trade name) manufactured by Kuraray Co., Ltd., and these components were sufficiently mixed to form a slurry. 800 g of zircionia beads having an average diameter of 0.5 mm was prepared and placed in a vessel together with the slurry, and the slurry was dispersed by using a dispersing machine (a ¼G sand grinder mill, manufactured by Imex Co., Ltd.) for 5 hours, to obtain an organic polyhalogen compound dispersion. Particles of the polyhalogen compound contained in the thus-obtained polyhalogen compound dispersion had an average particle diameter of 0.74 μm.

<<Preparation of a 22 wt % Dispersion of the Compound G>>

16 kg of water was added to 10 kg of the compound G and 10 kg of an aqueous 20 wt % solution of modified polyvinyl alcohol (Poval MP203 (trade name), manufactured by Kuraray Co., Ltd.), and these components were sufficiently mixed to form a slurry. This slurry was fed using a diaphragm pump and dispersed for 3 hours and 30 minutes by using a horizontal sand mill (UVM-2 (trade name), manufactured by Imex Co., Ltd.) filled with zirconia beads having an average diameter of 0.5 mm. Then, to the resultant dispersion, were added 0.2 g of benzoisothiazolinone sodium salt and water such that the concentration of the compound G became 22 wt %, to obtain a dispersion. Particles of the compound G contained in the dispersion obtained in this manner had a median diameter of 0.55 μm, and a maximum particle diameter of 2.0 μm or less. The resulted dispersion was filtered using a polypropylene filter with a hole diameter of 10.0 μm to remove foreign materials such as dusts, and then stored in a container.

<<Preparation of a 20 wt % Dispersion of a Coupler Compound>>

16 kg of water was added to 10 kg of the coupler compound A-409 and 10 kg of an aqueous 20 wt % solution of modified polyvinyl alcohol (Poval MP203 (trade name), manufactured by Kuraray co., Ltd.), and these components were sufficiently mixed to form a slurry. This slurry was fed using a diaphragm pump and dispersed for 3 hours and 30 minutes by using a horizontal sand mill (UVM-2 (trade name), manufactured by Imex Co., Ltd.) filled with zirconia beads having an average diameter of 0.5 mm. To the resultant dispersion were added 0.2 g of benzoisothiazolinone sodium salt and water such that the concentration of the coupler compound became 22 wt %, to obtain a dispersion. Particles of-the coupler compound contained in the dispersion obtained in this manner had a median diameter of 0.55 μm, and a maximum particle diameter of 2.0 μm or less. The resulted dispersion was filtered using a polypropylene filter with a hole diameter of 10.0 μm, to remove foreign materials such as dusts, and then stored in a container.

<<Preparation of a Methanol Solution of a Phthalazine Compound>>

26 g of 6-isopropylphthalazine was dissolved in 100 ml of methanol and used.

<<Preparation of a 20 wt % Dispersion of a Pigment>>

250 g of water was added to 64 g of C.I. Pigment Blue 60 (Indanthrene) and 6.4 g of Demol N (trade name) manufactured by Kao Corp., and these components were sufficiently mixed to form a slurry. 800 g of zirconia beads having an average diameter of 0.5 mm was prepared and placed in a vessel together with the slurry, the slurry was dispersed by using a dispersing machine (a ¼G sand grinder mill, manufactured by Imex Co., Ltd.) for 25 hours, to obtain a pigment dispersion. Particles of the pigment contained in the thus-obtained pigment dispersion had an average particle diameter of 0.21 μm.

<<Preparation of a Coating Solution for an Emulsion Layer>>

(Coating Solution for an Emulsion Layer)

To 103 g of the organic acid silver salt dispersion obtained above and 5 g of an aqueous 20 wt % solution of polyvinyl alcohol PVA 205 (trade name, manufactured by Kuraray Co., Ltd.), which were mixed and kept at 40° C., were added the coupler compound dispersion amounting to $1\times10^{-2}$ mol per 1 mol of silver, 23.2 g of the above 25 wt % dispersion of a reducing agent using I-1, the dispersion using D-119 amounting to 0.5 equivalent mol to the reducing agent using I-1, 20.3 g of the dispersion of the compound G, 4.8 g of a 5 wt % water dispersion of a pigment C.I. Pigment Blue 60, 10.7 g of the 30 wt % dispersion of an organic polyhalide, and 3.1 g of the 20 wt % dispersion of a mercapto compound. Then, 106 g of 40 wt % UF-purified SBR latex kept at 40° C. was added to the mixture, and then the mixture was sufficiently stirred. Thereafter, 6 ml of the methanol solution of a phthalazine compound was added to the resulting mixture, to obtain an organic acid silver salt-containing solution. Further, 10 g of a silver halide emulsion Ar that was same as described in Example 1 was mixed with the organic acid silver salt-containing solution by using a static mixer just before coating, to prepare an emulsion layer coating solution, and the coating solution was then fed to a coating die as it was, so that the coating amount of silver became 1.4 g/m$^2$.

The viscosity of the above emulsion layer coating solution was measured using a B-type viscometer manufactured by Tokyo Keiki Co., and found to be 85 [mPa·S] at 40° C. (No. 1 rotor).

The viscosities of the coating solution measured at 25° C. by using an RFS Fluid Spectrometer manufactured by Reometrix Far East Co. were 1,500, 220, 70, 40, and 20 [mPa·S] when the shear rates were 0.1, 1, 10, 100, and 1,000 [1/sec], respectively.

In this connection, the UF-purified SBR latex was obtained in the following manner. The SBR latex described below was diluted with distilled water to 1/10, and then dilution and purification were conducted using a UF (ultrafiltration) purification module FS03 FC FUY03A1 (trade name, manufactured by Dithane Membrane System Co.) until the ionic conductivity became 1.5 mS/cm, and the thus-obtained latex was used. At this time, the concentration of the latex was 40 wt %. (SBR latex: a latex of St(68)Bu (29)AA(3)) Average particle diameter: 0.1 μm, concentration: 45 wt %, equilibrium moisture content (25° C., 60% relative humidity): 0.6 wt %, ionic conductivity: 4.2 mS/cm (ionic conductivity was measured using a Conductometer CM-30S (trade name) manufactured by Toa Denpa Kogyo Co., with a latex raw liquid (40 wt %) at 25° C.), and pH: 8.2.

<<Preparation of an Intermediate Layer Coating Solution for an Emulsion Surfaces>>

(An intermediate Layer Coating Solution)

2 ml of an aqueous 5 wt % solution of Aerosol OT (trade name, manufactured by American Cyanamide Co.), 4 g of benzyl alcohol, 1 g of 2,2,4-trimethyl-1,3-pentanediol monoisobutylate, and 10 mg of benzoisothiazolinone were added to 772 g of an aqueous 10 wt % solution of polyvinyl alcohol PVA 205 (trade name, manufactured by Kuraray Co., Ltd.) and 226 g of a 27.5 wt % solution of a methyl methacrylate/styrene/2-ethylhexyl acrylate/hydroxyethyl methacrylate/acrylic acid copolymer (copolymerization ratio by mass: 59/9/26/5/1) latex, to produce a coating solution for an intermediate layer. The coating solution was fed to a coating die such that the coating amount became 5 ml/m$^2$.

The viscosity of the coating solution, which was measured using a B-type viscometer at 40° C. (No. 1 rotor) was 21 [mPa·S].

<<Preparation of a First Protective Layer Coating Solution for an Emulsion Surface>>

(Coating Solution for a First Prospective Layer)

80 g of an inert gelatin was dissolved in water. To the solution, 138 ml of a 10 wt % methanol solution of phthalic acid, 28 ml of 1N sulfuric acid, 5 ml of an aqueous 5 wt % solution of Aerosol TO (trade name, manufactured by American Cyanamide Co.) and 1 g of phenoxy ethanol were added, and water was further added to the solution so that the total amount became 1,000 g, to form a coating solution. The coating solution was fed to a coating die such that the coating amount became 10 ml/m$^2$.

The viscosity of the coating solution, which was measured using B-type viscometer at 40° C. (No. 1 rotor) was 17 [mPa·S].

<<Preparation of a Second Protective Layer Coating Solution for an Emulsion Surface>>

(Coating Solution for a Second Protective Layer)

100 g of an inert gelatin was dissolved in water. To the solution, 20 ml of a 5% solution of potassium N-perfluorooctylsulfonyl-N-propylalanate, 16 ml of a 5 wt % solution of Aerosol TO (trade name, manufactured by American Cyanamide Co.), 25 g of a polymethyl methacrylate fine particle (average particle diameter: 4.0 μm), 44 ml of 1N sulfuric acid, and 10 mg of benzoisothiazolinone were added, and water was further added to the solution so that the total amount became 1,555 g. 445 ml of an aqueous solution containing 4 wt % of chromium alum and 0.67 wt % of phthalic acid was mixed with the above solution by using a static mixer, just before coating, to produce a coating solution for a surface protective layer. This coating solution was then fed to a coating die such that the coating amount became 10 ml/$m^2$.

The viscosity of the coating solution, which was measured using B-type viscometer at 40° C. (No. 1 rotor) was 9 [mPa·S].

<<Preparation of Coating Solutions for a Backface>>

(Preparation of a Solid Fine-particle Dispersion Liquid of a Base Precursor)

64 g of a base precursor compound, and 10 g of a surfactant Demol N (trade name) manufactured by Kao Corp. were mixed with 246 ml of distilled water, and the mixed solution was subjected to beads dispersion using a sand mill (¼ Gallon sand grinder mill, manufactured by Imex Co.), to obtain a solid fine-particle dispersion liquid of the base precursor, having an average particle diameter of 0.2 $\mu$m.

(Preparation of a Dye Solid Fine-particle Dispersion Liquid)

9.6 g of a cyanine dye compound and 5.8 g of sodium p-alkylbenzenesulfonate were mixed with 305 ml of distilled water, and the mixed solution was subjected to beads dispersion using a sand mill (¼ Gallon sand grinder mill, manufactured by Imex Co.), to obtain a dispersion liquid of solid fine-particles of the dye having an average particle diameter of 0.2 $\mu$m.

(Preparation of an Anti-halation Layer Coating Solution)

17 g of a gelatin, 9.6 g of polyacrylamide, 70 g of the above base precursor solid fine-particle dispersion liquid, 56 g of the above dye solid fine-particle dispersion liquid, 1.5 g of polymethyl methacrylate fine particle (average particle size: 6.5 $\mu$m), 2.2 g of sodium polyethylenesulfonate, 0.2 g of an aqueous 1 wt % solution of a coloring dye compound, and 844 ml of water, were mixed, to prepare an anti-halation layer coating solution.

(Preparation of a Coating Solution for a Protective Layer)

In a container kept at 40° C., 50 g of a gelatin, 0.2 g of sodium polystyrenesulfonate, 2.4 g of N,N-ethylenebis (vinylsulfonacetamide), 1 g of sodium tert-octylphenoxyethoxyethanesulfonate, 30 mg of benzoisothiazolinone, 32 mg of $C_8F_{17}SO_3K$, 64 mg of $C_8F_{17}SO_2N(C_3H_7)(CH_2CH_2O)_4(CH_2)_4SO_3Na$, and 950 ml of water were mixed, to produce a protective layer coating solution.

The compounds used in Example 3 are shown below.

(I-1)

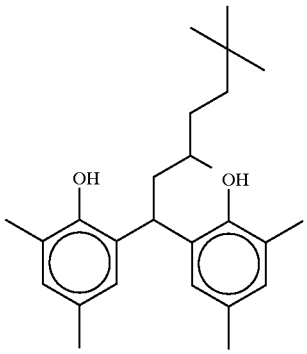

-continued (A-409)

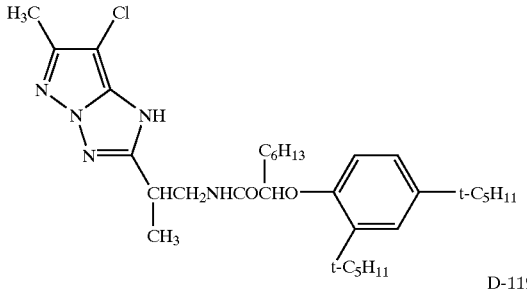

D-119

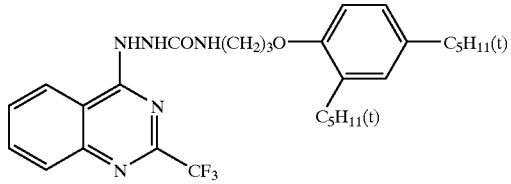

(P-2)

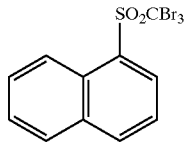

Base precursor compound

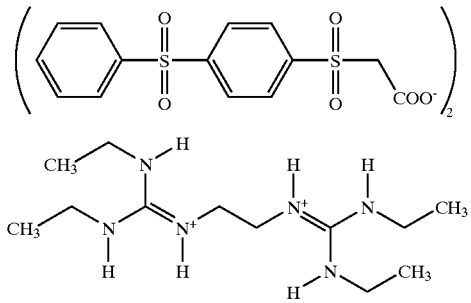

Cyanine dye compound

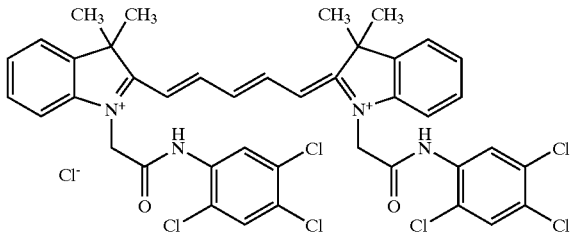

Coloring dye compound

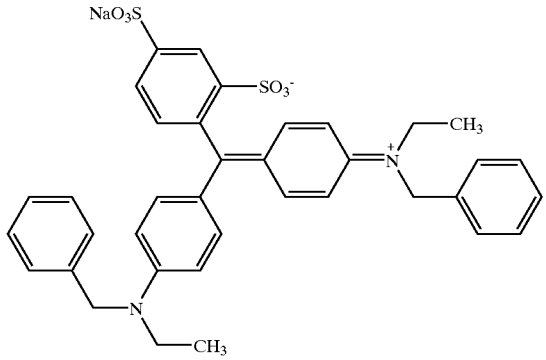

-continued

Compound G

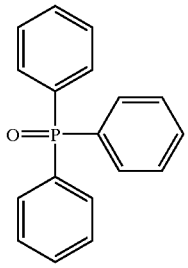

<<Preparation of a Heat-developable Light-sensitive Material>>

The anti-halation layer coating solution was coated such that the coated amount of the solid content of the solid fine-particle dye became 0.04 g/m$^2$, and the protective layer coating solution was coated such that the coated amount of the gelatin became 1 g/m$^2$, by simultaneous multilayer coating, on the support 10 manufactured in Example 2, followed by drying to form anti-halation backing layers. Then, the emulsion layer, the intermediate layer, the first layer of the protective layer, and the second layer of the protective layer, were coated in this order from the undercoat surface, on the surface opposite to the backface, by simultaneous multilayer coating using a slide bead coating system, to manufacture Sample 301 of a heat-developable light-sensitive material. Further, samples 302 to 310 of light-sensitive materials of the present invention were manufactured in the same manner as the above-described sample 301, except that a silver behenate was changed as shown in Table 6. It is to be noted that the emulsion surface was applied, without rolling the material after the backface was coated.

The coating was carried out in the condition that the speed of coating was 160 m/minute, the distance between the tip of the coating die and the support was 0.18 mm, and the pressure in the vacuum chamber was set lower than an atmospheric pressure by 392 Pa. In the successive chilling zone, air with a dry-bulb temperature of 18° C. and a wet-bulb temperature of 12° C. was blown against the coating solution, for 30 seconds, at an average air velocity of 7 m/sec, to cool the coating solution. Then, dry air with a dry-bulb temperature of 30° C. and a wet-bulb temperature of 18° C. was blown from a hole against the coating solutions in a drying zone of a helical type floatation system, for 200 seconds, at an air velocity of 20 m/sec, to vaporize the solvents contained in the coating solutions.

Each light-sensitive material sample was evaluated as follows. The results are shown in Table 6.

(Evaluation of Photographic Performance)

The light-sensitive material was exposed to light at an oblique angle of 30 degrees with the normal line, by using a 647-nm Kr laser sensitometer (maximum output: 500 mW). Then the light-sensitive material was processed (developed) at 120° C. for 15 seconds, and the resulted image was evaluated using a densitometer. As to the sensitivity, the sensitivity of the heat-developable light-sensitive material 301, as shown in Table 6, was assumed to be 100.

TABLE 6

| Name of samples | Remarks | Emulsion of organosilver salt used | Sensitivity | Maximum density |
|---|---|---|---|---|
| 301 | Comparative example | Silver behenate | 100 | 0.50 |
| 302 | Present invention | HAG-37 | 135 | 0.70 |
| 303 | Present invention | HAG-41 | 130 | 0.95 |
| 304 | Present invention | HAG-1 | 145 | 1.10 |
| 305 | Present invention | HAG-6 | 165 | 0.85 |
| 306 | Present invention | HAG-27 | 170 | 1.05 |
| 307 | Present invention | HAG-31 | 200 | 0.80 |
| 308 | Present invention | HAG-45 | 185 | 0.95 |
| 309 | Present invention | HAG-60 | 185 | 0.90 |
| 310 | Present invention | HAG-65 | 175 | 1.05 |

As is understood from Table 6, the light-sensitive material of the present invention has quite high sensitivity, and gives an image having quite high maximum density. Further, the light-sensitive material of the present invention can form an image excellent in grainiess.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material, comprising a support provided thereon a photographic constitutional layer including at least one photographic light-sensitive layer that comprises a light-sensitive silver halite, an organosilver salt having a nitrogen-containing heterocycle, a compound capable of forming a dye by a coupling reaction with an oxidized product of a developing agent, and a binder, wherein the photographic light-sensitive layer contains:

(A) as the light-sensitive silver halide, a silver halide emulsion composed of tabular silver halide grains having a main face made up of a (111) plane, an average diameter of a circle whose area is equivalent to a projected area of an individual grain of at least 0.70 $\mu$m, and an average thickness of less than 0.20 $\mu$m;

(B) as the organosilver salt, a compound in which a hydrogen on a 5- or 6-membered nitrogen-containing heterocycle having at least one —NH— group is replaced with Ag;

and wherein the tabular silver halide grains contained in the silver halide emulsion contain a bromide in an amount exceeding 70 mole % and an iodide in an amount from 0.30 to 10 mole % to the silver.

2. A silver halide color photographic light-sensitive material according to claim 1, wherein the organosilver salt having a nitrogen-containing heterocycle is an silver salt of a benzotriazole compound having at a 5-position thereof an alkyl group having 1 to 12 carbon atoms.

3. A silver halide color photographic light-sensitive material according to claim 1, wherein the silver halide emulsion is being chemically sensitized by a tellurium sensitizer.

4. A silver halide color photographic light-sensitive material according to claim 1, wherein the light-sensitive material contains a developing agent.

5. A silver halide color photographic light-sensitive material according to claim 1, wherein the light-sensitive material is heat-developable at 75° C. or above.

6. A silver halide color photographic light-sensitive material according to claim 1, wherein the nitrogen-gocontaining heterocycle of the organosilver salt is formed from pyrazole, imidazole, 1,2,3-triazole, 1,2,4-triazole, tetrazole, succinimide, phthalimide, glutarimide, 1,3-oxazolidine-2,4-dione, or hydantoin, each of which may be condensed with a benzene ring or a 5- to 7-membered aromatic heterocycle.

7. A silver halide color photographic light-sensitive material according to claim 1, wherein in the silver halide emulsion, the tabular silver halide grains occupy 50 to 100% of the total projected area of all the silver halide grains.

8. A silver halide color photographic light-sensitive material according to claim 1, wherein the average thickness of the tabular grain is 0.01 to 0.20 $\mu$m.

9. A silver halide color photographic light-sensitive material according to claim 1, wherein the average diameter of a circle whose area is equivalent to a projected area of an individual grain of the tabular grain is 0.7 to 5 $\mu$m.

10. A silver halide color photographic light-sensitive material according to claim 1, wherein in the silver halide emulsion, the average aspect ratio of all the tabular grains is 3.5 to 100.

11. A silver halide color photographic light-sensitive material according to claim 1, wherein the light-sensitive material contains a developing agent represented by the following formula IV, V, VI or VII:

formula IV

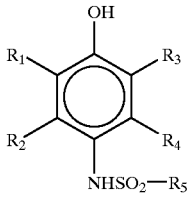

formula V

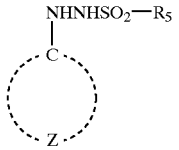

formula VI

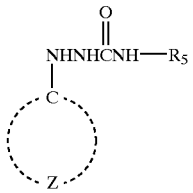

-continued formula VII

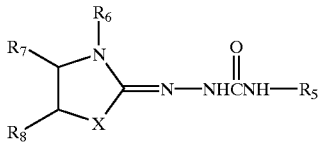

wherein, in the formulas IV, V, VI and VII, $R_1$, $R_2$, $R_3$, and $R_4$ each represent a hydrogen atom, a halogen atom, an alkyl group, an aryl group, an alkylcarbonamido group, an arylcarbonamido group , an alkylsulfonamido group, an arylsulfonamido group, an alkoxy group, an aryloxy, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group;

$R_5$ represents an alkyl group, an aryl group, or a heterocyclic group;

Z represents a group of atoms forming, together with the C, an aromatic ring;

$R_6$ represents an alkyl group;

X represents an oxygen atom, a sulfur atom, a selenium atom, or an alkyl- or aryl-substituted tertiary nitrogen atom; and $R_7$ and $R_8$ each represent a hydrogen atom or a substituent, or $R_7$ and $R_8$ bond together to form a double bond or a ring.

12. A silver halide color photographic light-sensitive material according to claim 11, wherein the compound capable of forming a dye by a coupling reaction with an oxidized product of a developing agent is a four-equivalent coupler, and wherein the developing agent is a compound represented by the above formula IV or V.

13. A silver halide color photographic light-sensitive material according to claim 11, wherein the compound capable of forming a dye by a coupling reaction with an oxidized product of a developing agent is a two-equivalent coupler, and wherein the developing agent is a compound represented by the above formula VI or VII.

14. A silver halide color photographic light-sensitive material according to claim 1, which has a magnetic recording layer.

* * * * *